US006040100A

United States Patent [19]

Tanaka et al.

[11] Patent Number: 6,040,100

[45] Date of Patent: Mar. 21, 2000

[54] ELECTROPHOTOGRAPHIC PHOTOSENSITIVE MEMBER, PROCESS CARTRIDGE AND ELECTROPHOTOGRAPHIC APPARATUS

[75] Inventors: Masato Tanaka, Shizuoka-ken; Hideyuki Takai, Yokohama; Kouichi Nakata, Numazu, all of Japan

[73] Assignee: Canon Kabushiki Kaisha, Tokyo, Japan

[21] Appl. No.: 09/261,504

[22] Filed: Mar. 3, 1999

[30] Foreign Application Priority Data

Mar. 4, 1998 [JP] Japan ..... 10-067690
Mar. 4, 1998 [JP] Japan ..... 10-067691

[51] Int. Cl.[7] ..... G03G 5/06

[52] U.S. Cl. ..... 430/72; 430/74

[58] Field of Search ..... 430/71, 72, 73, 430/74

[56] References Cited

U.S. PATENT DOCUMENTS 5,246,805 9/1993 Miyazaki et al. ..... 430/71
5,411,828 5/1995 Kashizaki ..... 430/71

FOREIGN PATENT DOCUMENTS 0322823 7/1989 European Pat. Off. .

OTHER PUBLICATIONS

Patent Abstracts of Japan, vol. 97, No. 1, Jan. 97 for JP8–227166.

Patent Abstracts of Japan, vol. 11, No. 170 (P–581) Jun. 1987 for JP 62–2267.

Patent Abstracts for Japan, vol. 96, No. 8, Aug. 1996 for JP8–87124.

*Primary Examiner*—John Goodrow
*Attorney, Agent, or Firm*—Fitzpatrick, Cella, Harper & Scinto

[57] ABSTRACT

An electrophotographic photosensitive member is formed of a support, and a photosensitive layer disposed on the support. The photosensitive layer is characterized by containing an azo pigment having an organic group represented by formula (1) below:

(1)

wherein A denotes a residue group of formula (1A) below:

(IA)

and $k_1$, $k_2$, $Z_1$, $Z_2$, D; $R_1$ and $R_2$ are defined in the text. The group of the formula (1) may provide at least one of up to 4 azo-substituents of the azo pigment having an entire structure represented by wherein Ar denotes an aromatic or heterocyclic core unit, Cp denotes a coupler residue group, and —(N=N—Cp) denotes such an azo-substituent. The photosensitive member can exhibit good electrophotographic performances including high and stable sensitivity on repetitive use.

17 Claims, 1 Drawing Sheet

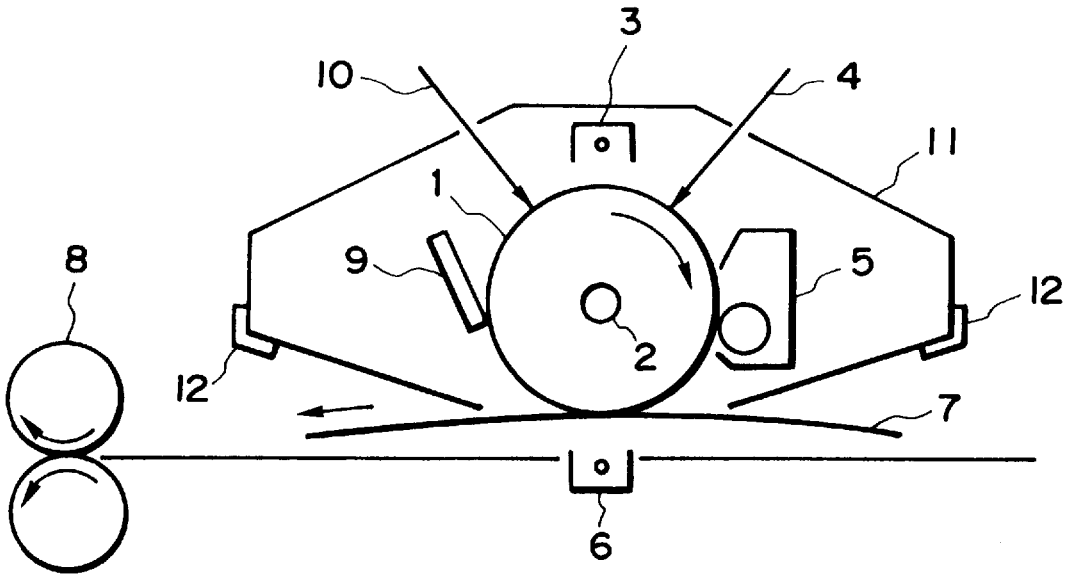
3
10
4
11
1
9
5
12
8
2
12
7
6

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member containing a photoconductive substance of a specific structure, and a photosensitive substance and an electrophotographic apparatus equipped with the electrophotographic photosensitive member.

Hitherto, inorganic photoconductive substances, such as selenium, cadmium sulfide and zinc oxide, have been extensively used as photoconductive substances for use in electrophotographic photosensitive members using an organic photoconductive substance has an advantage that it provides an extremely good productivity because of good film-formability of the organic photoconductive substance allowing the production by wet-coating, thus providing an inexpensive electrophotographic photosensitive member. Further, such an organic photosensitive member also has an advantage that the sensitive wavelength region can be arbitrarily controlled by selection of a dye or pigment used as the photoconductive substance, and therefore has been extensively studied heretofore.

Particularly, in recent years, function separation-type photosensitive members comprising in lamination a charge generation layer containing an organic photoconductive dye or pigment and a charge transport layer comprising a photoconductive polymer and a low-molecular weight photoconductive substance, have been developed to provide remarkable improvements in sensitivity and durability which have been regarded as defects of conventional organic electrophotographic photosensitive members.

It is known that azo pigments exhibit excellent photoconductivity, and compounds having various properties can be easily obtained by selective combination of an azo component and a coupler component. Accordingly, a large number of compounds have been proposed heretofore. Examples of such azo pigment compounds are disclosed in, e.g., Japanese Laid-Open Patent Application (JP-A) 47-37543, JP-A 53-132347, JP-A 54-22834, JP-A 58-70232, JP-A 60-131539, JP-A 62-2267, JP-A 62-192747, JP-A 63-262656, JP-A 63-264762 and JP-A 1-180554.

However, conventional electrophotographic photosensitive members using azo pigments are not necessarily sufficient in respects of sensitivity and potential stability on repetitive use, so that only a few materials have been commercialized.

SUMMARY OF THE INVENTION

A generic object of the present invention is to provide a novel electrophotographic photosensitive member.

A more specific object of the present invention is to provide an electrophotographic photosensitive member having practically high sensitivity and stable potential characteristic on repetitive use.

Another object of the present invention is to provide a process cartridge and an electrophotographic apparatus using the electrophotographic photosensitive member.

According to the present invention, there is provided an electrophotographic photosensitive member, comprising a support, and a photosensitive layer disposed on the support; said photosensitive layer containing an azo pigment having an organic group represented by formula (1) below:

(1)

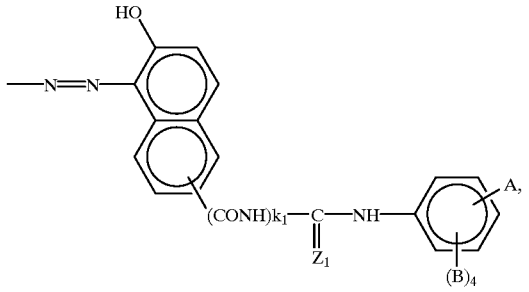

wherein each B independently denotes a hydrogen atom, halogen atom, nitro group, cyano group, substituted or unsubstituted alkyl group, substituted or unsubstituted alkoxy group, or substituted or unsubstituted amino group; $Z_1$ denotes an oxygen or sulfur atom; $k_1$ is 0 or 1; A denotes a residue group of formula (1A) below:

(IA)

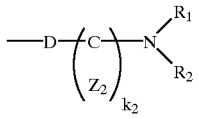

wherein $R_1$ and $R_2$ independently denote a hydrogen atom, a substituted or unsubstituted alkyl group, substituted or unsubstituted aralkyl group, a substituted or unsubstituted aryl group, a substituted or unsubstituted heterocyclic group, or a group forming a substituted or unsubstituted cyclic group by a combination of the groups R1 and R2 together with the nitrogen (N) atom in the formula (1A); $Z_2$ denotes an oxygen atom or sulfur atom; $k_2$ is 1 or 2; D denotes a substituted or unsubstituted alkylene group, substituted or unsubstituted alkenylene group or and $k_3$ is 0 or 1.

The present invention further provides a process cartridge and an electrophotographic apparatus respectively including the above-mentioned electrophotographic photosensitive member.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing is a schematic illustration of an electrophotographic apparatus including a process cartridge which in turn includes an embodiment of the electrophotographic photosensitive member according to the invention.

DETAILED DESCRIPTION OF THE INVENTION

As described above, the electrophotographic photosensitive member according to the present invention comprises a support and a photosensitive layer disposed on the support, and the photosensitive layer is characterized by containing an azo pigment having an organic group represented by formula (1) below:

(1)

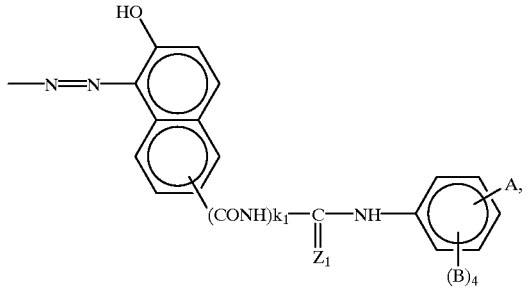

wherein each B independently denotes a hydrogen atom, halogen atom, nitro group, cyano group, substituted or unsubstituted alkyl group, substituted or unsubstituted alkoxy group, or substituted or unsubstituted amino group; $Z_1$ denotes an oxygen or sulfur atom; $k_1$ is 0 or 1; A denotes a residue group of formula (1A) below:

(IA)

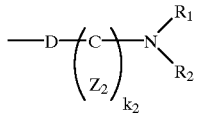

wherein $R_1$ and $R_2$ independently denote a hydrogen atom, a substituted or unsubstituted alkyl group, a substituted or unsubstituted aralkyl group, a substituted or unsubstituted aryl group, a substituted or unsubstituted heterocyclic group, or a group forming a substituted or unsubstituted cyclic group by a combination of the groups R1 and R2 together with the nitrogen (N) atom in the formula (1A); $Z_2$ denotes an oxygen atom or sulfur atom; $k_2$ is 1 or 2; D denotes a substituted or unsubstituted alkylene group, substituted or unsubstituted alkenylene group or

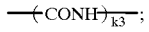

and $k_3$ is 0 or 1.

In the formula (1), a group of formula (1B) below may preferably be attached to a carbon of 6-position of the naphthalene ring with respect to the azo group in view of the electrophotographic performances:

(1B)

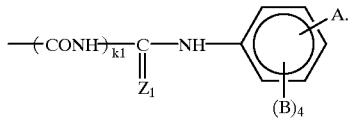

As for each substituent B, examples of the alkyl group may include methyl, ethyl and propyl; examples of the alkoxy group may include methoxy and ethoxy; and examples of the amino group may include amino and dimethylamino. Further, examples of the substituent optionally possessed by these groups may include: halogen atoms, such as fluorine, chlorine, bromine and iodine, nitro group, and cyano group.

As for the groups R1 and R2 in the residue group A of formula (1A), examples of the alkyl group may include methyl, ethyl, propyl and butyl; examples of the aralkyl group may include benzyl, phenetyl and naphthyl methyl; examples of the aryl group may include phenyl, biphenyl, naphthyl and anthryl; and examples of the heterocyclic group may include; pyridyl, thienyl, furyl, thiazolyl, carbazolyl, dibenzofuryl, benzoimidazolyl, and benzothiazolyl. Examples of the substituent optionally possessed by the above-mentioned alkyl group may include: halogen atoms, such as fluorine, chlorine, bromine and iodine; nitro group and cyano group. Examples of the substituent optionally possessed by the above-mentioned aralkyl group, aryl group and heterocyclic group may include: alkyl groups, such as methyl, ethyl and propyl; halogen atoms, such as fluorine, chlorine, bromine and iodine; alkylamino groups, such as dimethylamino and diethylamino; phenylcarbamoyl, nitro, cyano, and halo-methyl groups, such as trifluoromethyl.

Examples of the cyclic amino group formed by the groups R1, R2 and the nitrogen (N) in the formula (1A) may include: pyrrolyl, pyrrolinyl, pyrrolidinyl, indolyl, piperidinyl, piperazinyl, isoindolyl, carbazolyl, benzoindolyl, imidazolyl, pyrazolyl, pyrazolinyl, oxadinyl, phenoxadinyl and benzocarbolyl. Examples of the substituent optionally possessed by these cyclic amino groups may include: alkyl groups, such as methyl, ethyl and propyl; alkoxy groups, such as methoxy and ethoxy; halogen atoms, such as fluorine, chlorine, bromine and iodine; nitro, cyano and halo-methyl groups, such as trifluoromethyl.

As will be described hereinafter, R1 may preferably be a hydrogen atom so as to exhibit an interaction between pigment molecules owing to hydrogen-bonding capability. Further, in the case where R1 is hydrogen, R2 may preferably be a substituted or unsubstituted alkyl group, or substituted or unsubstituted aralkyl group, or substituted or unsubstituted aryl group. Among these, a substituted or unsubstituted aryl group is particularly preferred, and substituted or unsubstituted phenyl is most preferred.

As for the group D, examples of the alkylene group may include: methylene, ethylene and propylene; and examples of the alkenylene group may include: vinylene and propenylene. Examples of the substituted optionally possessed by the alkylene and alkenylene groups may include: halogen atoms, such as fluorine, chlorine, bromine and iodine, nitro group and cyano group.

The group D (alkylene or alkenylene) may preferably be $—CH_2—$, $—CH_2CH_2—$, $—CH(CH_3)—$, $—CH_2CH_2CH_2—$ or —CH=CH— in case of $k_2$=1, and may preferably be $—CH_2—$ in case of $k_2$=2. Further, in case where D is one of these preferable groups, it is preferred that all the four groups B are hydrogen atoms, and $Z_2$ is an oxygen atom.

The azo pigment used in the present invention may preferably have an entire structure including a core unit to which the organic group of the formula (1) is bonded. The core unit includes at least one ring unit each comprising at least one of substituted or unsubstituted aromatic hydrocarbon rings and substituted or unsubstituted heterocyclic rings with the proviso that a plurality of such ring units can be bonded to each other via an intervening bonding group. Each ring unit may be composed of one ring or a plurality of fused rings. The core unit can comprise a single ring unit but may preferably comprise a plurality of such ring units bonded directly or via an intervening bonding group. The nature and examples of such an intervening bonding group will be understood from not a few preferred examples of the combinations of the ring units described below and the azo pigment enumerated hereinafter.

Examples of the ring units, i.e., (optionally substituted) aromatic hydrocarbon ring(s) and/or heterocyclic ring(s), may include: hydrocarbon rings, such as benzene, naphthalene, fluorene, phenanthrene, anthracene and pyrene; heterocyclic rings, such as furan, thiophene, pyridine, indole, benzothiazole, carbazole, acridone, dibenzothiophene, benzoxazole, oxadiazole, and thiazole; and combination of such hydrocarbon ring(s) and/or heterocyclic ring(s) bonded directly or via an aromatic group or non-aromatic group, such as biphenyl, binaphthyl, diphenylamine, triphenylamine, N-methyldiphenylamine, fluorenone, phenanthrenequinone, anthraquinone, benzanthrone, anthanthrone, terphenyl, diphenyloxadiazole, stilbene, distyrylbenzene, azobenzene, azoxybenzene, phenylbenzoxazole, diphenylmethane, diphenylsulfone, diphenyl ether, benzophenone, tetraphenyl-p-phenylenediamine, tetraphenylbenzidine, N-phenyl-2-pyridylamine, and N,N-diphenyl-2-pyridylamine.

Examples of the substituent optionally possessed by the aromatic hydrocarbon ring(s) and/or heterocyclic ring(s) may include: alkyl groups, such as methyl, ethyl, propyl and butyl; alkoxy groups, such as methoxy and ethoxy; dialkylamino groups, such as dimethylamino and diethylamino; halogen atoms, such as fluorine, chlorine, bromine and iodine; nitro, cyano and halo-methyl groups.

More specifically, the azo pigment used in the present invention may preferably have a structure represented by the following formula (2):

$$Ar(N{=}N{-}Cp)_n \quad (2),$$

wherein Ar denotes a core unit as described above including at least one ring unit each comprising at least one of substituted or unsubstituted aromatic hydrocarbon rings and substituted or unsubstituted heterocyclic rings with the proviso that a plurality of such ring units can be bonded to each other via an intervening bonding group; n is an integer of 1–4; and each Cp denotes a coupler residue group having a phenolic hydroxy group with the proviso that at least one of up to 4 Cp groups constitutes the organic group of the formula (1). In the present invention, it is preferred that n is at least 2, and n=2 is particularly preferred in view of the electrophotographic performances of the resultant photosensitive member.

Examples of the coupler groups Cp in the formula (2) other than that constituting the organic group of the formula (1) may include those of the following formula (3)–(16) while these are not exhaustive.

(3)

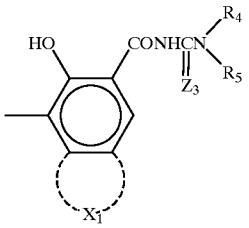

-continued (4)

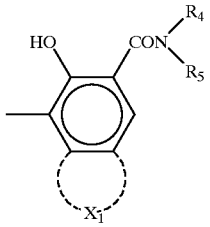

(5)

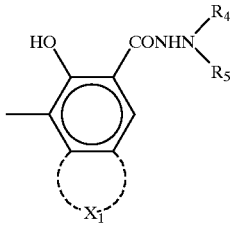

(6)

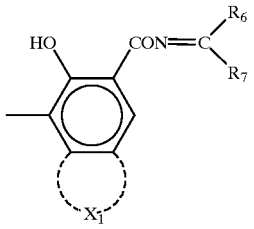

(7)

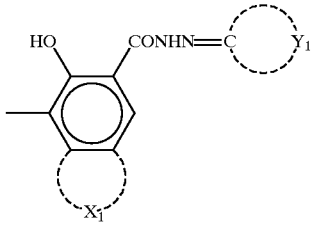

(8)

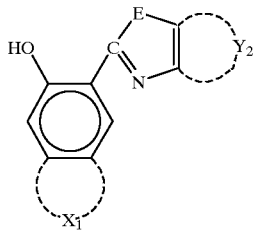

-continued (9)

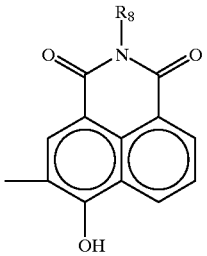

(10)

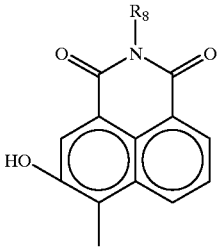

(11)

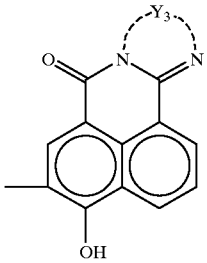

(12)

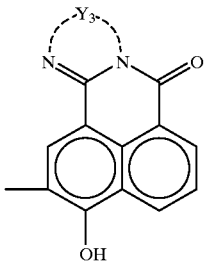

(13)

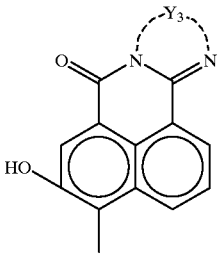

-continued (14)

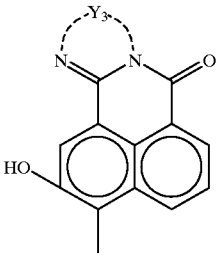

(15)

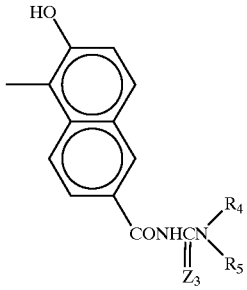

(16)

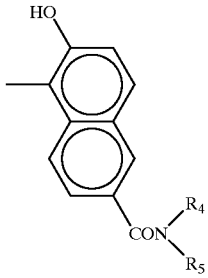

In the above formulae, X1 represents an organic residue group condensed with the benzene ring to form an aromatic hydrocarbon ring or heterocyclic ring, such as a substituted or unsubstituted naphthalene ring, substituted or unsubstituted anthracene ring, substituted or unsubstituted carbazole ring, substituted or unsubstituted benzocarbazole ring, substituted or unsubstituted dibenzofuran ring, substituted or unsubstituted benzonaphthofuran ring, substituted or unsubstituted fluorenone ring, substituted or unsubstituted dibenzophenylene sulfite ring, substituted or unsubstituted quinoline ring, substituted or unsubstituted isoquinoline ring, or substituted or unsubstituted acridine ring;

R4 and R5 independently denote a hydrogen atom, a substituted or unsubstituted alkyl group, a substituted or unsubstituted aralkyl group, a substituted or unsubstituted aryl group, a substituted or unsubstituted heterocyclic group, or a group forming a substituted or unsubstituted cyclic amino group by combination of the groups R4 and R5 with the nitrogen in the formula concerned;

R6 and R7 independently denote a hydrogen atom, a substituted or unsubstituted alkyl group, a substituted or unsubstituted aralkyl group, a substituted or unsubstituted aryl group, or a substituted or unsubstituted heterocyclic group;

R8 denotes a substituted or unsubstituted alkyl group, a substituted or unsubstituted aralkyl group, a substituted or unsubstituted aryl group, or a substituted or unsubstituted heretocyclic group;

Y1 denotes a divalent group forming a substituted or unsubstituted hydrocarbon ring group or heterocyclic group together with the carbon in the formula concerned with preferred examples of the hydrocarbon ring group or heterocyclic group of

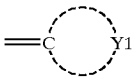

including the following:

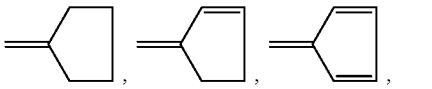

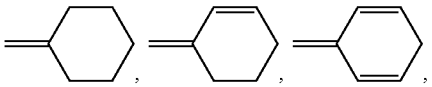

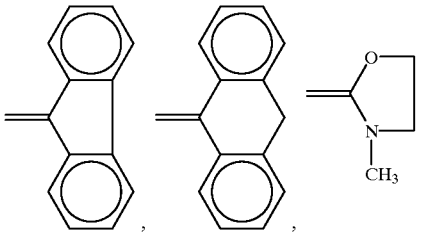

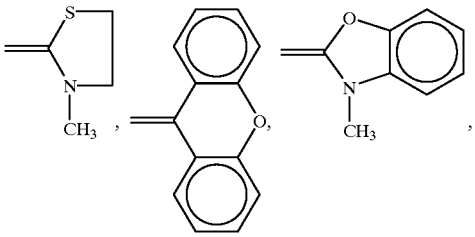

-continued

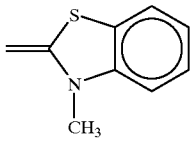

Y2 denotes a substituted or unsubstituted divalent aromatic hydrocarbon ring group, such as o-phenylene, o-naphthylene, peri-naphthylene, 1,2-anthrylene, or 9,10-phenanthrylene;

Y3 denotes a substituted or unsubstituted divalent aromatic hydrocarbon ring group or nitrogen-containing heterocyclic group with examples of the divalent aromatic hydrocarbon ring group including: o-phenylene, o-naphthylene, peri-naphthylene, 1,2-anthrylene and 9,10-phenanthrylene, and with examples of the divalent nitrogen-containing heterocyclic group including: 3,4-pyrazole-di-yl, 2,3-pyridine-di-yl, 4,5-pyridine-di-yl, 6,7-imidazole-di-yl, 5,6 -benzimidazole-di-yl, and 6,7-quinoline-di-yl;

E denotes an oxygen atom, sulfur atom or N-substituted or unsubstituted imino group with examples of the N-substituent including: substituted or unsubstituted aralkyl group, substituted or unsubstituted aralkyl group, and substituted or unsubstituted aryl group such as phenyl and naphthyl; and Z3 is an oxygen atom or sulfur atom.

As for the groups R4 to R8 and E in the above formulae (3)–(16), examples of the alkyl group may include: methyl, ethyl and propyl; the aralkyl group: benzyl, phenethyl and naphthyl; the aryl group: phenyl, diphenyl, naphthyl and anthryl; the heterocyclic group: pyridyl, thienyl, furyl, thiazolyl, carbazolyl, dibenzofuryl, benzimidazolyl and benzothiazolyl; the nitrogen-containing cyclic amino group: those derived from the corresponding amines of pyrrole, pyrroline, pyrrolidine, pyrrolidone, indole, indaline, isoindole, carbazole, benzindole, imidazole, pyrazole, pyrazoline, oxadine, phenoxazine and benzcarbazole.

Further, examples of the optional substituents that may be contained the groups X1, R4–R8, Y1–Y3 and E may include: alkyl groups, such as methyl, ethyl, propyl and butyl; alkoxy groups, such as methoxy and ethoxy; halogen atoms, such as fluorine, chlorine, bromine and iodine; alkylamino groups, such as dimethylamino and diethylamino; phenylcarbamoyl, nitro, cyano and halo-methyl groups, such as trifluoromethyl.

Preferred examples of the azo pigment used in the present invention are enumerated hereinbelow with their example numbers each followed by its entire structural formula on the left side and structural formula of the coupler residue (Cp) in the entire structural formula on the right side.

Pigment (1)-1
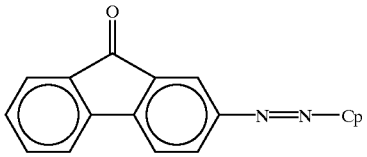
Cp:
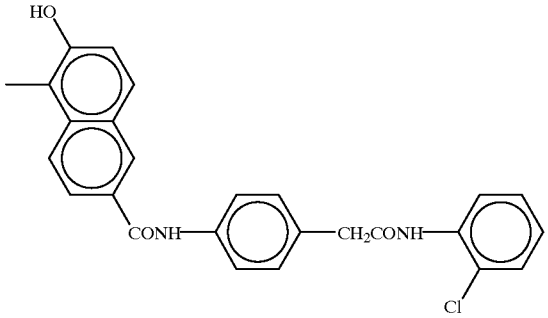
Pigment (1)-2
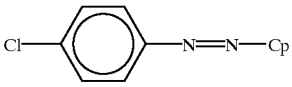
Cp:
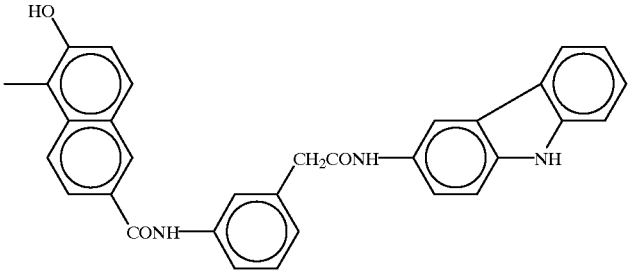
Pigment (1)-3
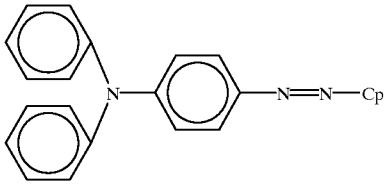
Cp:
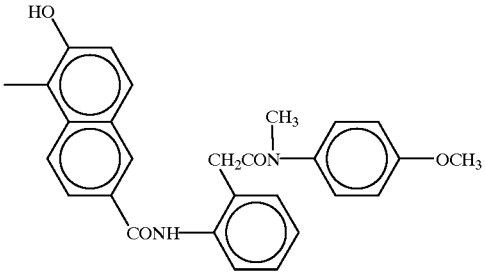
Pigment (1)-4
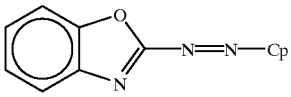
Cp:
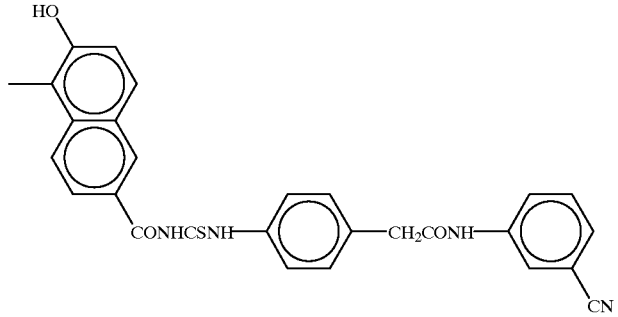

-continued
Pigment (1)-5
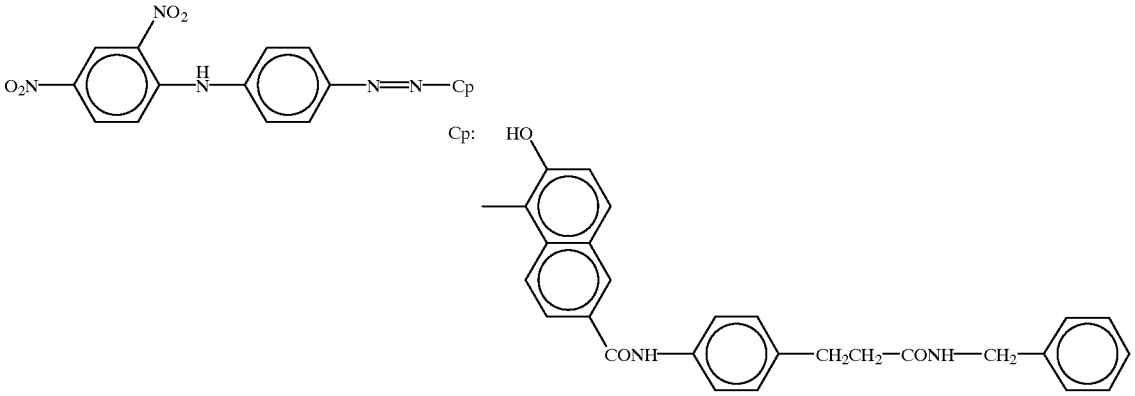
Pigment (1)-6
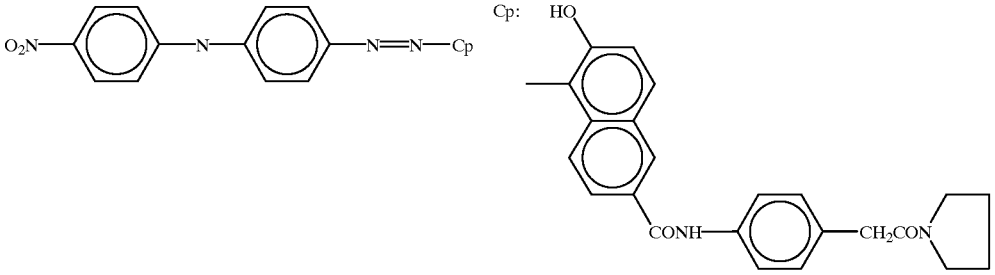
Pigment (1)-7
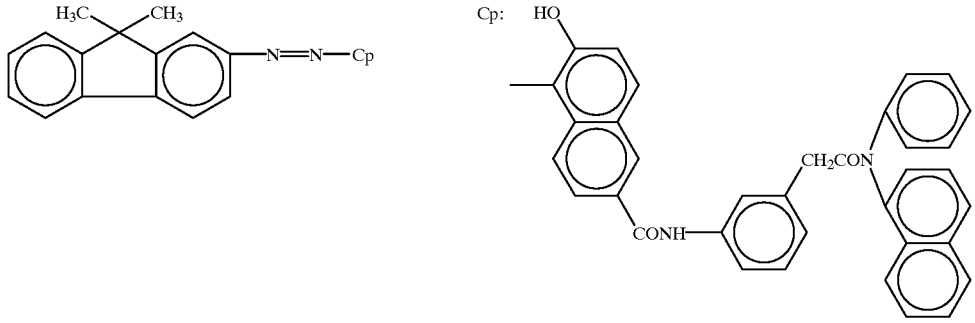
Pigment (1)-8
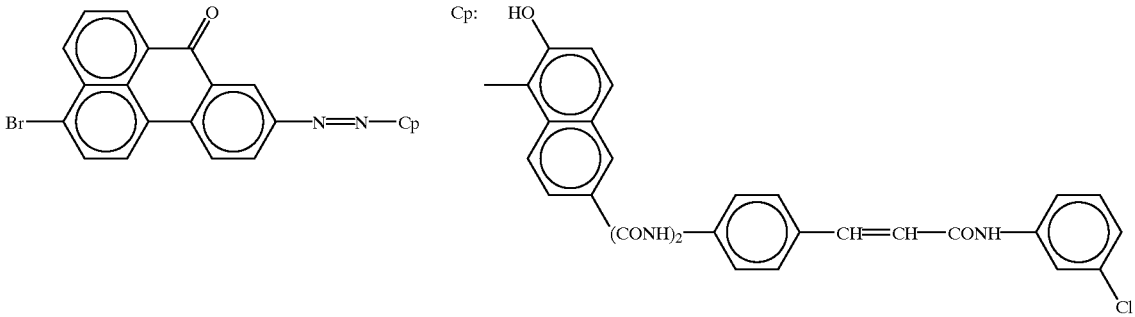

-continued
Pigment (2)-1
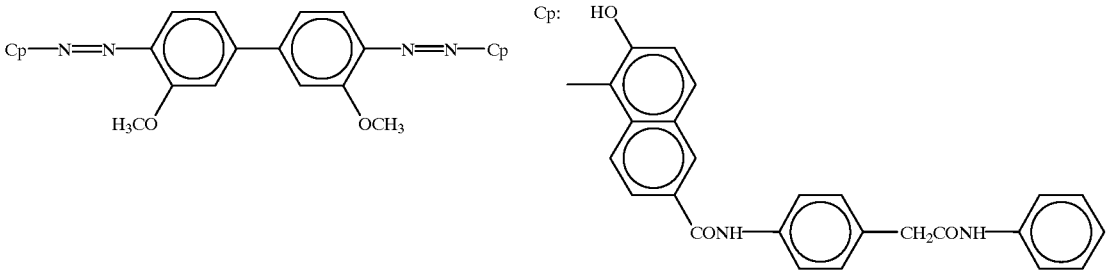
Pigment (2)-2
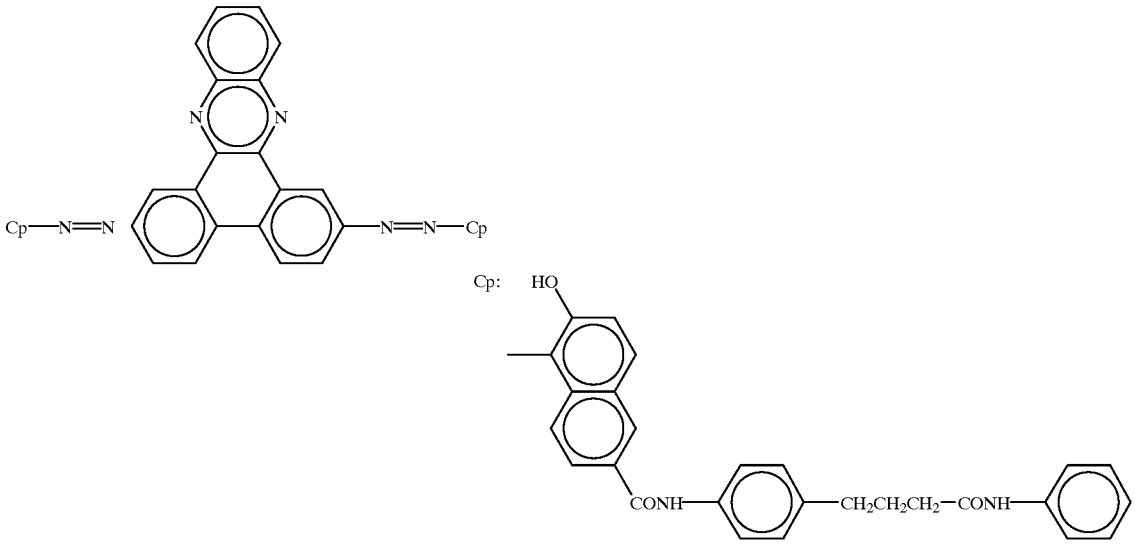
Pigment (2)-3
Structure: same as the above
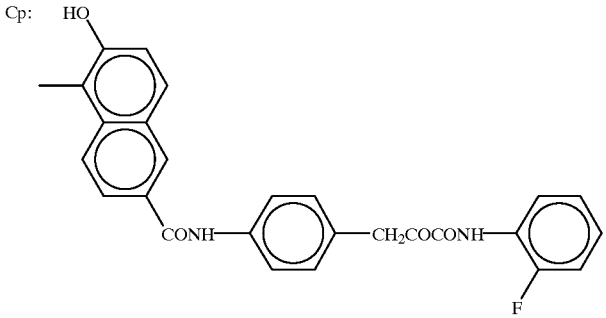
Pigment (2)-4
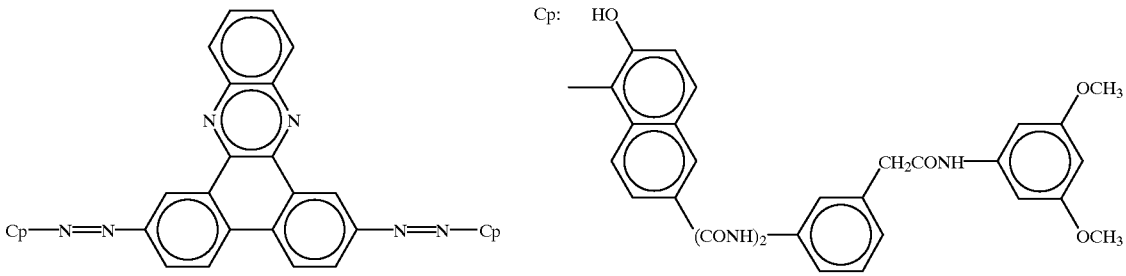

-continued
Pigment (2)-5
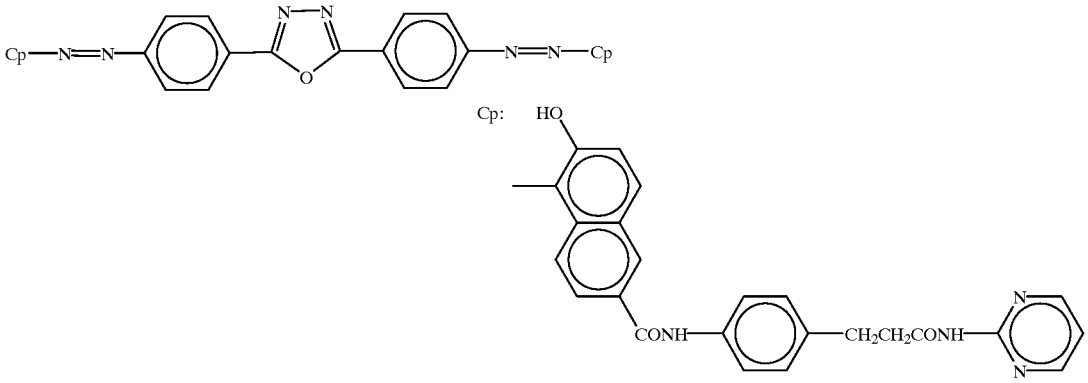
Pigment (2)-6
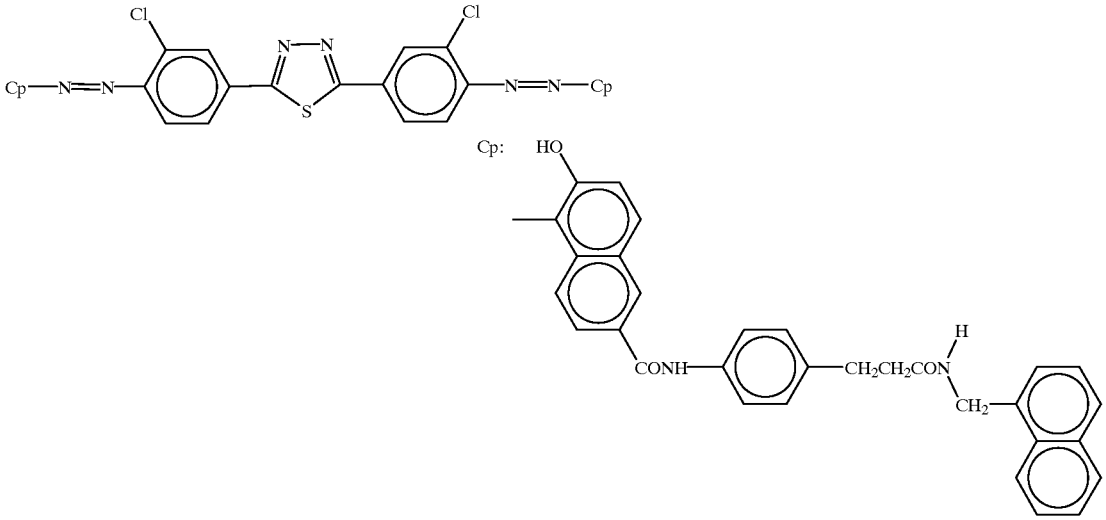
Pigment (2)-7
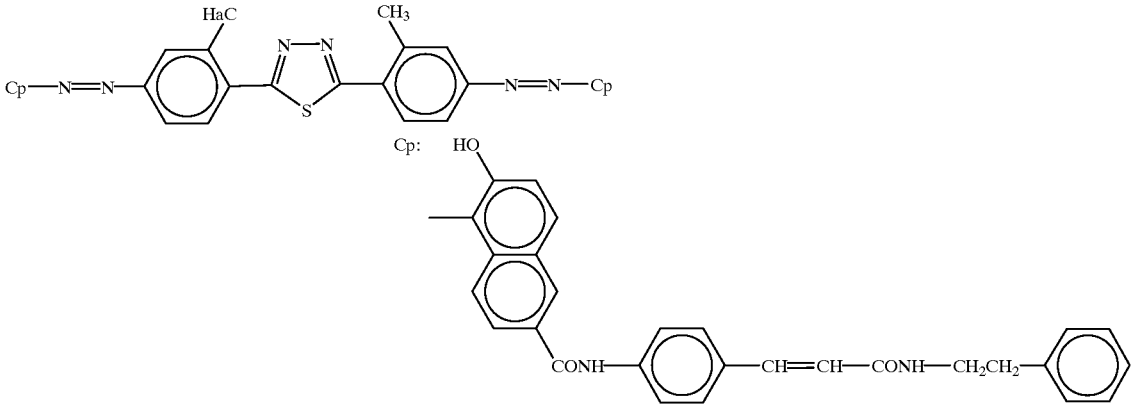

-continued
Pigment (2)-8
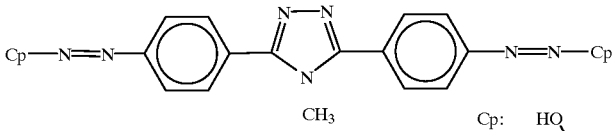
Cp:
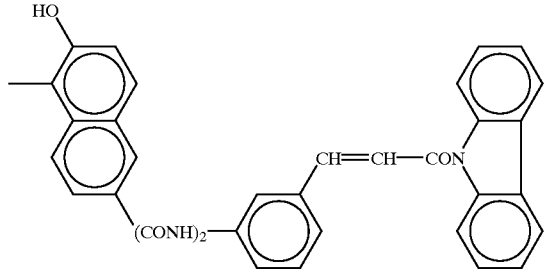
Pigment (2)-9
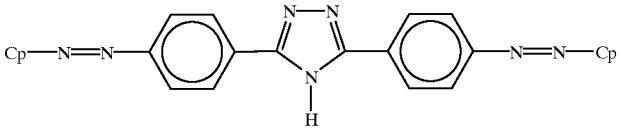
Cp:
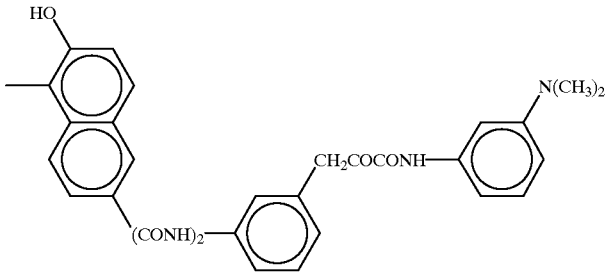
Pigment (2)-10
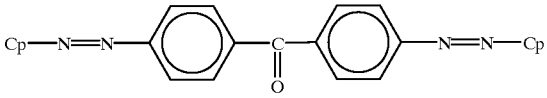
Cp:
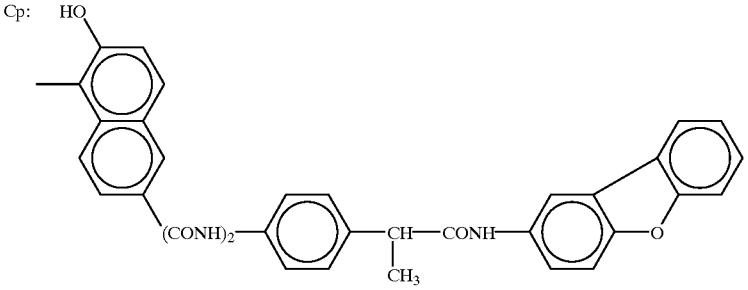
Pigment (2)-11
Structure: same as the above
Cp:
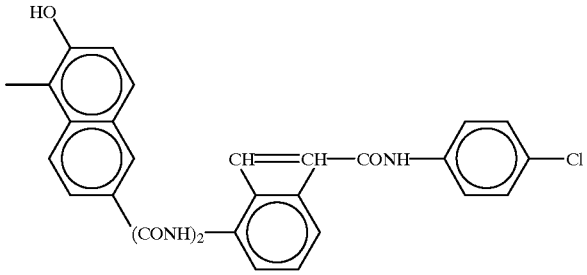

-continued
Pigment (2)-12
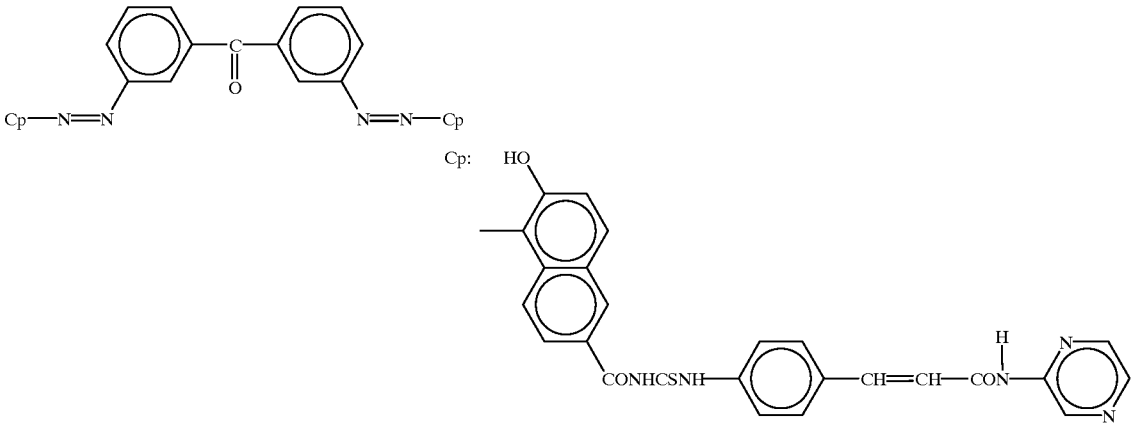
Pigment (2)-13
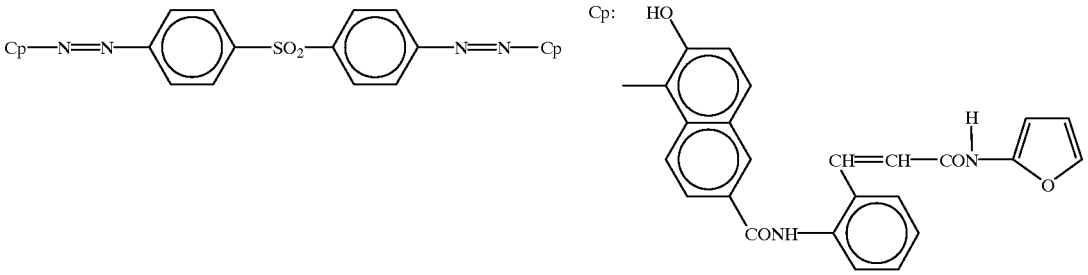
Pigment (2)-14
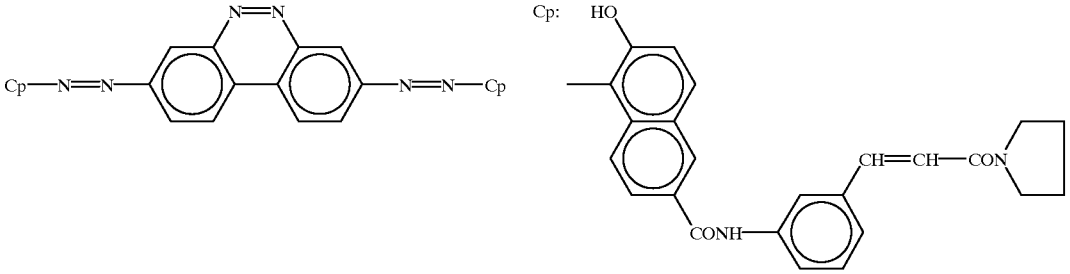
Pigment (2)-15
Structure: same as the above
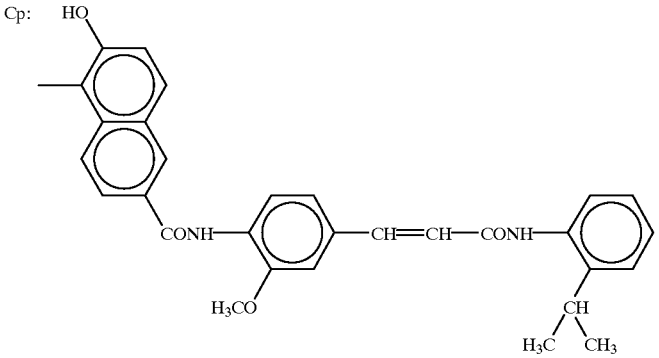

-continued
Pigment (2)-16
Structure: same as the above
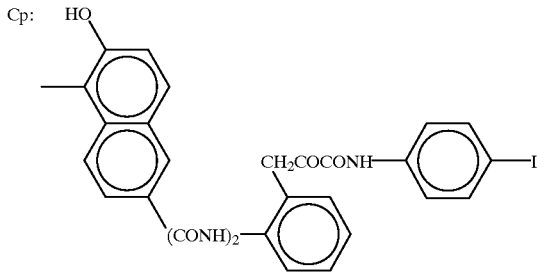
Pigment (2)-17
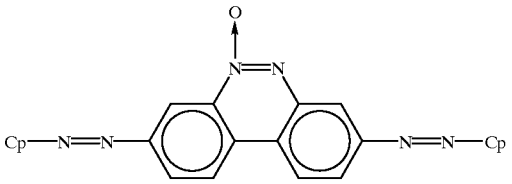
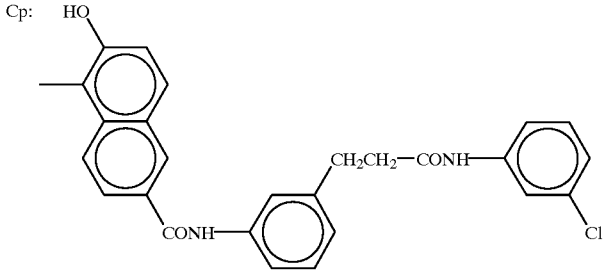
Pigment (2)-18
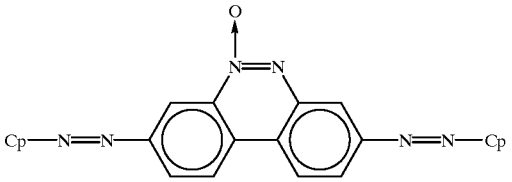
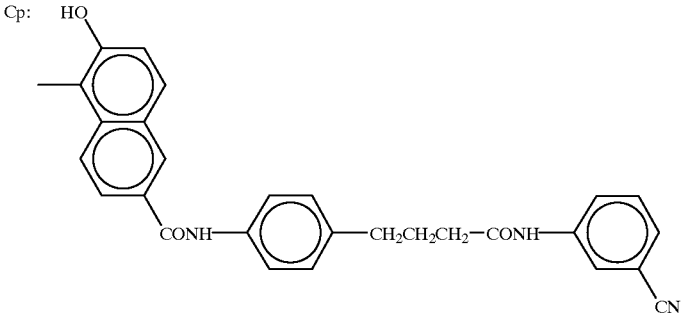
Pigment (2)-19
Structure: same as the above
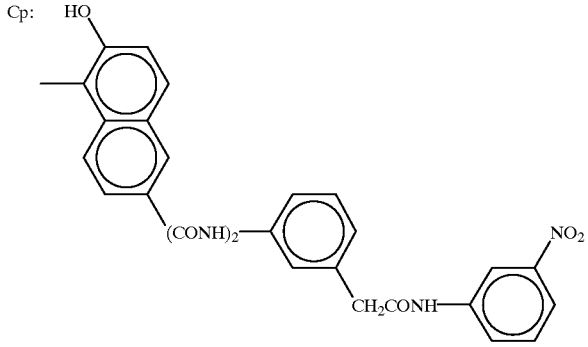

-continued
Pigment (2)-20
Structure: same as the above
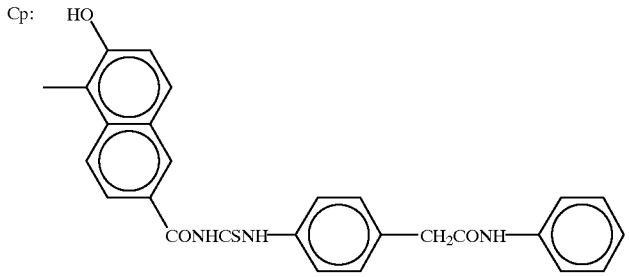
Pigment (2)-21
Structure: same as the above
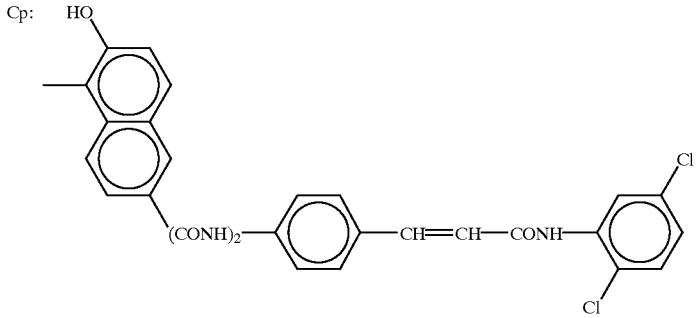
Pigment (2)-22
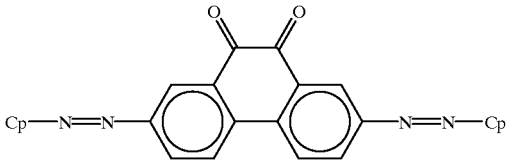
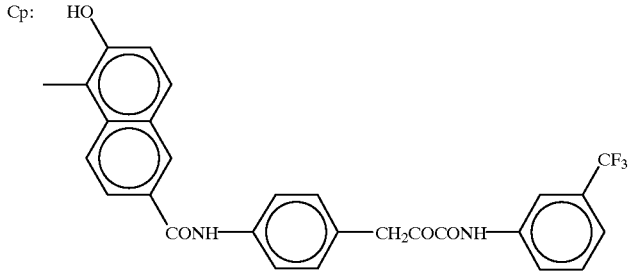
Pigment (2)-23
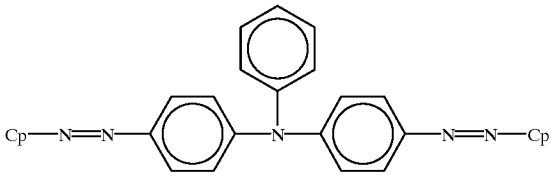
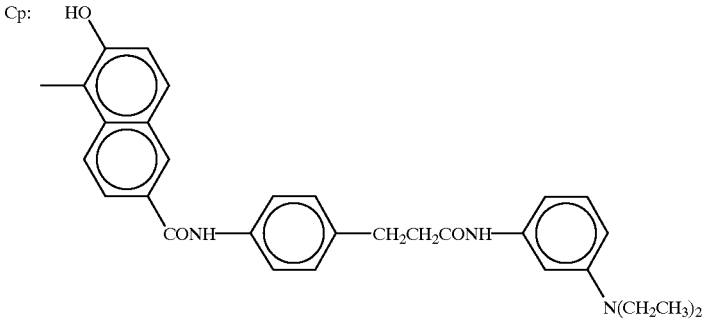

-continued
Pigment (2)-24
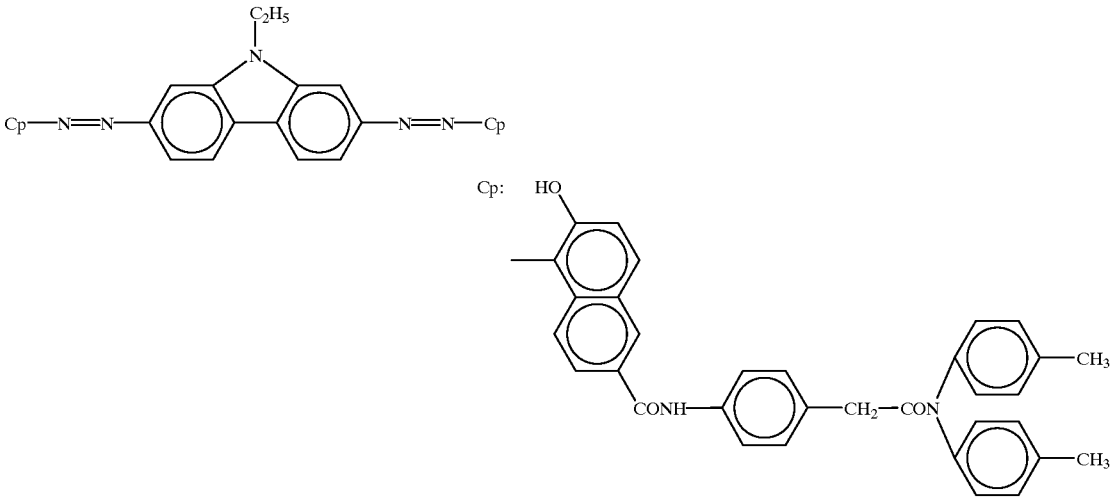
Pigment (2)-25
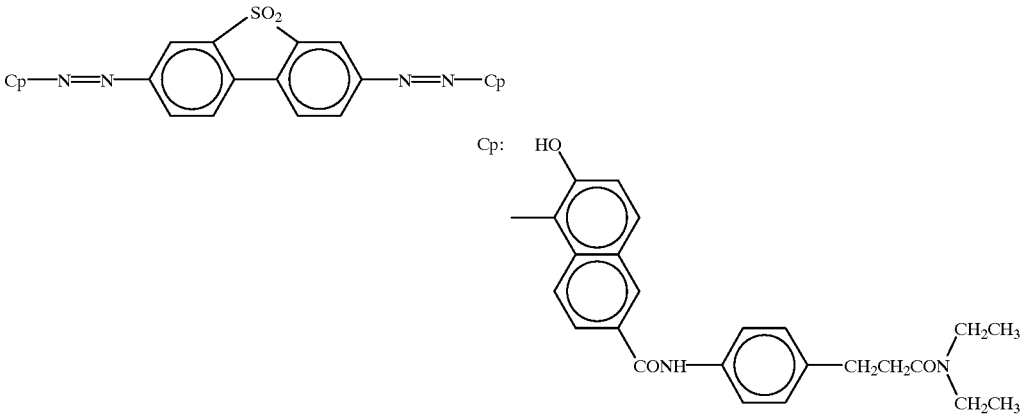
Pigment (2)-26
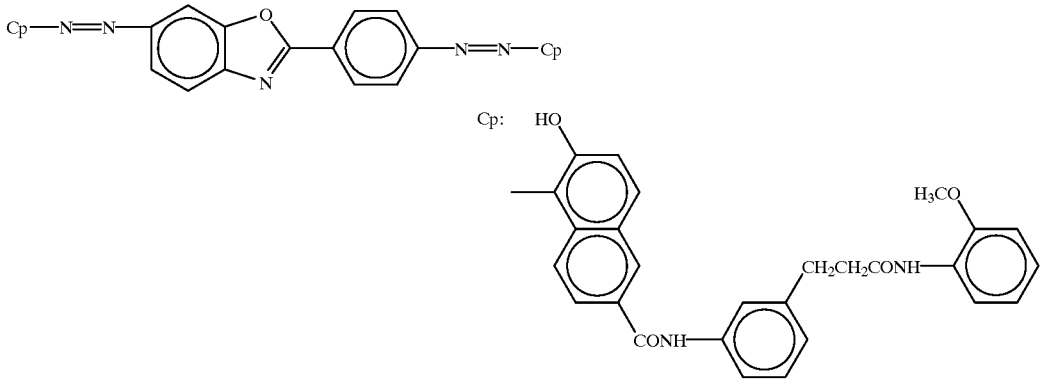

-continued
Pigment (2)-27
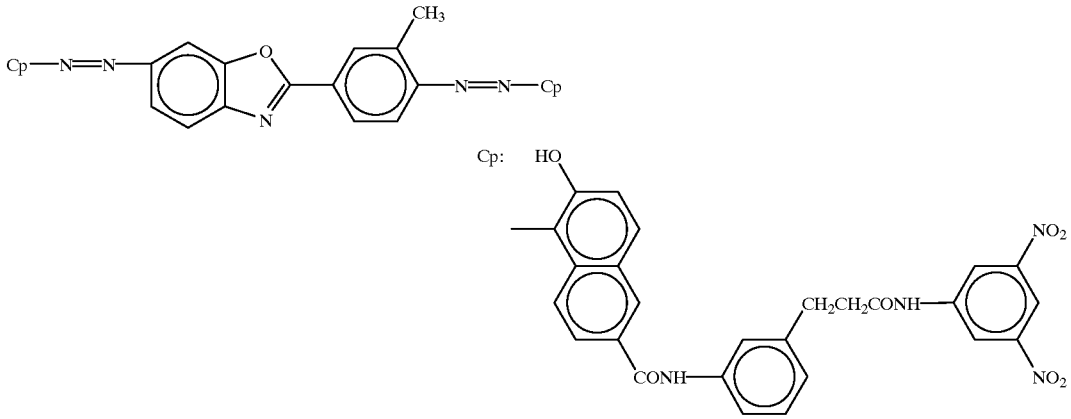
Pigment (2)-28
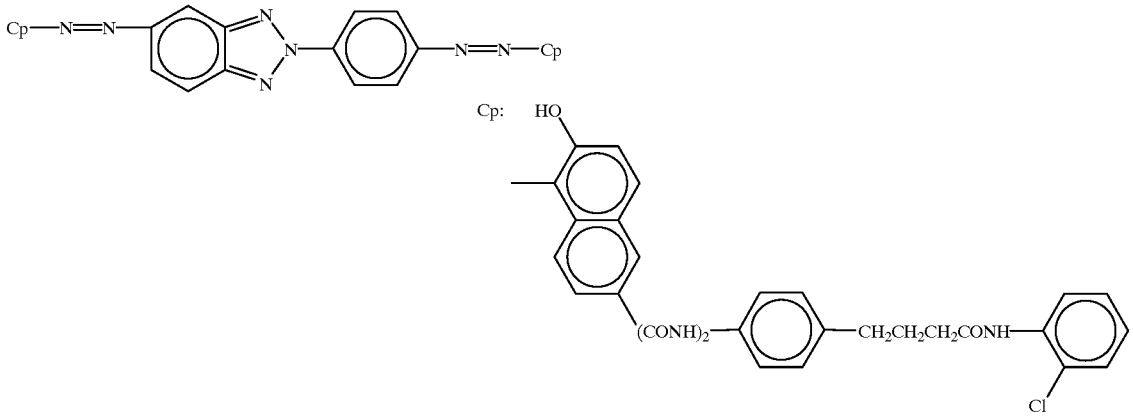
Pigment (2)-29
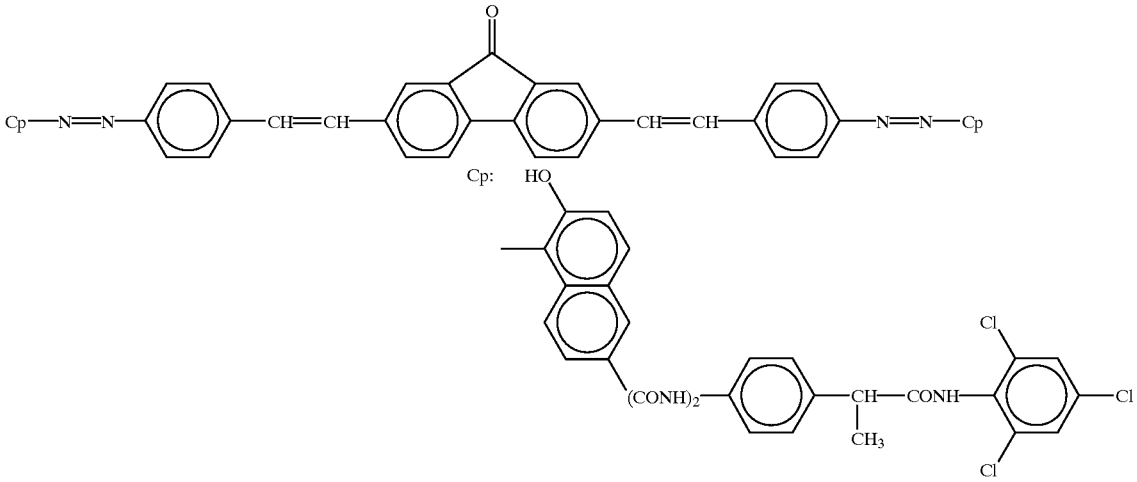

-continued
Pigment (2)-30
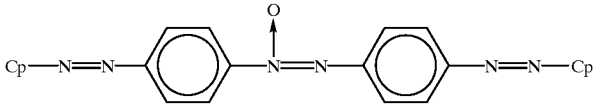
Cp:
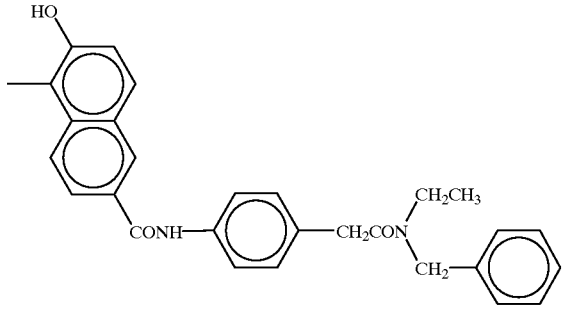
Pigment (2)-31
Structure: same as the above
Cp:
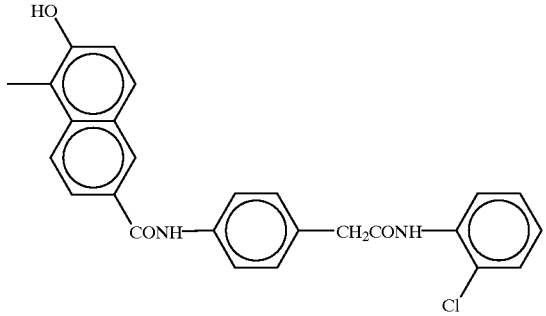
Pigment (2)-32
Structure: same as the above
Cp:
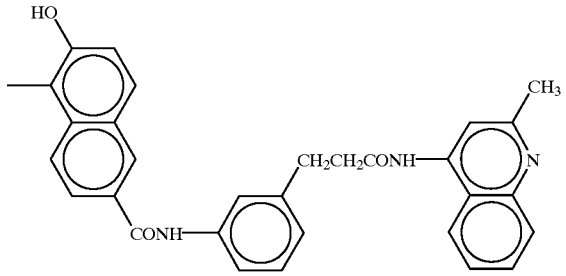
Pigment (2)-33
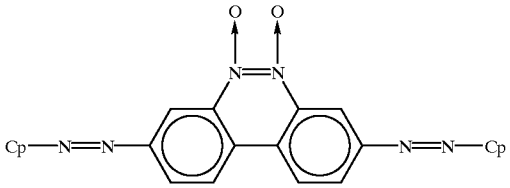
Cp:
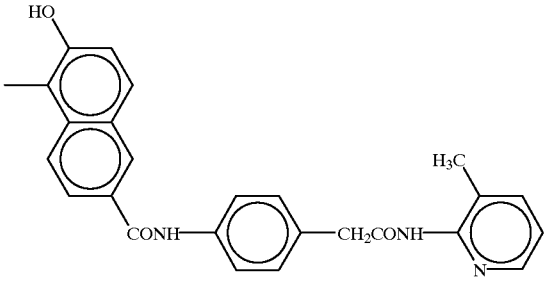

-continued
Pigment (2)-34
Structure: same as the above
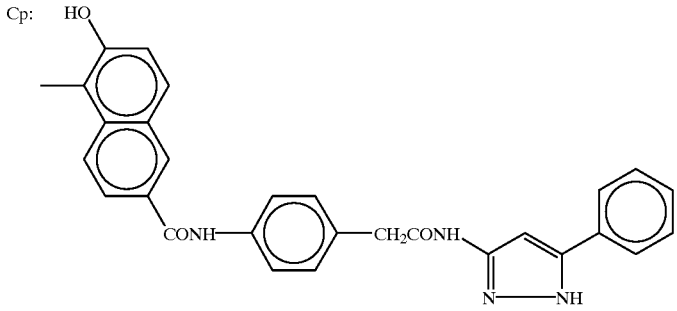
Pigment (2)-35
Structure: same as the above
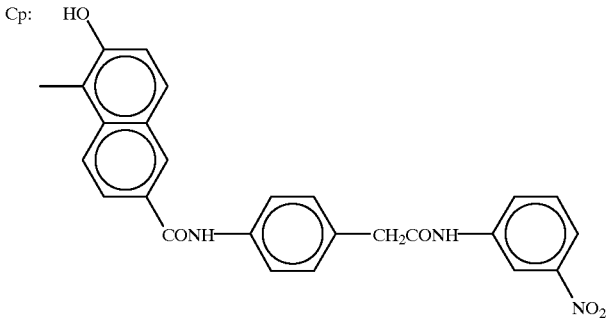
Pigment (2)-36
Structure: same as the above
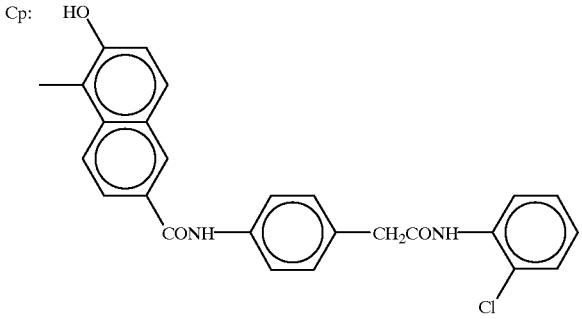
Pigment (2)-37
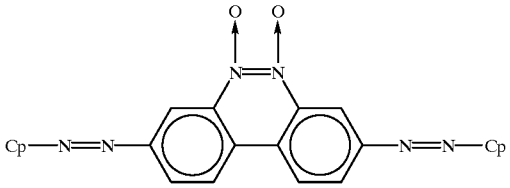
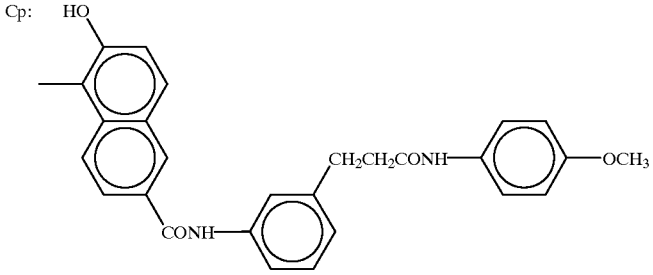

-continued
Pigment (2)-38
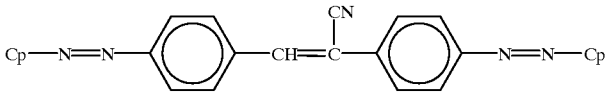
Cp:
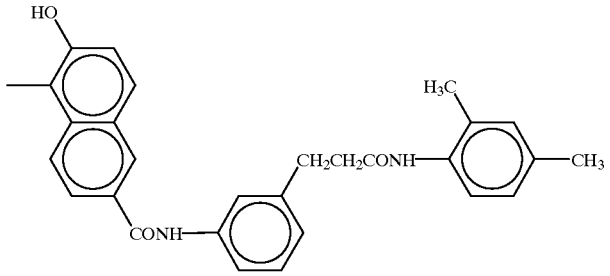
Pigment (2)-39
Structure: same as the above
Cp:
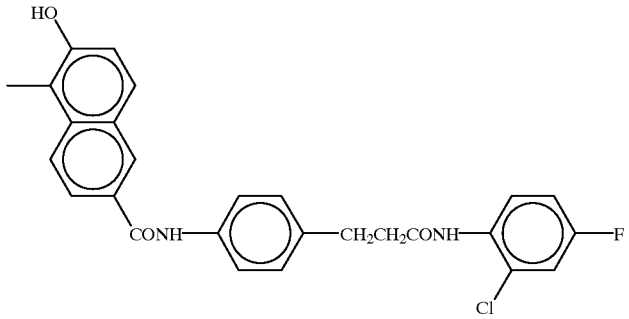
Pigment (2)-40
Structure: same as the above
Cp:
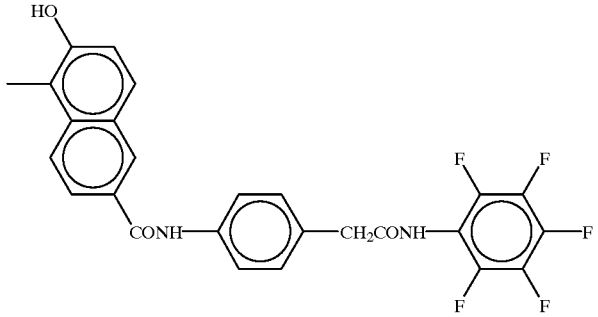
Pigment (2)-41
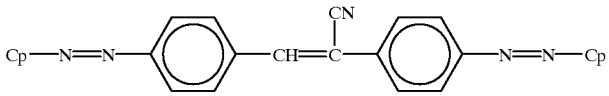
Cp:
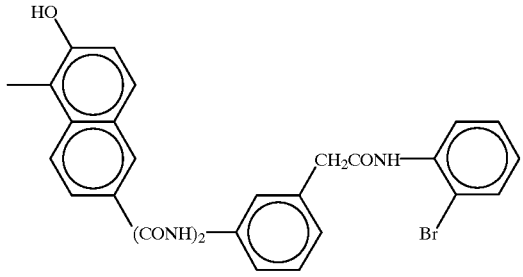

-continued
Pigment (2)-42
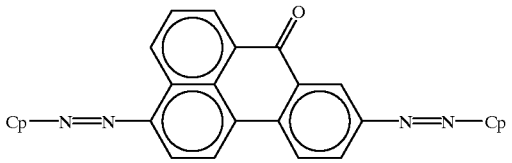
Cp:
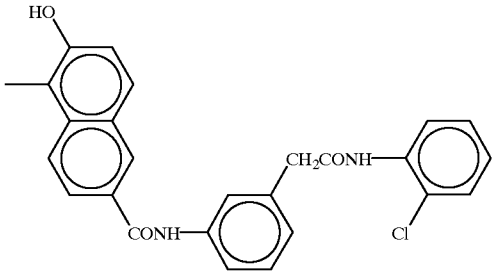
Pigment (2)-43
Structure: same as the above
Cp:
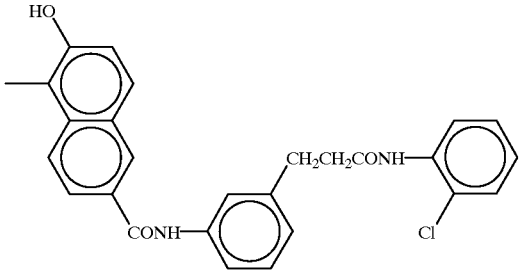
Pigment (2)-44
Structure: same as the above
Cp:
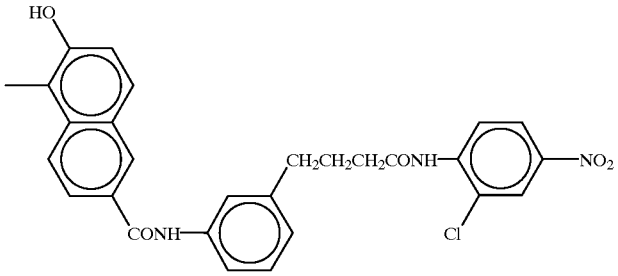
Pigment (2)-45
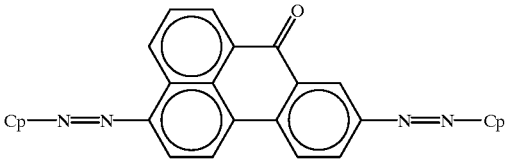
Cp:
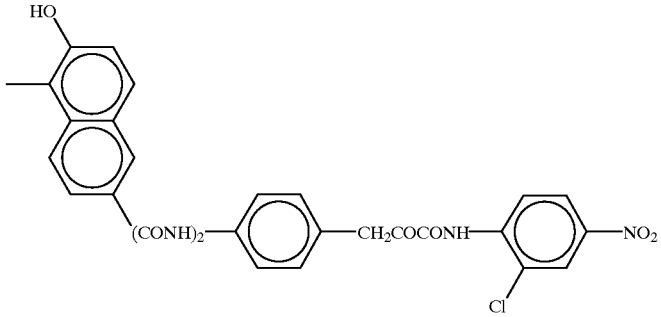

-continued
Pigment (2)-46
Structure: same as the above
Cp:
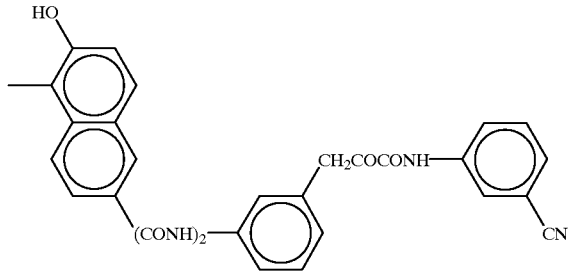
Pigment (2)-47
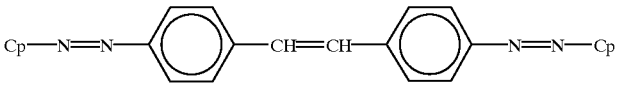
Cp:
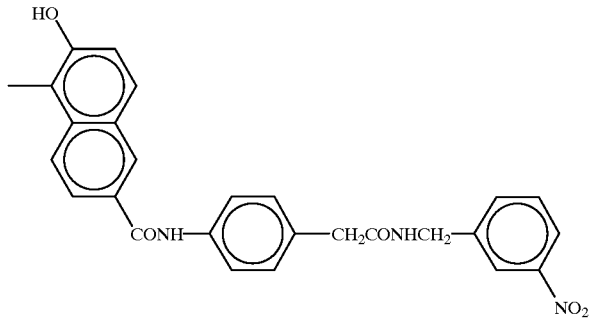
Pigment (2)-48
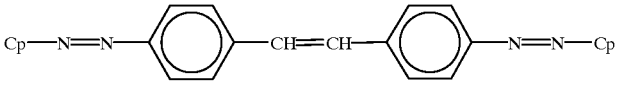
Cp:
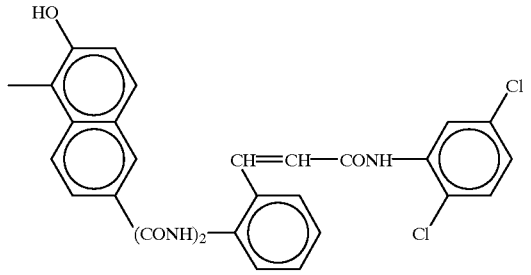
Pigment (2)-49
Structure: same as the above
Cp:
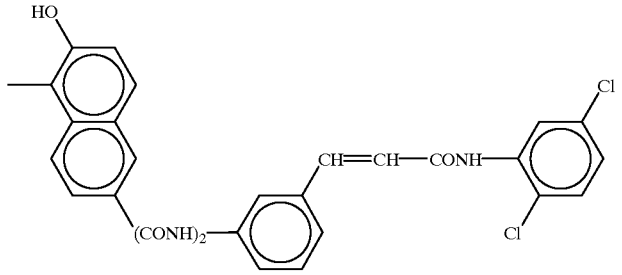

-continued
Pigment (2)-50
Structure: same as the above
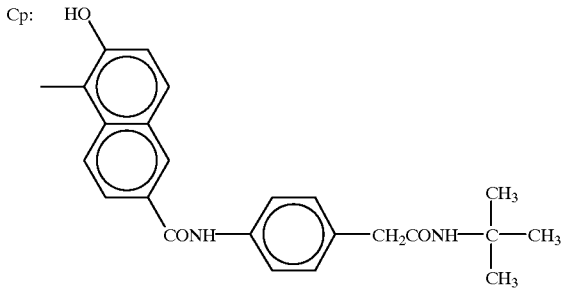
Pigment (2)-51
Structure: same as the above
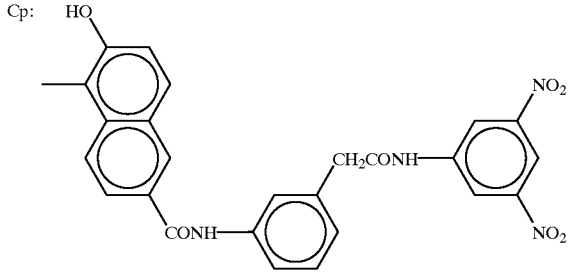
Pigment (2)-52
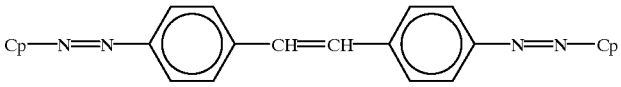
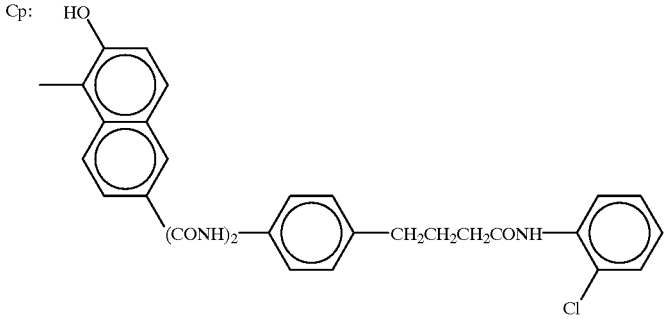
Pigment (2)-53
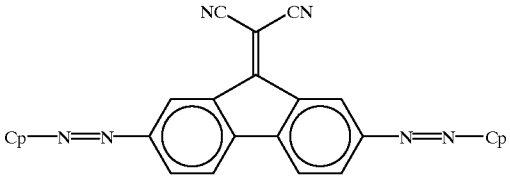
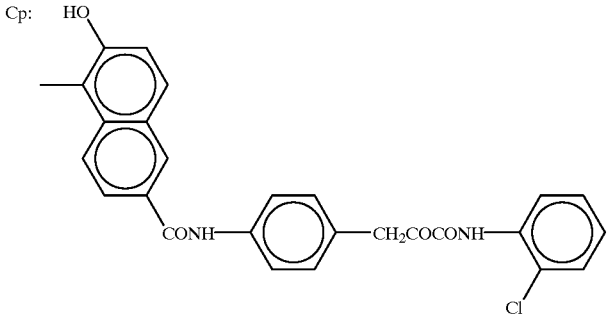

-continued
Pigment (2)-54
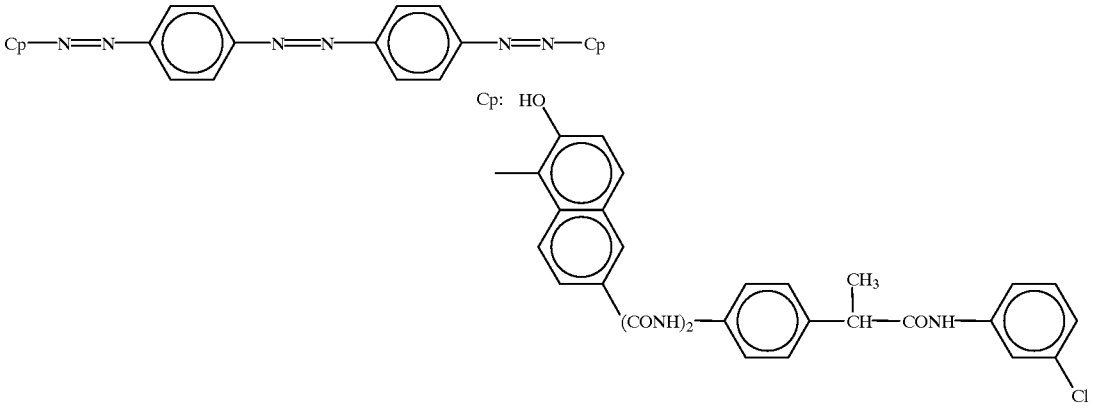
Pigment (2)-55
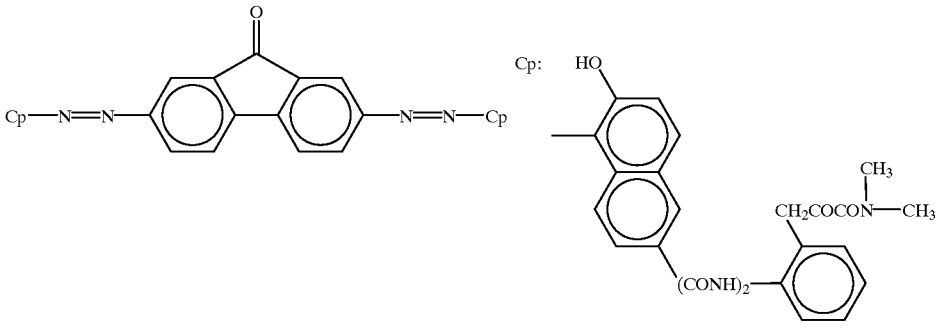
Pigment (2)-56
Structure: same as the above
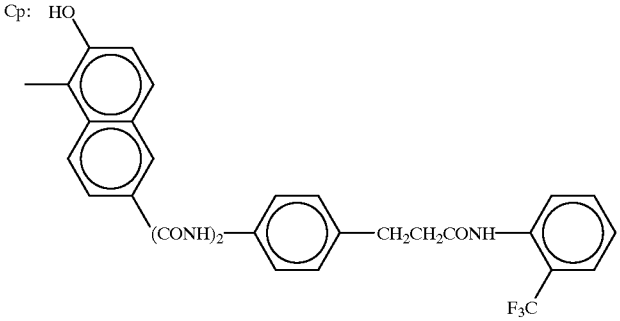
Pigment (2)-57
Structure: same as the above
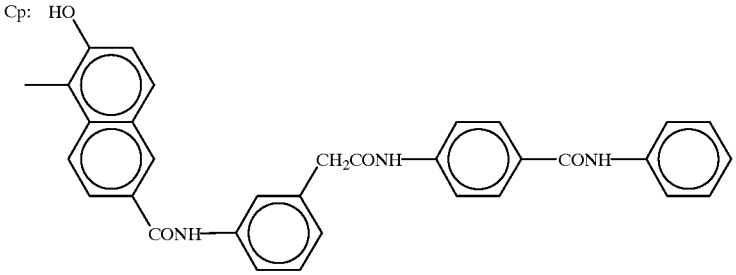

-continued
Pigment (2)-58
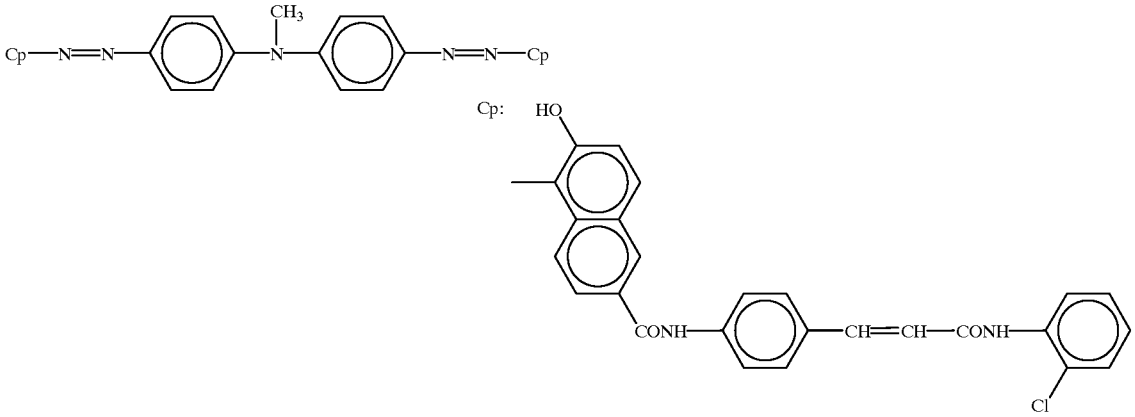
Pigment (2)-59
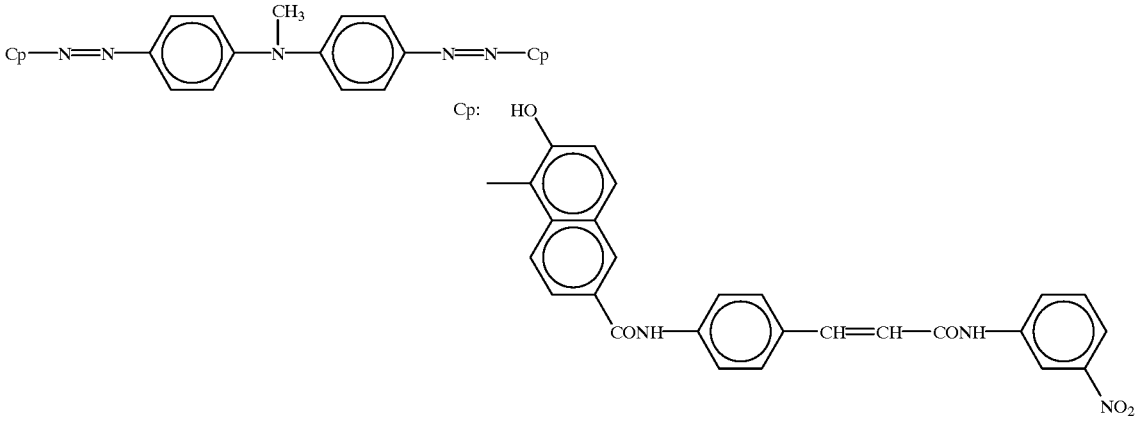
Pigment (2)-60
Structure: same as the above
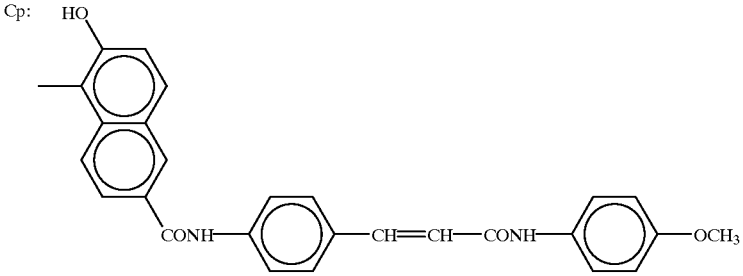
Pigment (2)-61
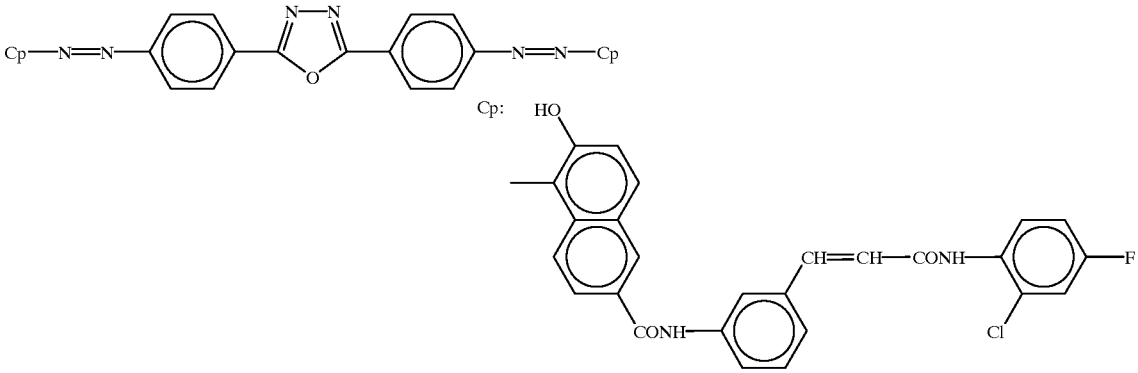

-continued
Pigment (2)-62
Structure: same as the above
Cp:
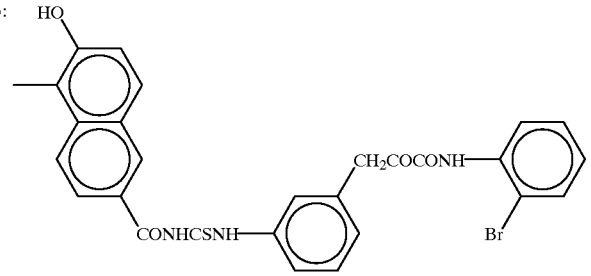
Pigment (2)-63
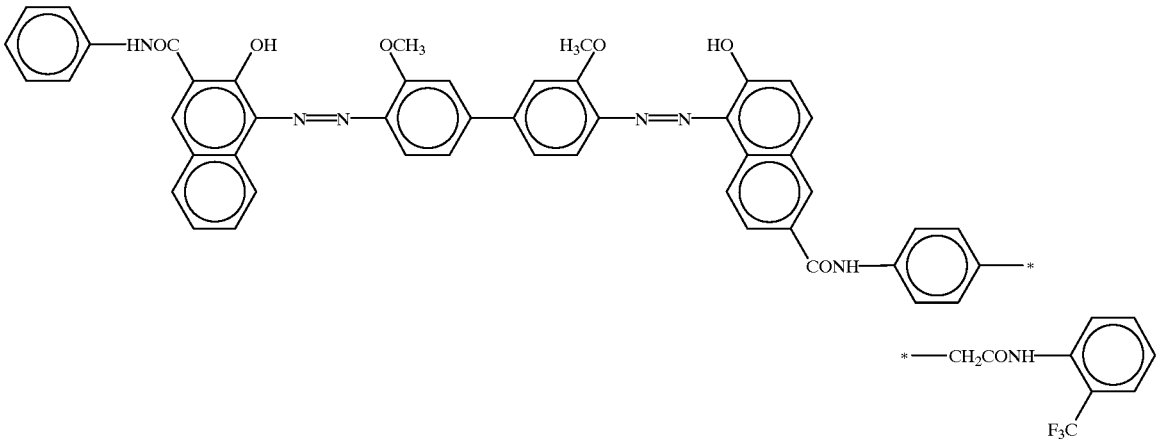
Pigment (2)-64
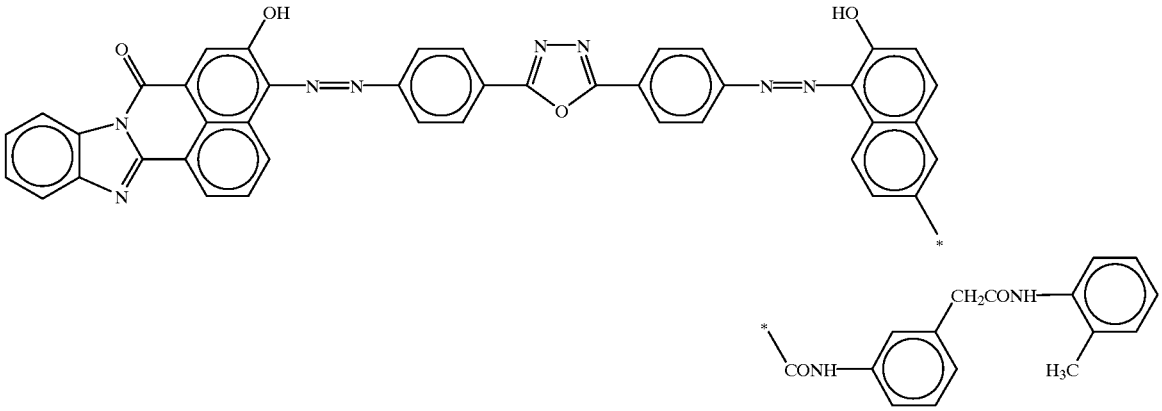

-continued
Pigment (2)-65
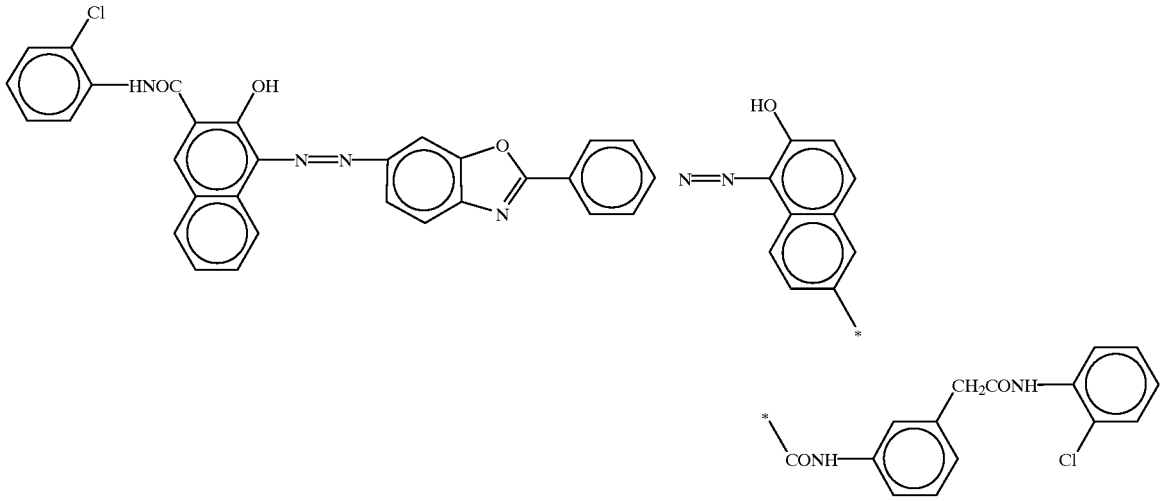
Pigment (2)-66
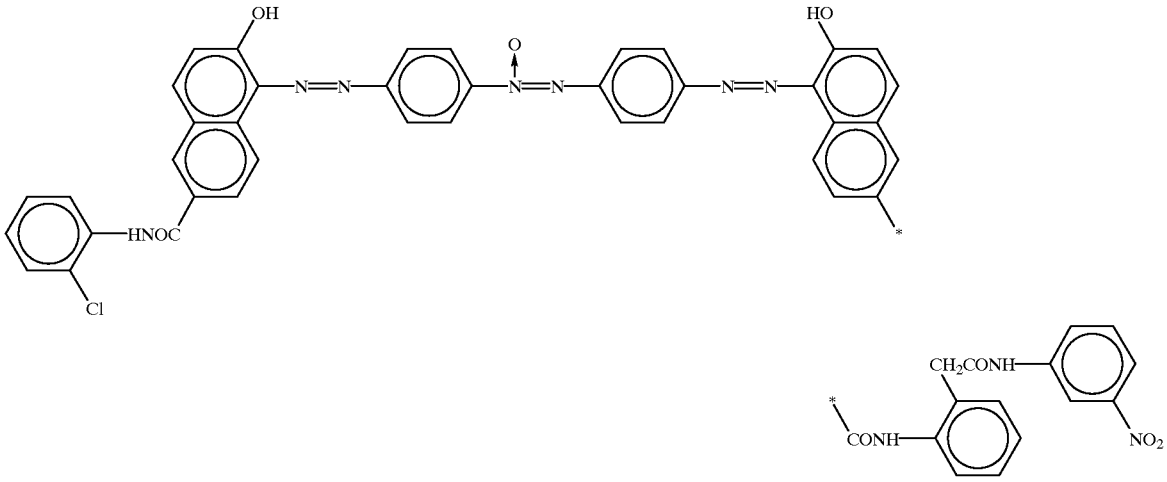
Pigment (2)-67
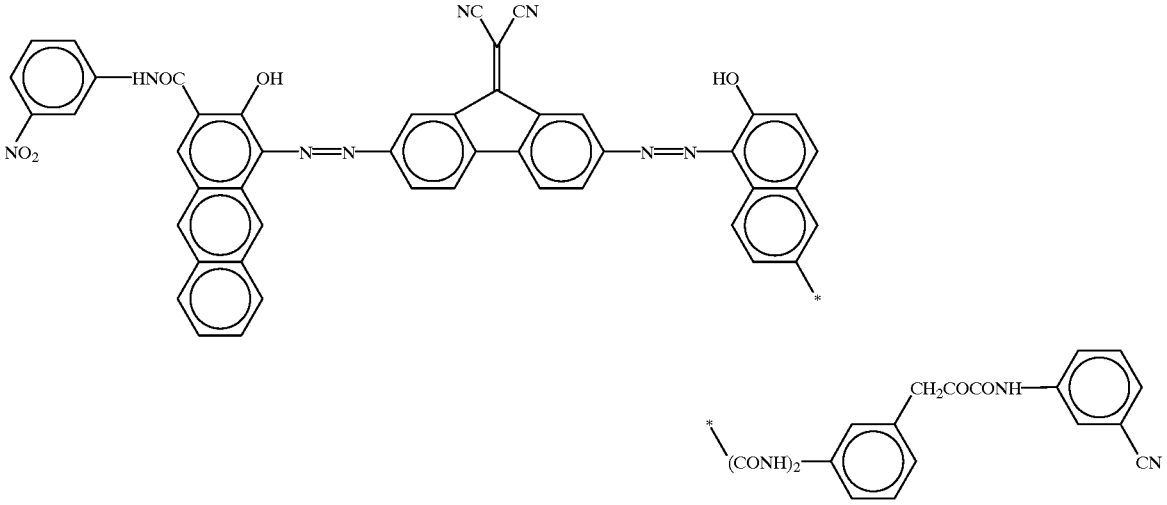

-continued
Pigment (2)-68
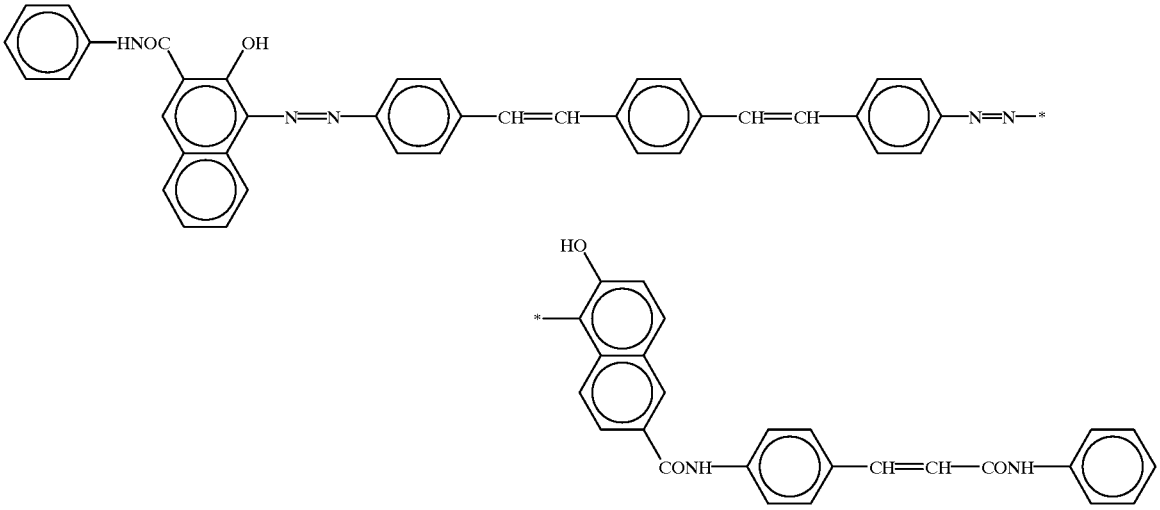
Pigment (2)-69
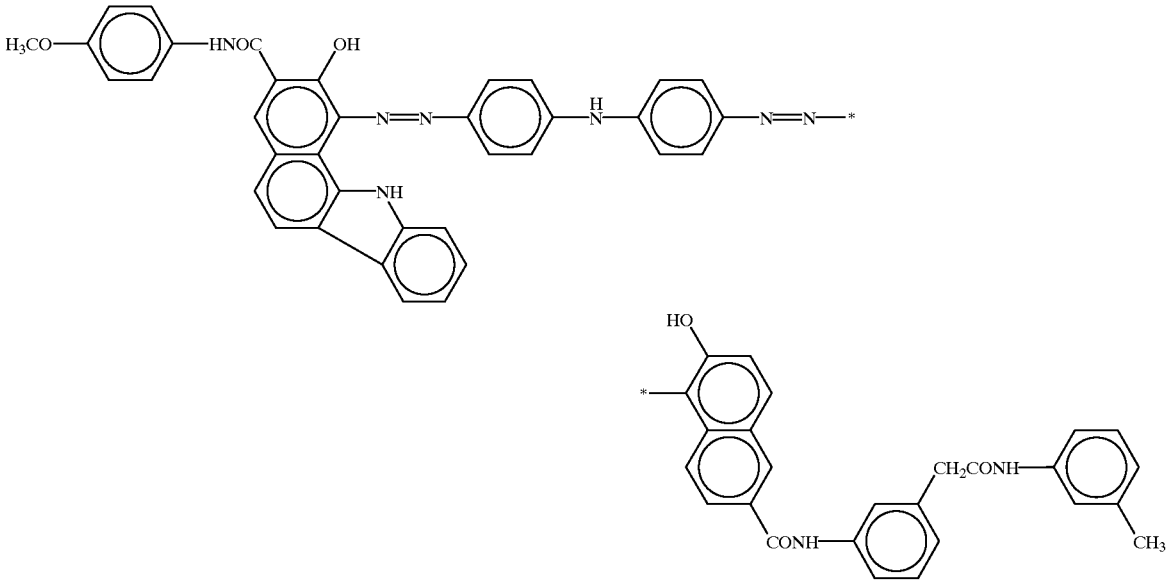

-continued
Pigment (2)-70
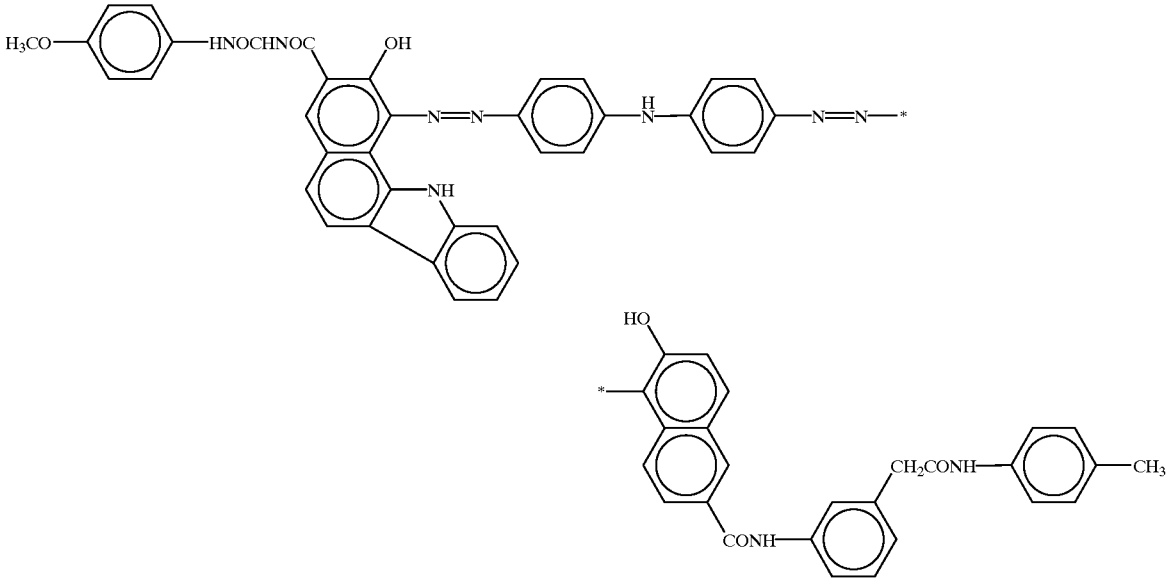
Pigment (3)-1
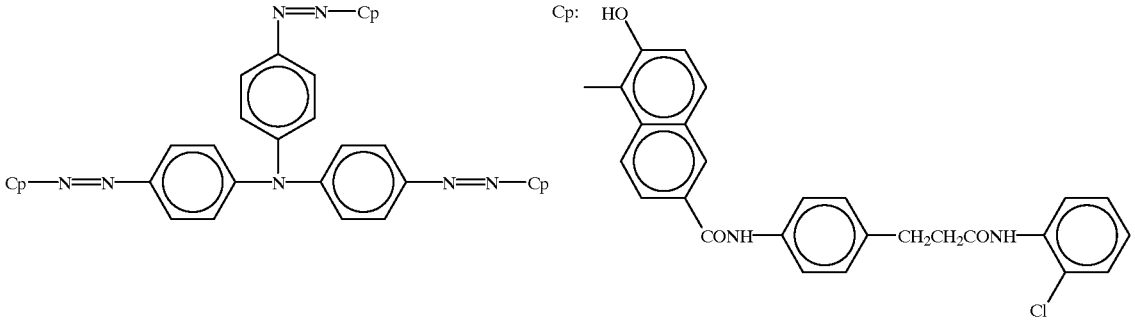
Pigment (3)-2
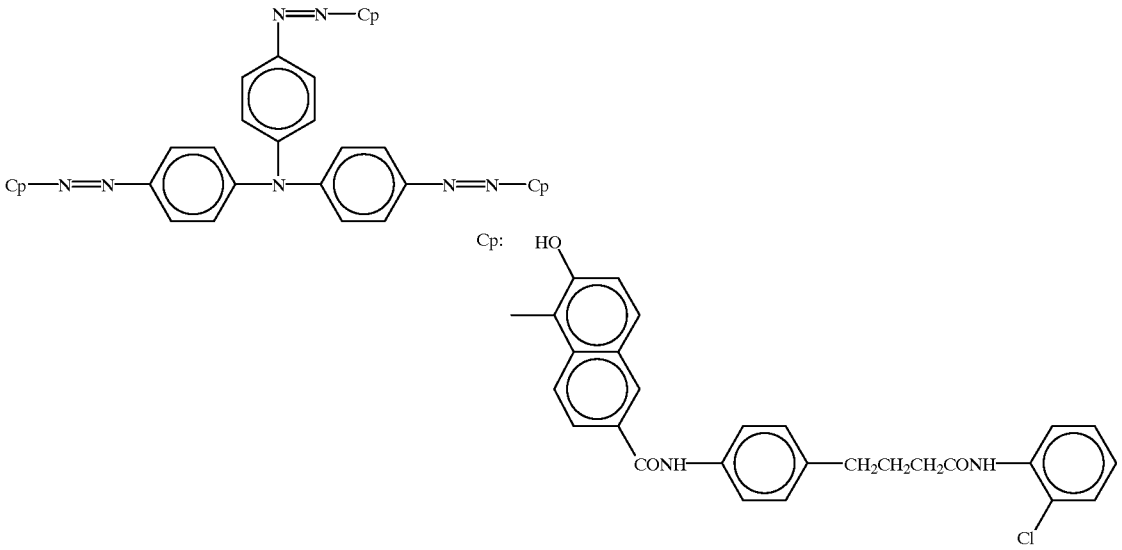

-continued
Pigment (3)-3
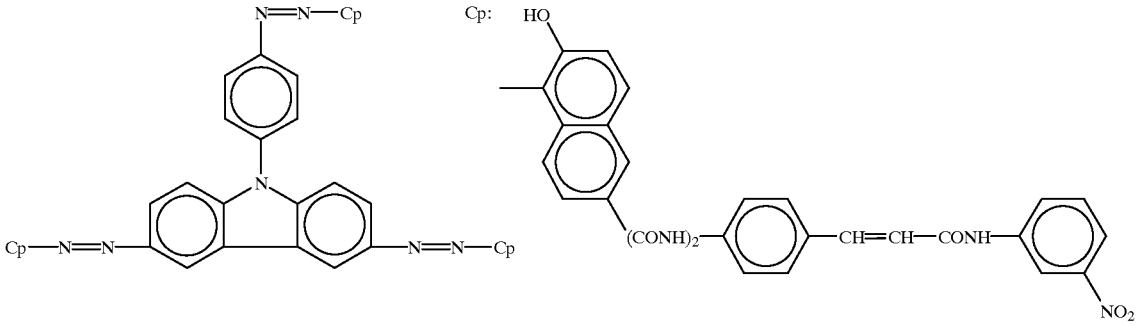
Pigment (3)-4
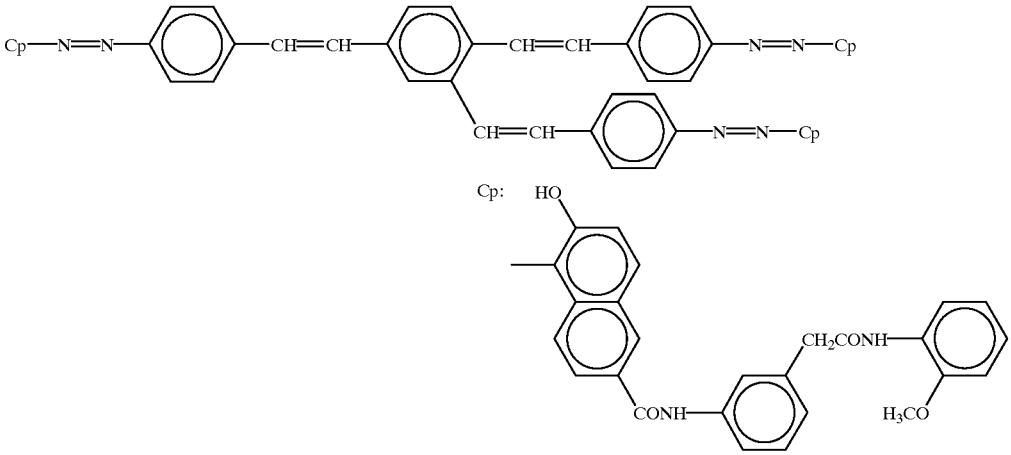
Pigment (3)-5
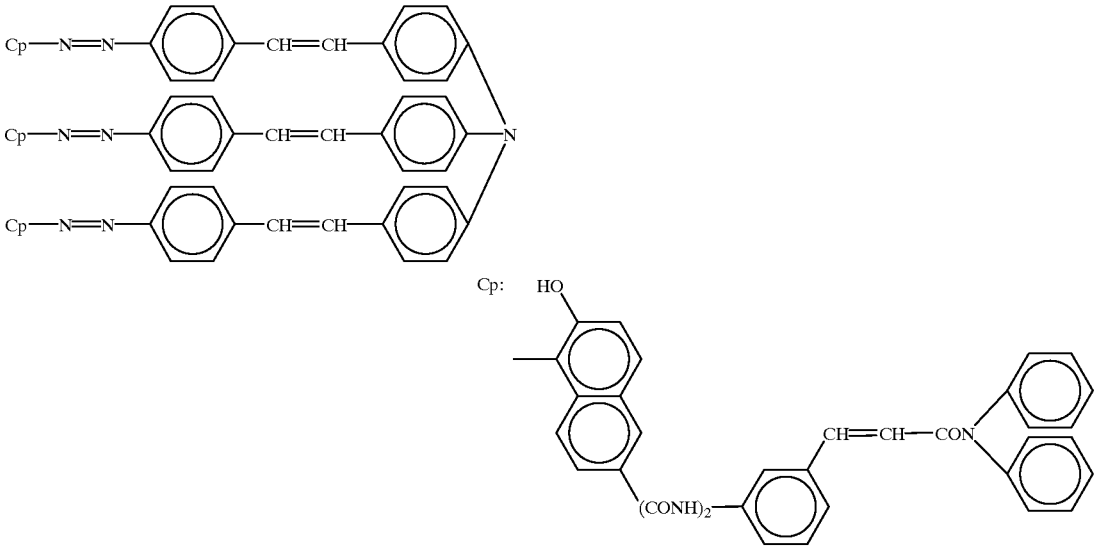

-continued
Pigment (3)-6
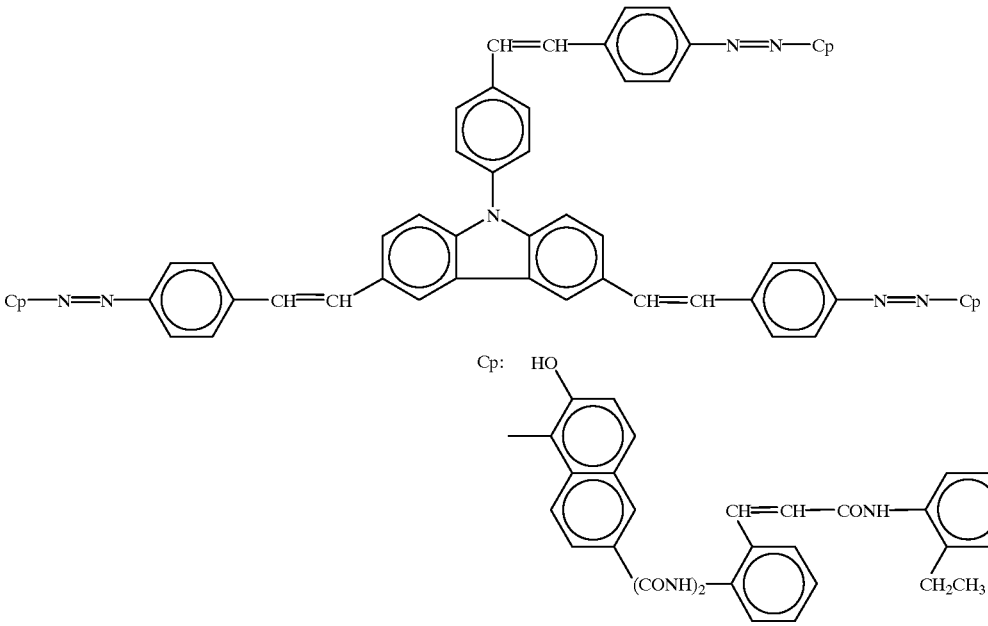
Pigment (3)-7
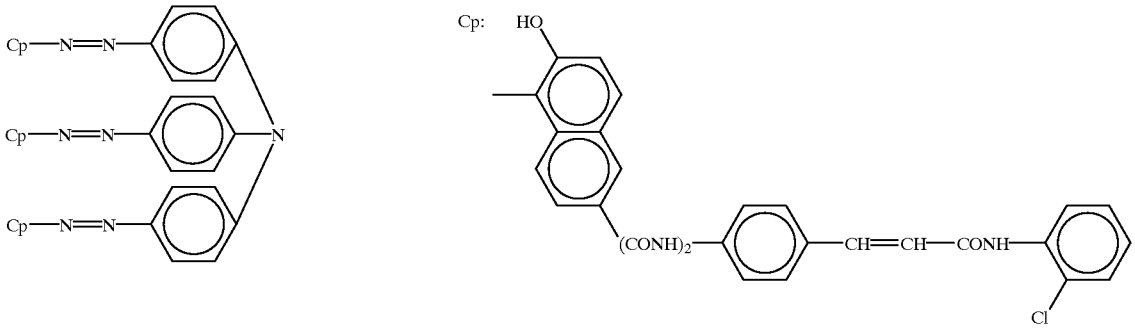
Pigment (3)-8
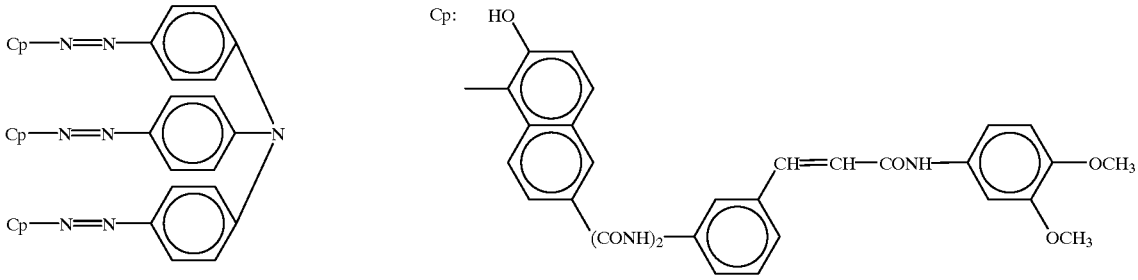
Pigment (3)-9
Structure: same as the above
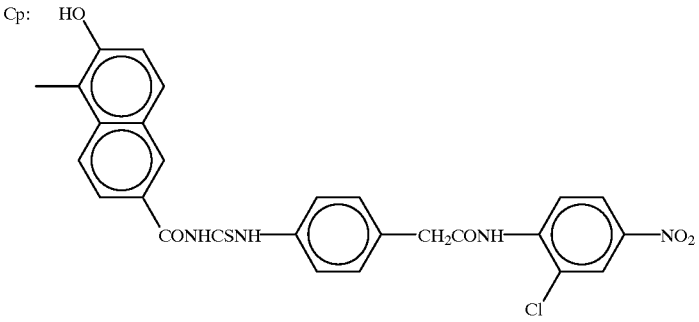

-continued
Pigment (3)-10
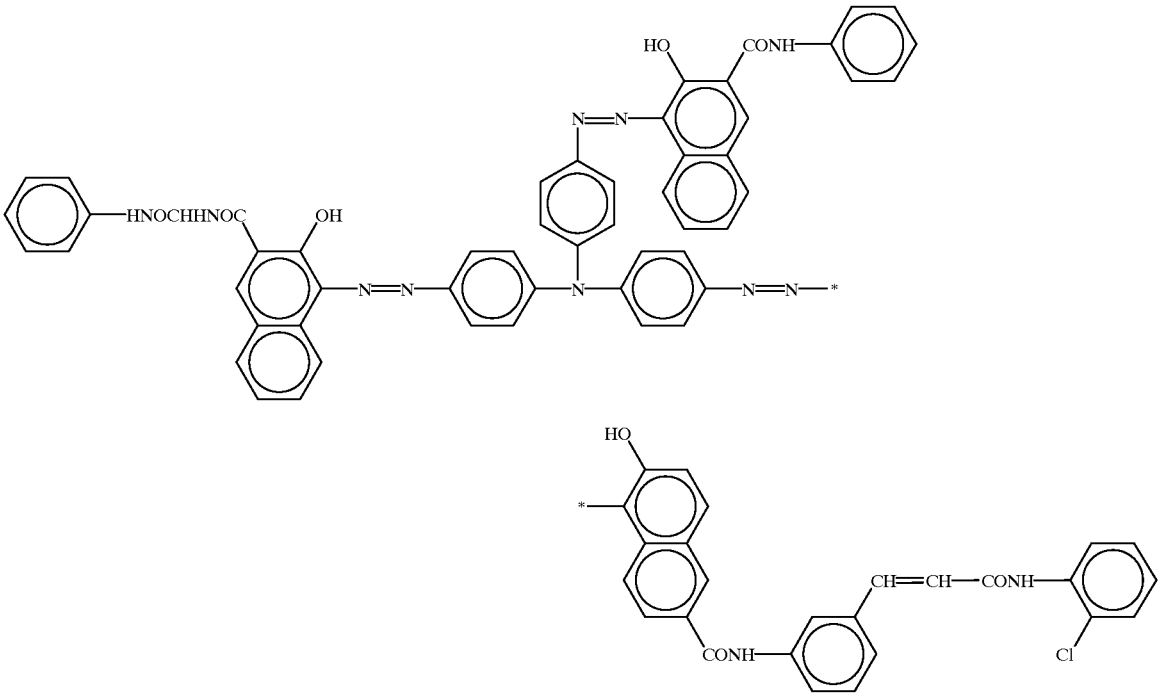
Pigment(3)-11
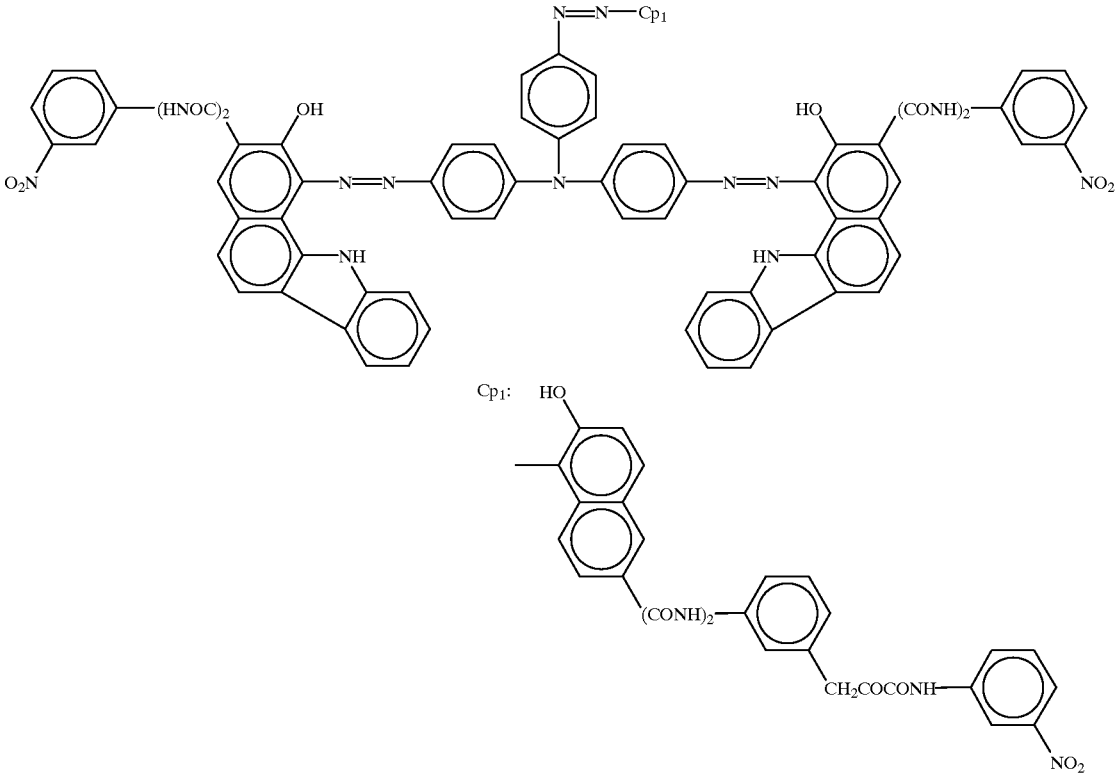

-continued
Pigment(3)-12
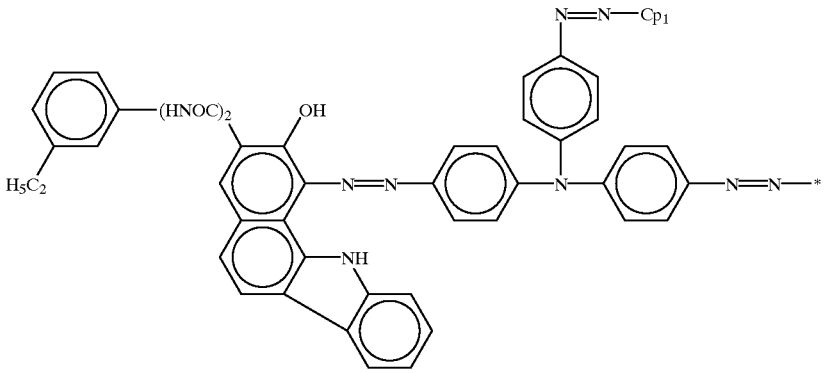
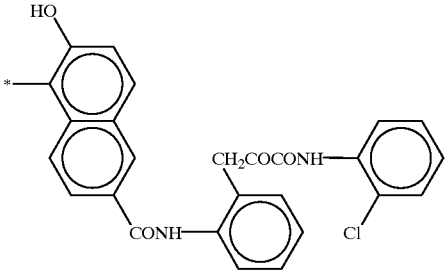
Cp1:
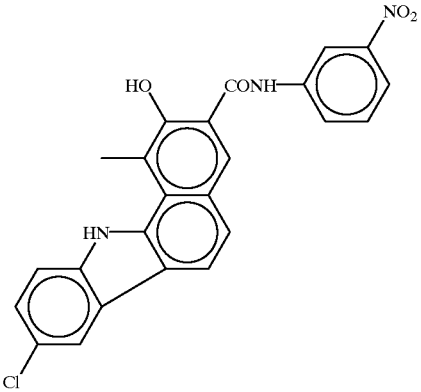
Pigment (4)-1
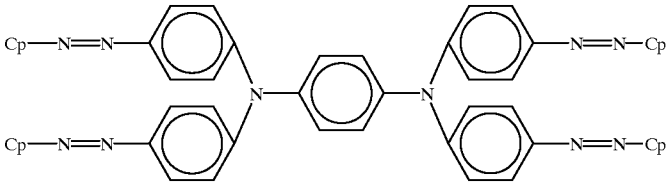
Cp:
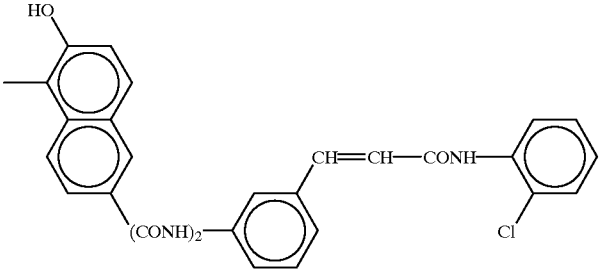

-continued
Pigment (4)-2
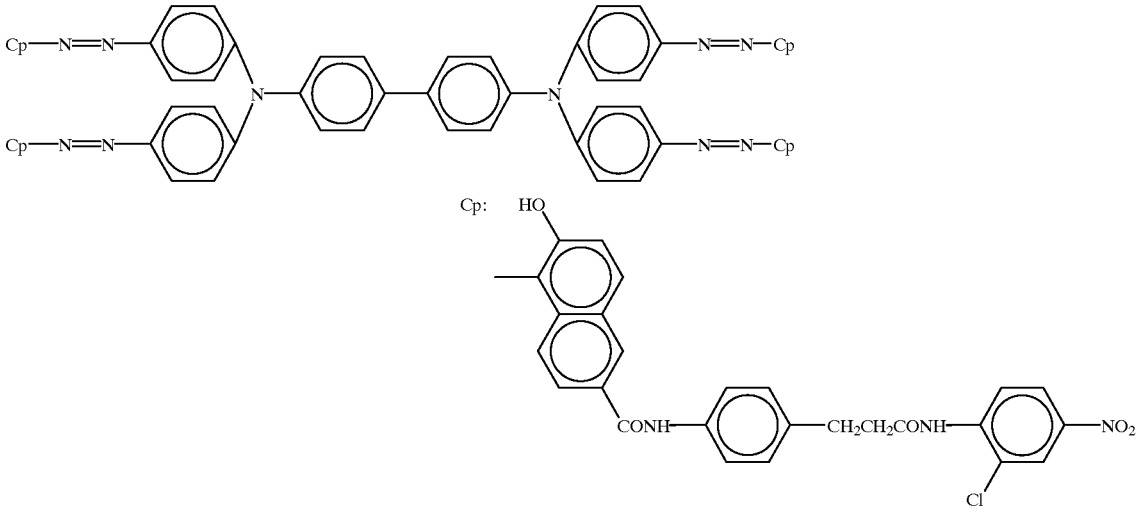
Pigment (4)-3
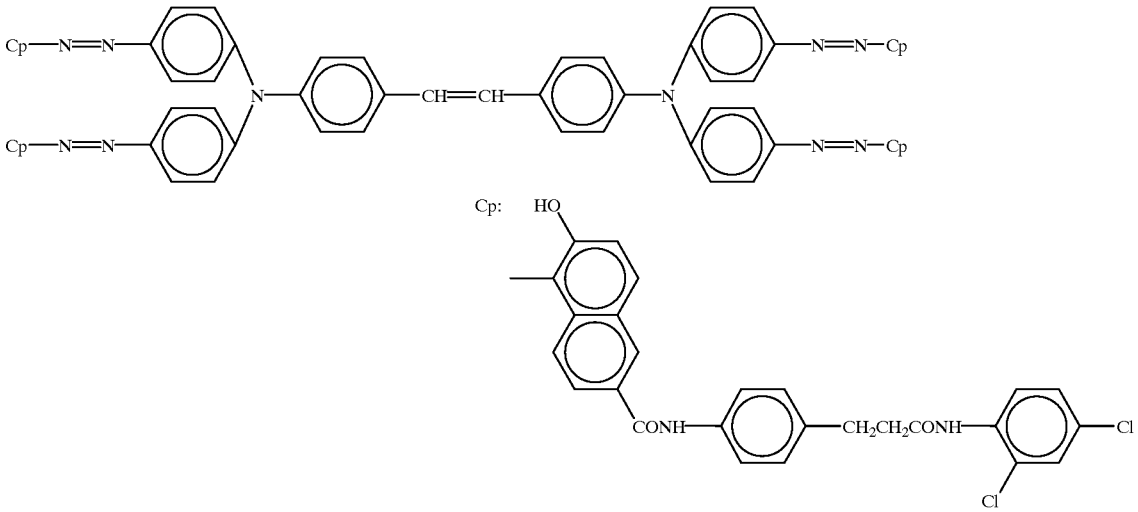
Pigment (4)-4
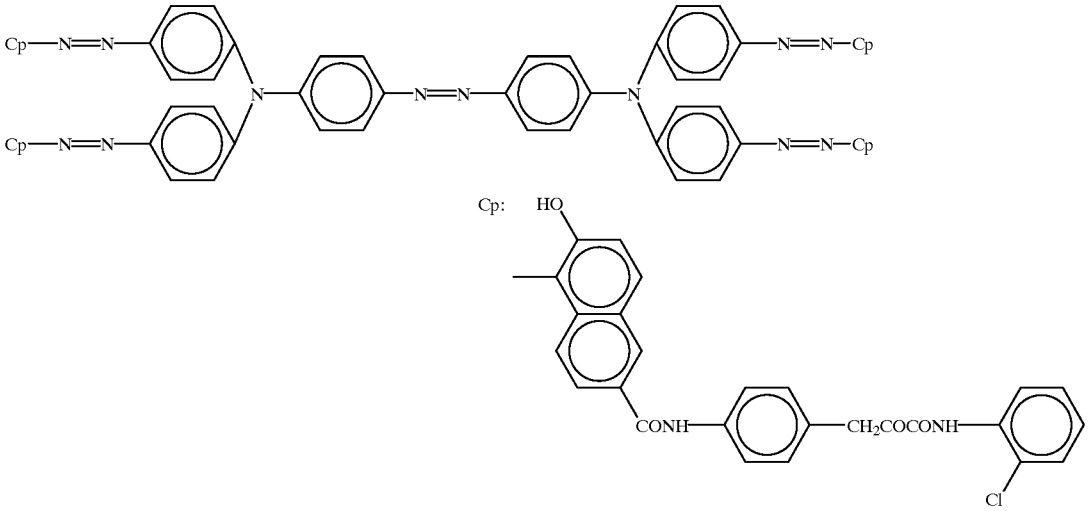

-continued
Pigment (4)-5
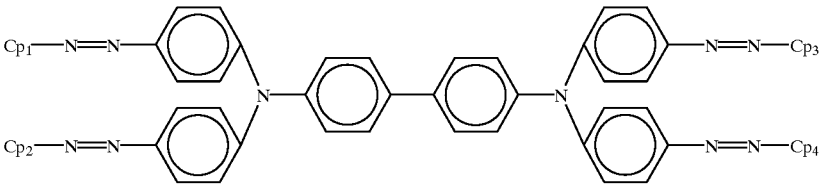
Cp1, Cp4:
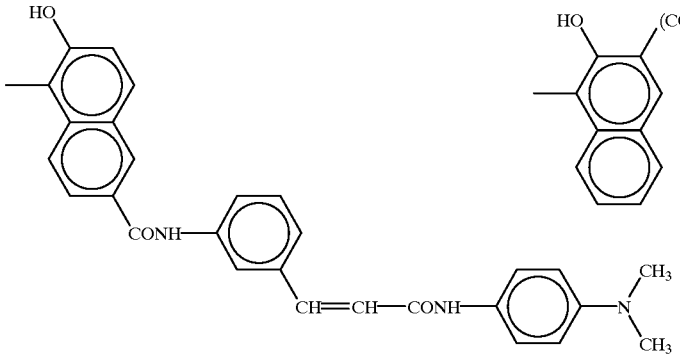
Cp1, Cp4:
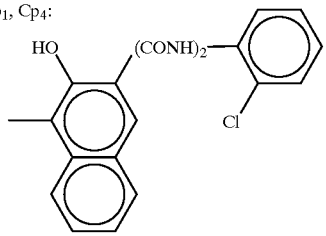
Pigment (5)-1
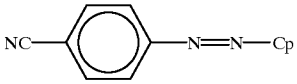
Cp:
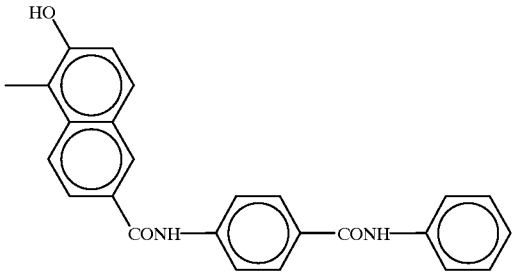
Pigment (5)-2
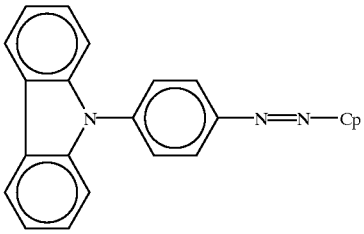
Cp:
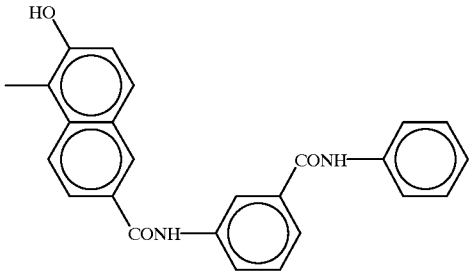
Pigment (5)-3
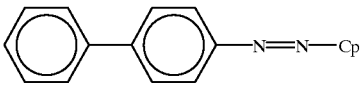
Cp:
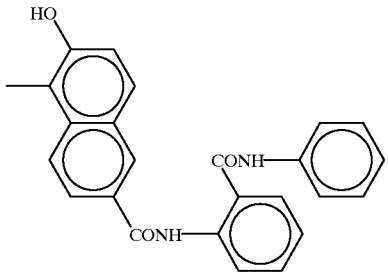

-continued
Pigment (5)-4
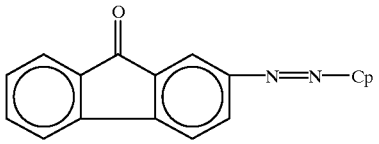
Cp:
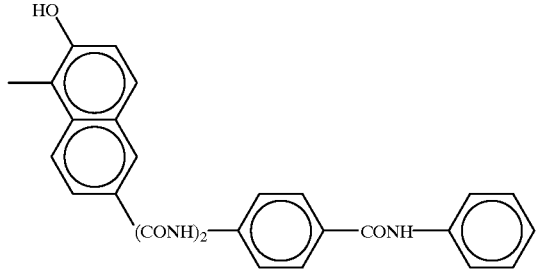
Pigment (5)-5
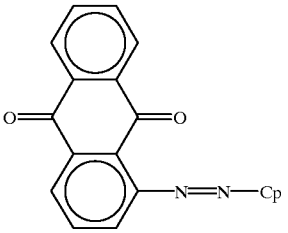
Cp:
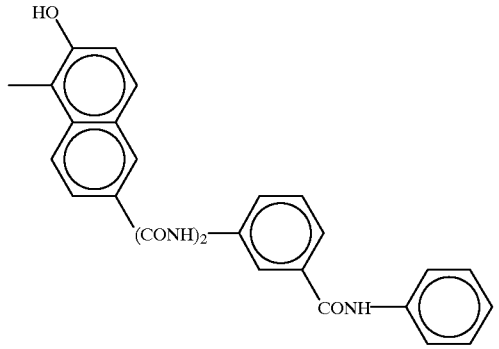
Pigment (5)-6
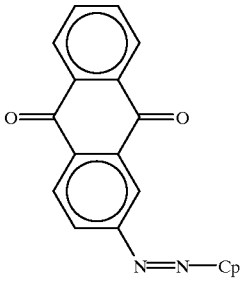
Cp:
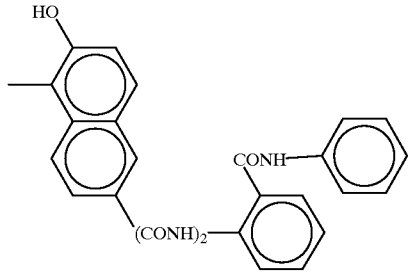
Pigment (5)-7
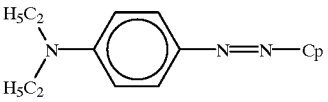
Cp:
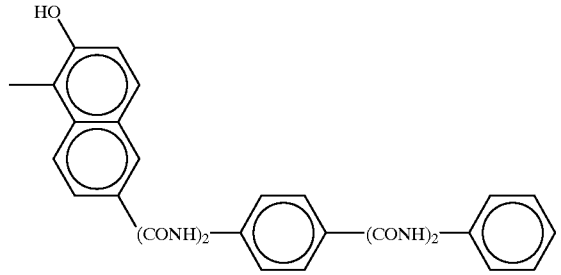
Pigment (5)-8
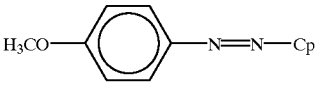
Cp:
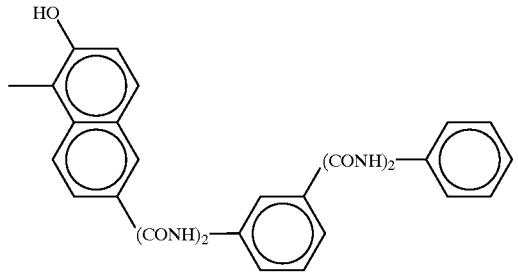

-continued
Pigment (5)-9
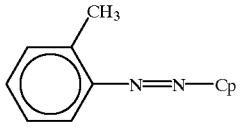
Cp:
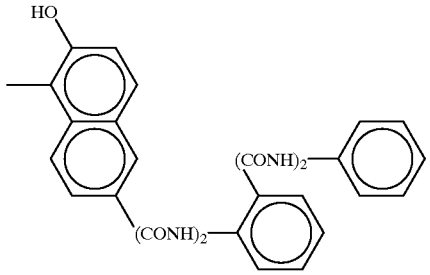
Pigment (5)-10
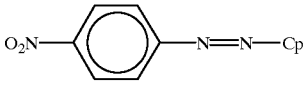
Cp:
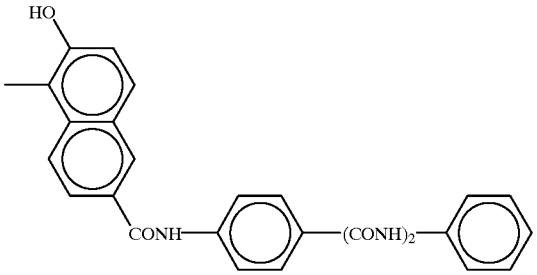
Pigment (5)-11
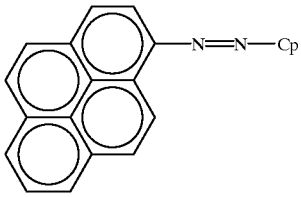
Cp:
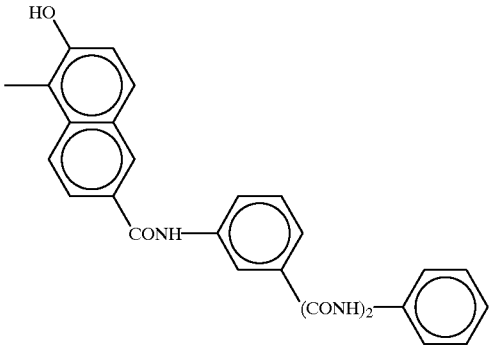
Pigment (5)-12
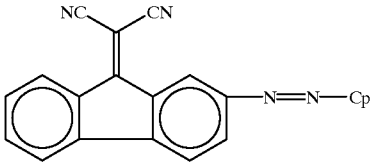
Cp:
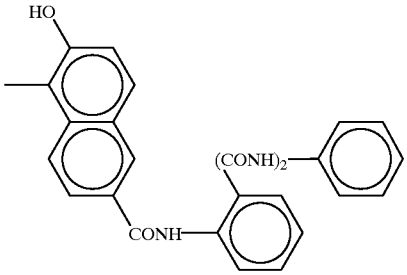
Pigment (5)-13
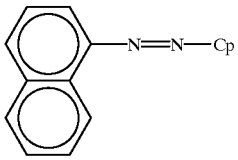
Cp:
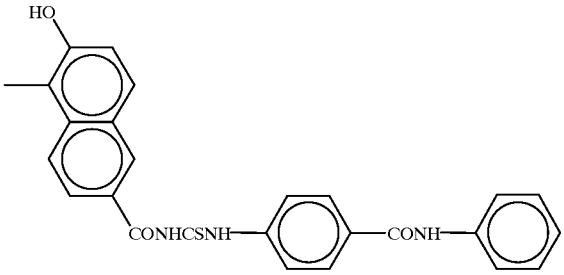

-continued
Pigment (5)-14
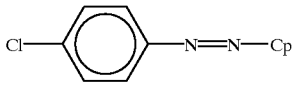
Cp:
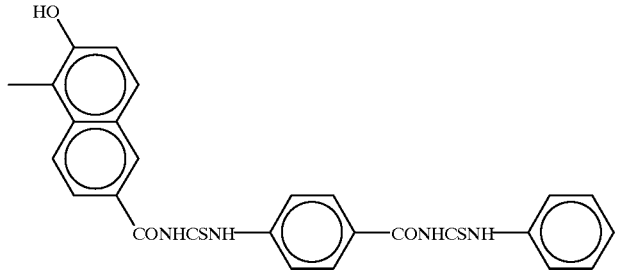
Pigment (5)-15
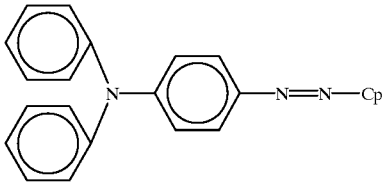
Cp:
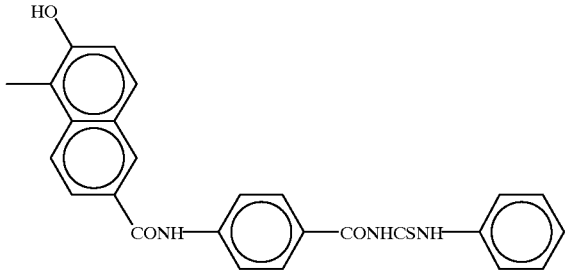
Pigment (5)-16
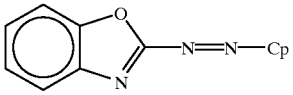
Cp:
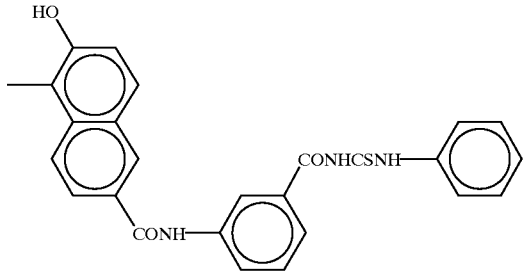
Pigment (5)-17
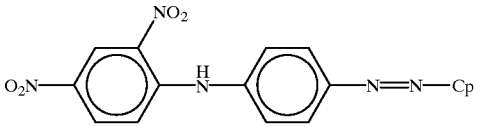
Cp:
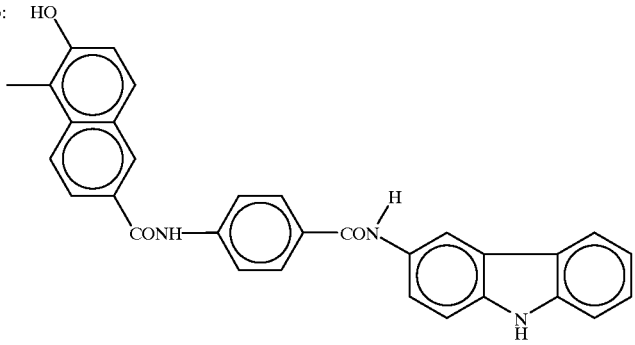
Pigment (5)-18
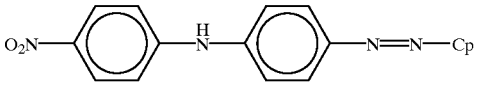
Cp:
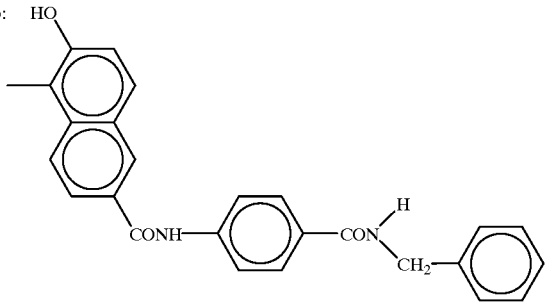

-continued
Pigment (5)-19
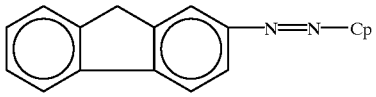
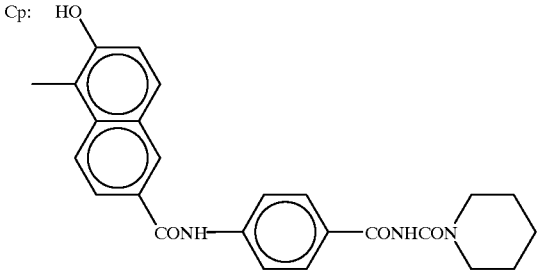
Pigment (5)-20
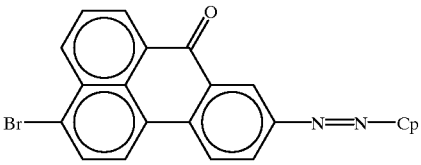
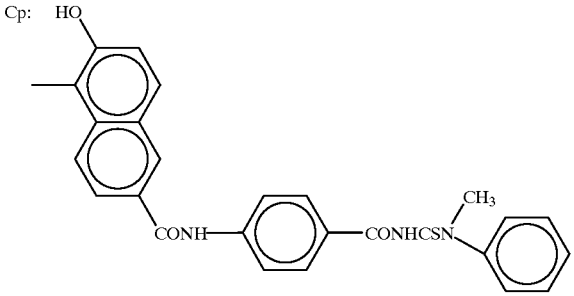
Pigment (5)-21
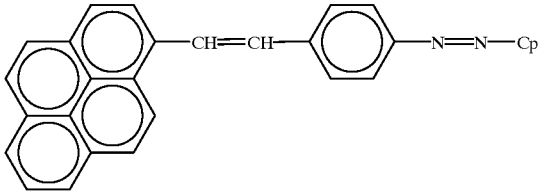
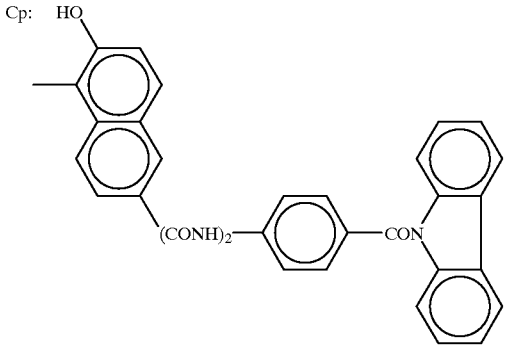
Pigment (5)-21
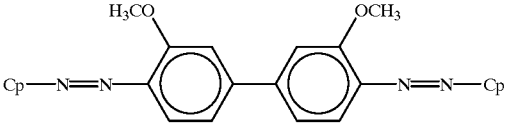
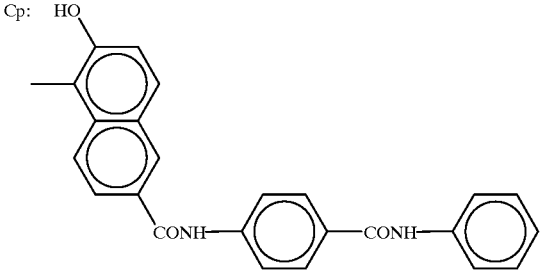
Pigment (6)-2
Structure: same as the above
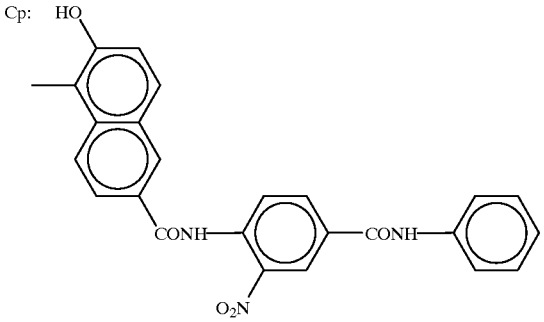

-continued
Pigment (6)-3
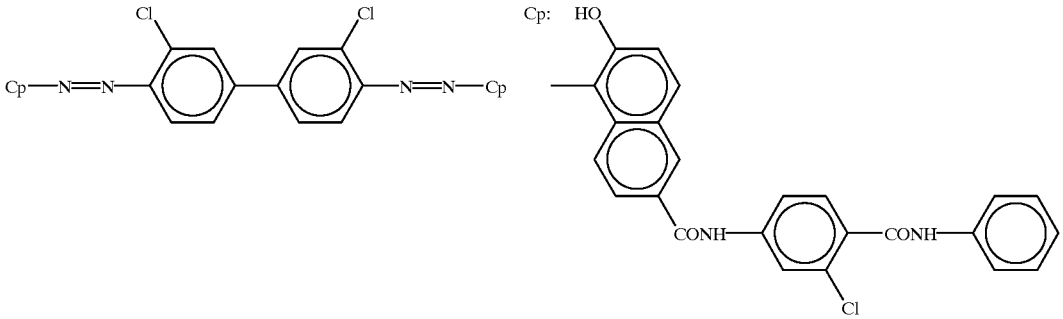
Pigment (6)-4
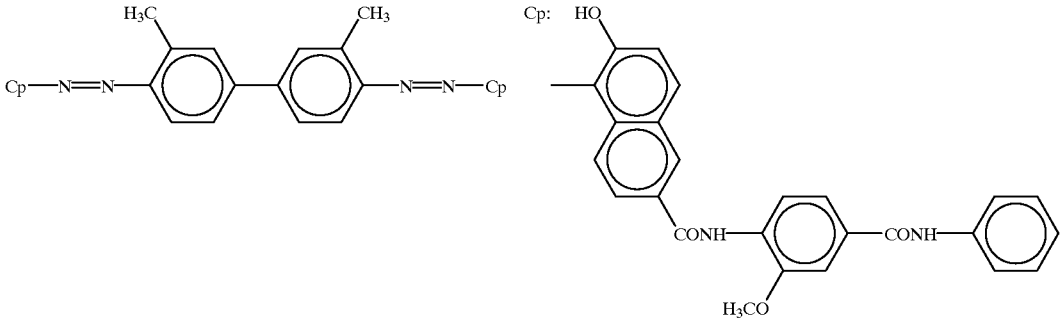
Pigment (6)-5
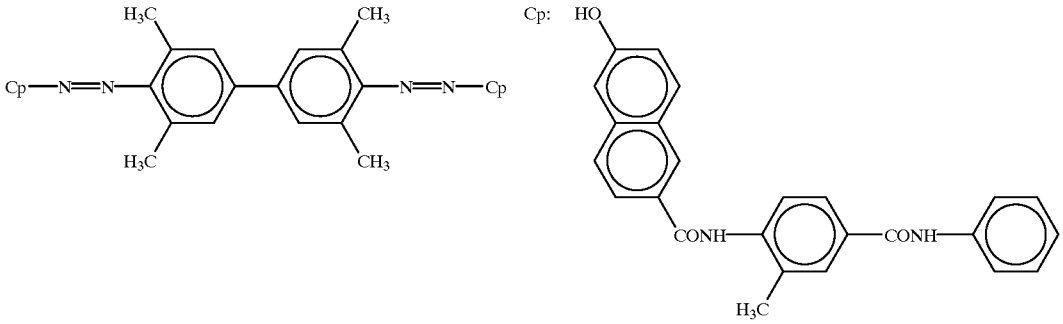
Pigment (6)-6
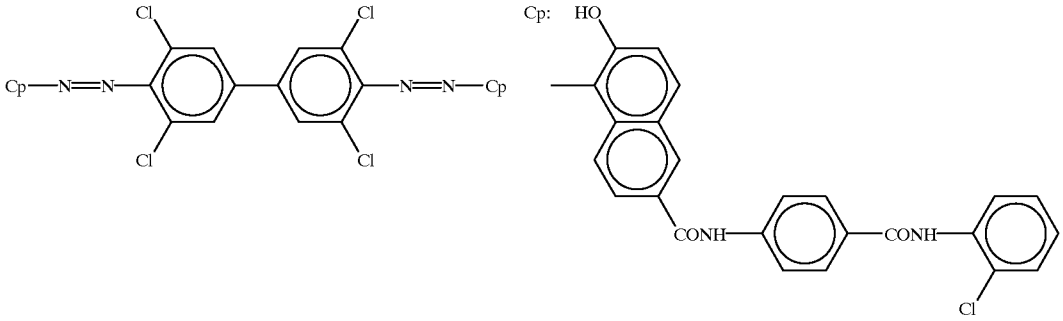

-continued
Pigment (6)-7
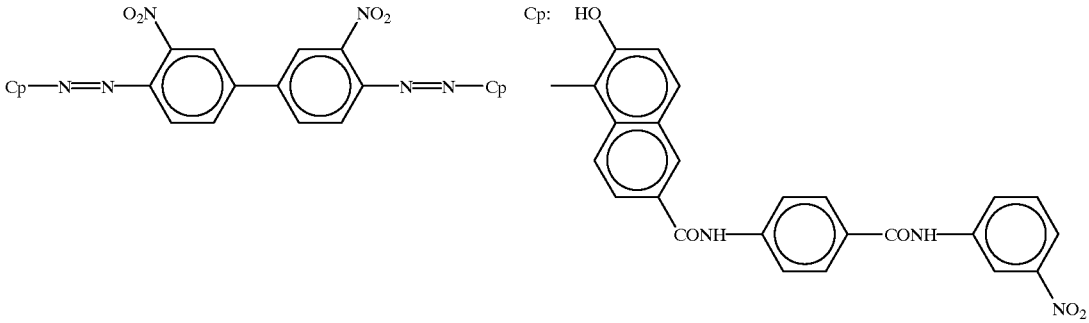
Pigment (6)-8
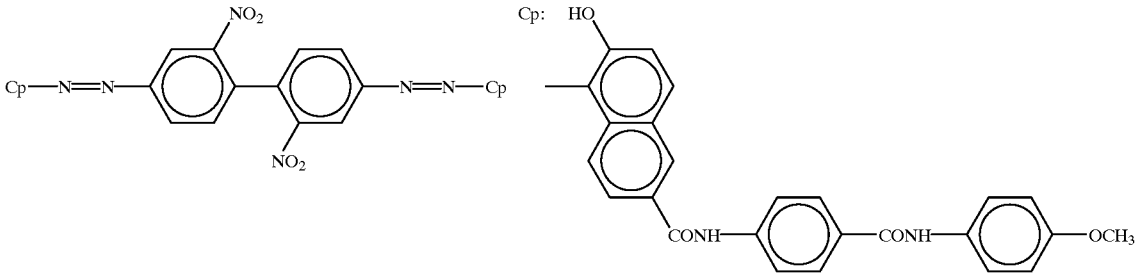
Pigment (6)-9
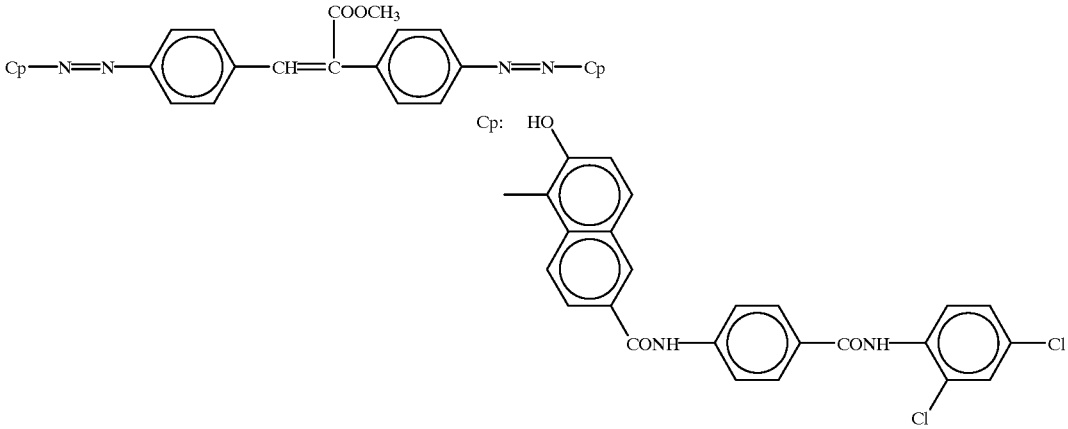
Pigment (6)-10
Structure:same as the above
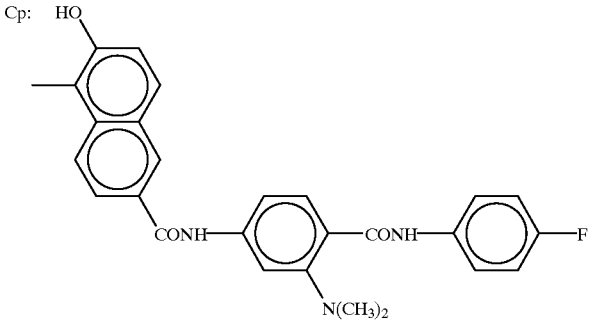
Pigment (6)-11
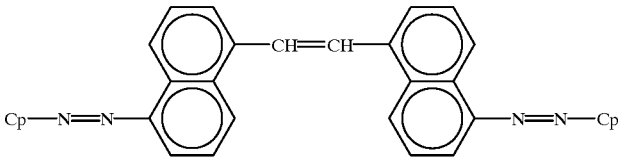

-continued
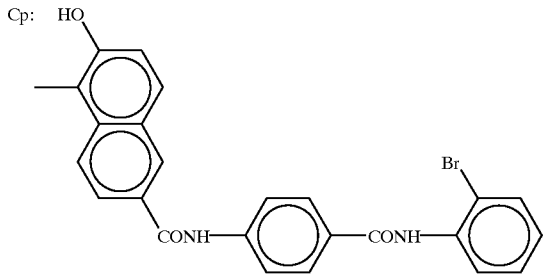
Pigment (6)-12
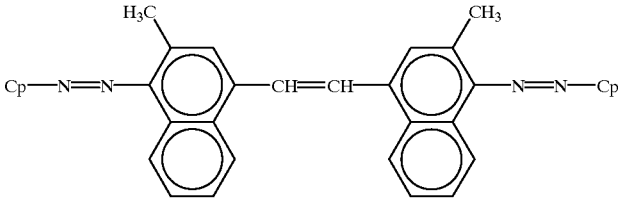
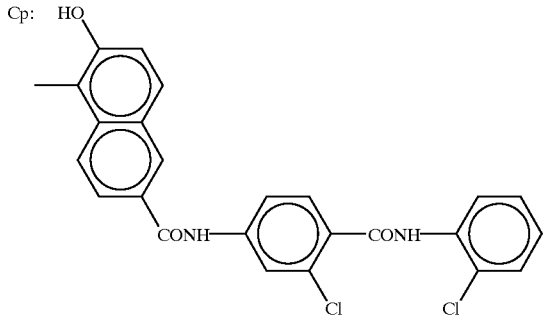
Pigment (6)-13
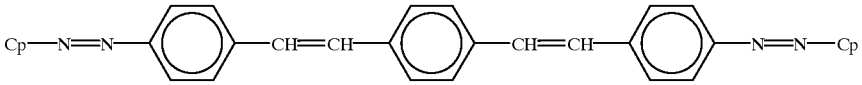
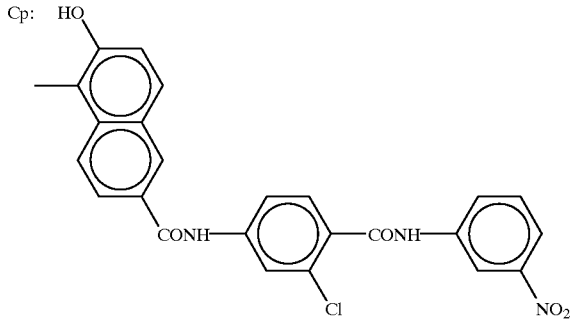
Pigment (6)-14
Structure:same as the above
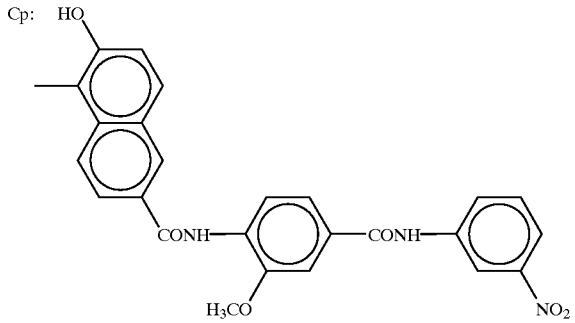

-continued
Pigment (6)-15
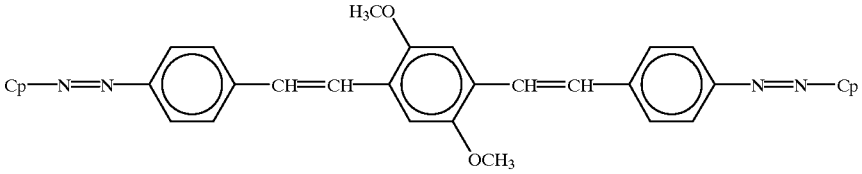
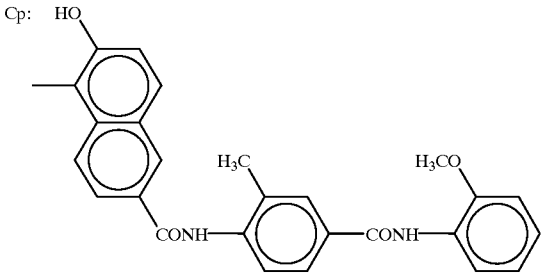
Pigment (6)-16
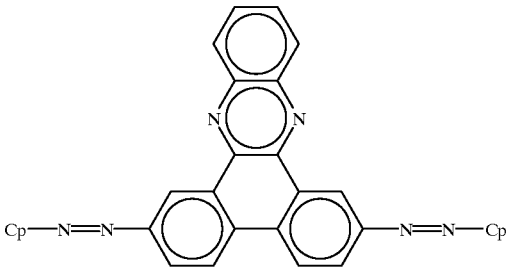
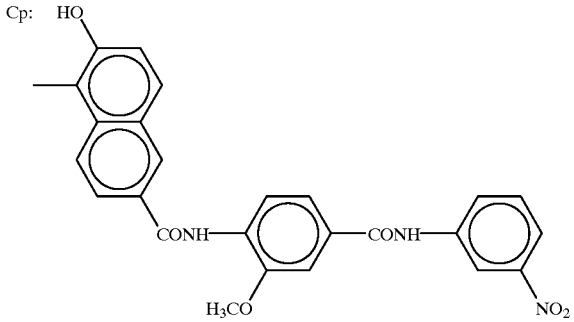
Pigment (6)-17
Structure:same as the above
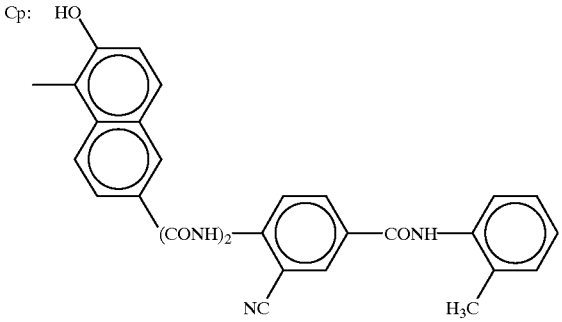
Pigment (6)-18
Structure:same as the above
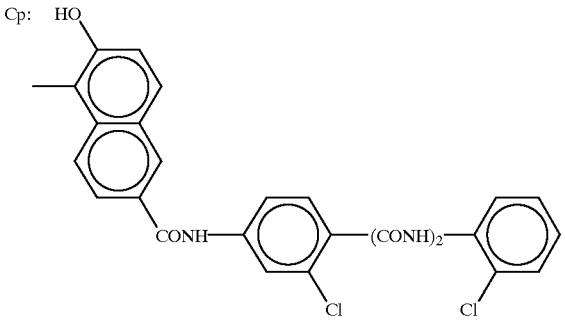

-continued
Pigment (6)-19
Structure:same as the above
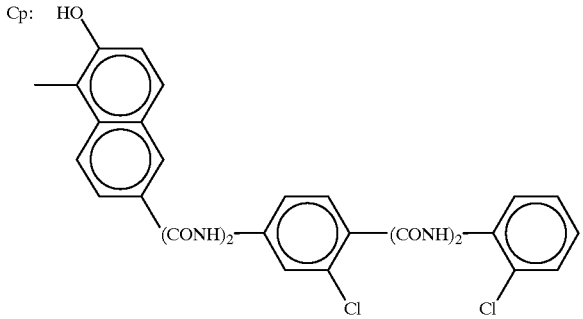
Pigment (6)-20
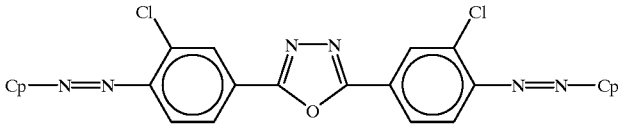
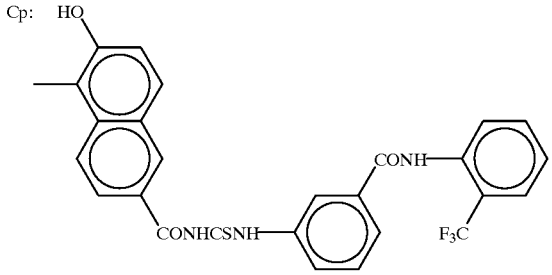
Pigment (6)-21
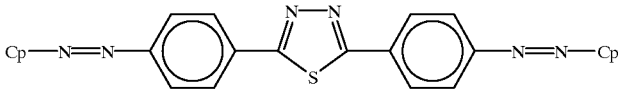
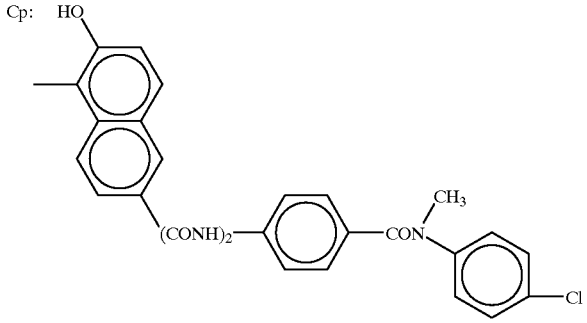
Pigment (6)-22
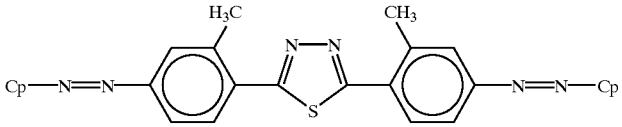
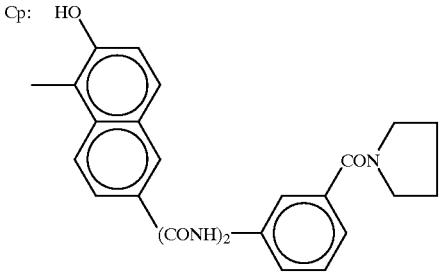

-continued
Pigment (6)-23
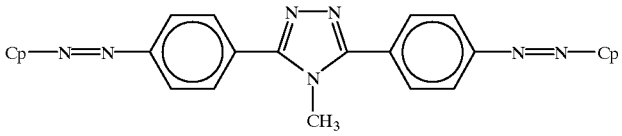
Cp:
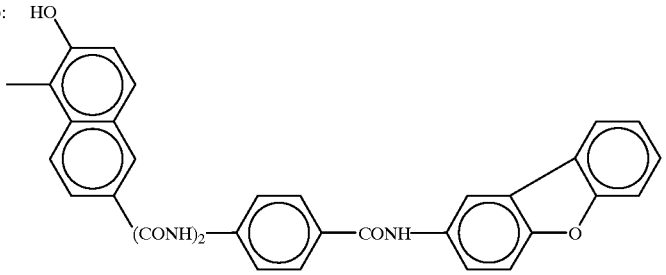
Pigment (6)-24
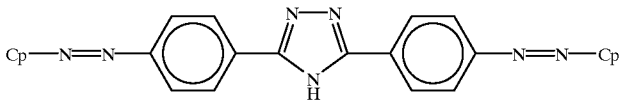
Cp:
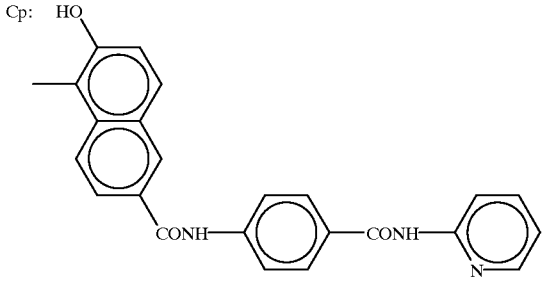
Pigment (6)-25
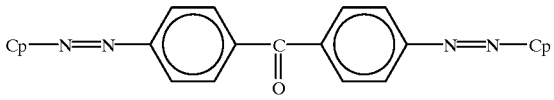
Cp:
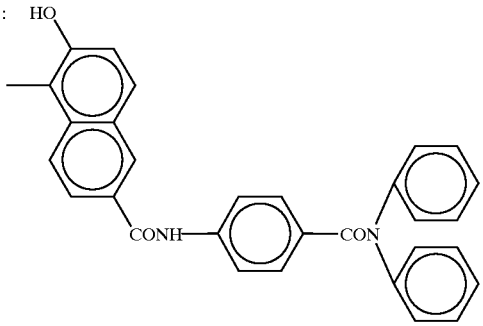
Pigment (6)-26
Structure:same as the above
Cp:
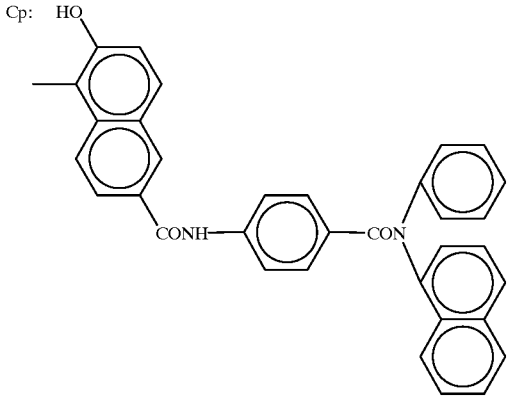

-continued
Pigment (6)-27
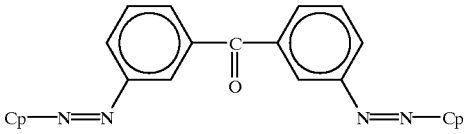
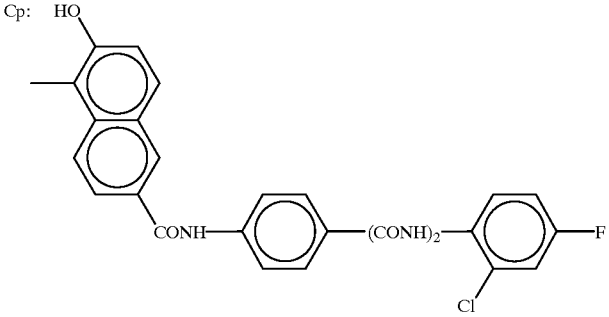
Pigment (6)-28
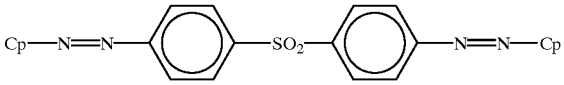
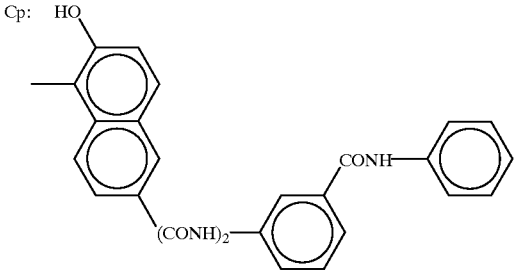
Pigment (6)-29
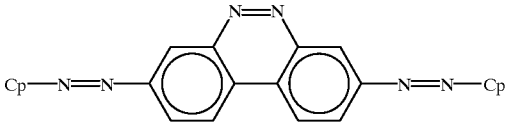
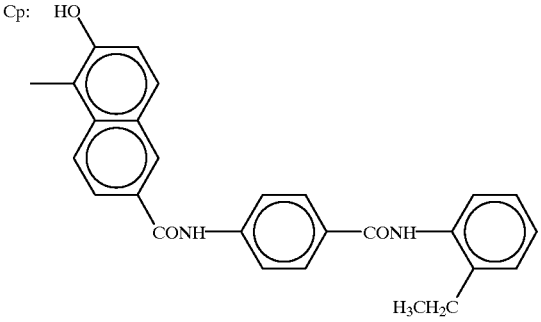
Pigment (6)-30
Structure:same as the above
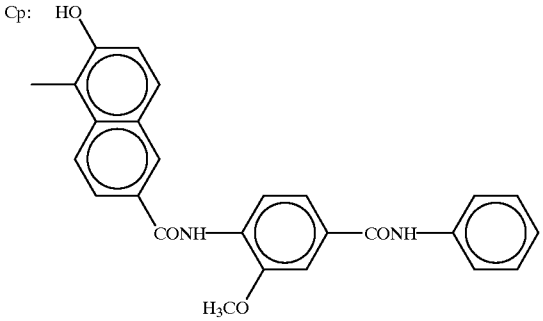
Pigment (6)-31
Structure:same as the above
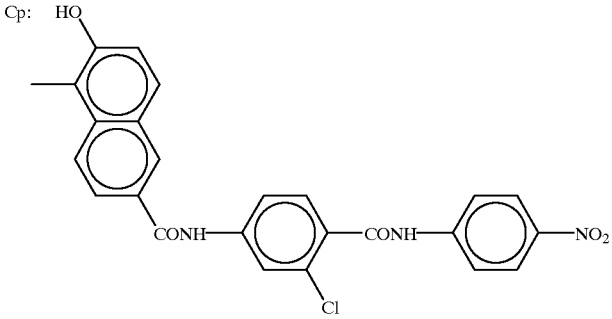

-continued
Pigment (6)-32
Structure:same as the above
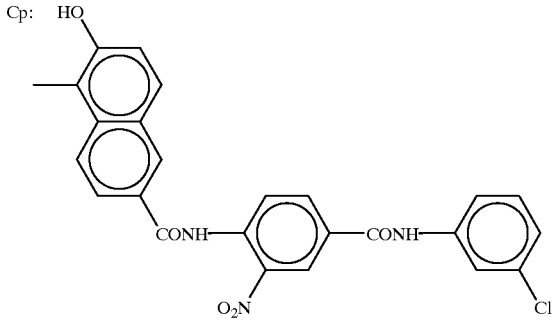
Pigment (6)-33
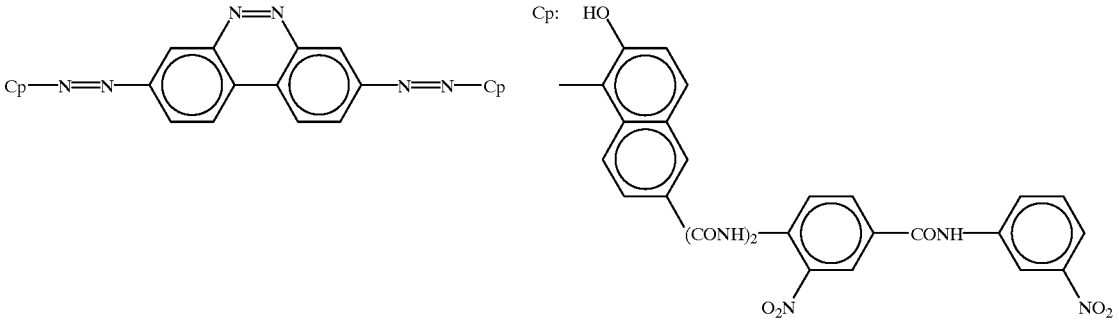
Pigment (6)-34
Structure:same as the above
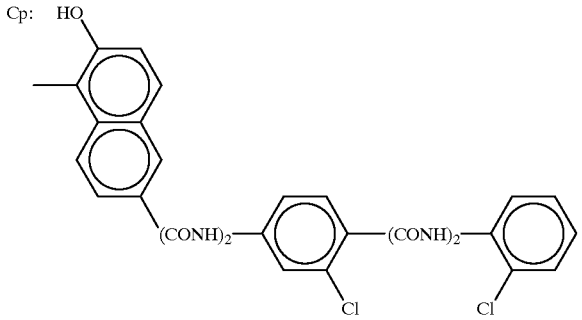
Pigment (6)-35
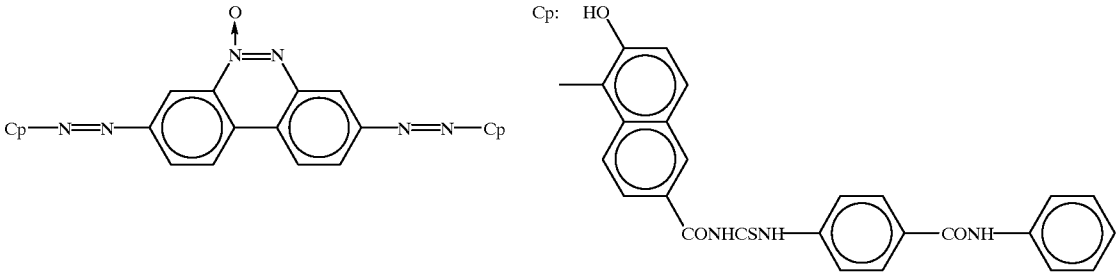

-continued
Pigment (6)-36
Structure:same as the above
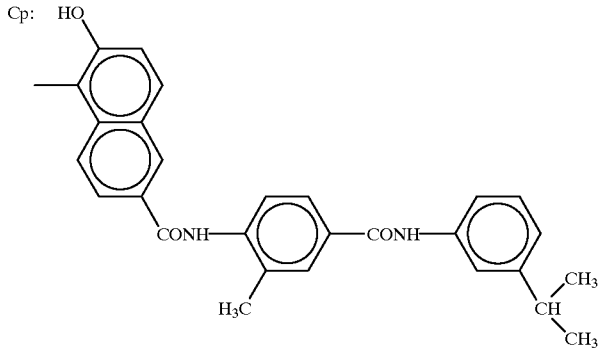
Pigment (6)-37
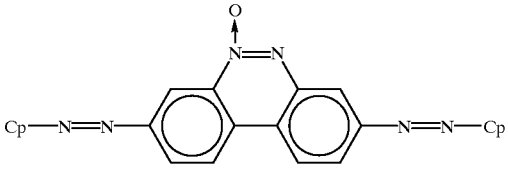
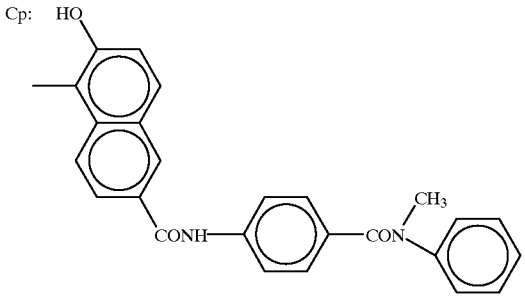
Pigment (6)-38
Structure:same as the above
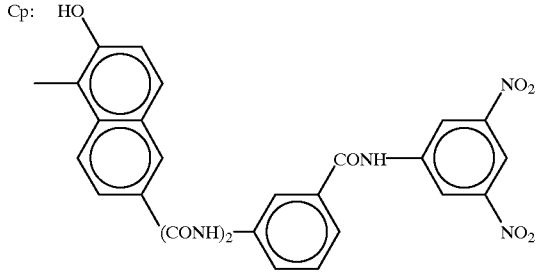
Pigment (6)-39
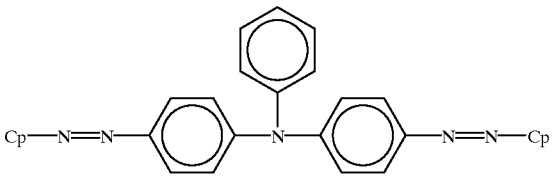
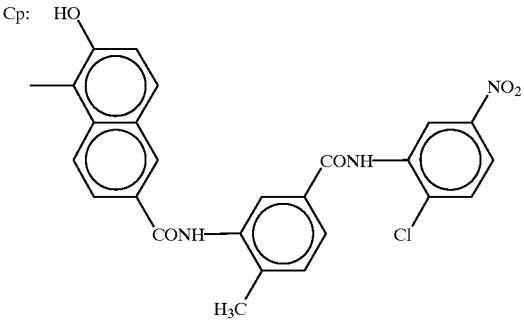
Pigment (6)-40
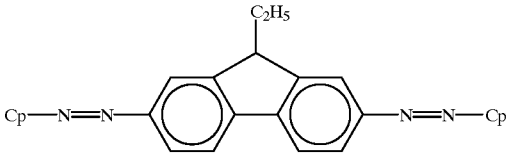
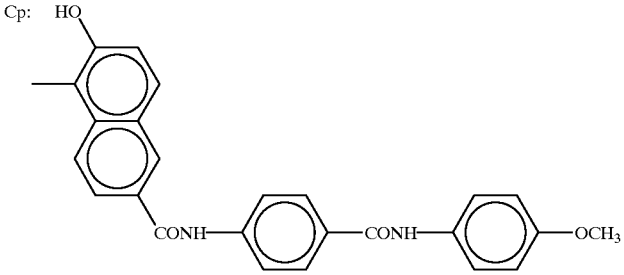

-continued
Pigment (6)-41
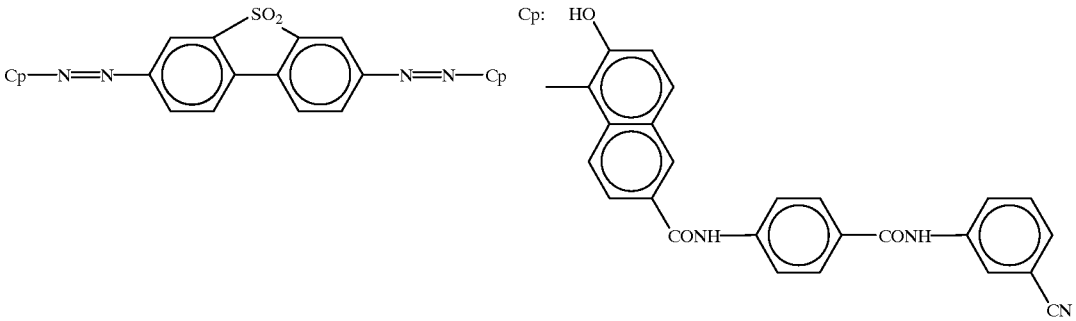
Pigment (6)-42
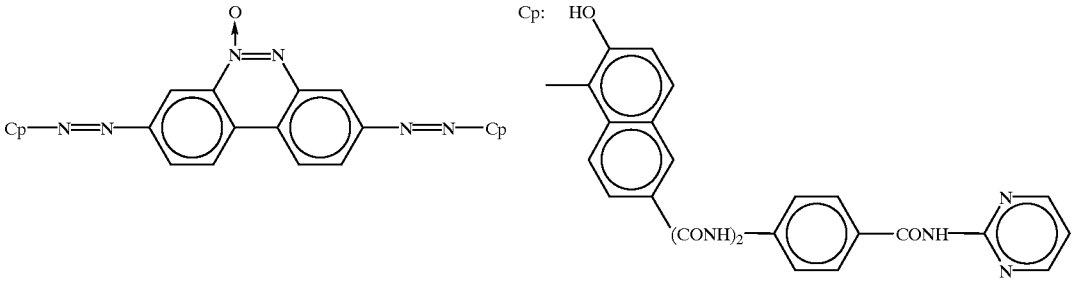
Pigment (6)-43
Structure:same as the above
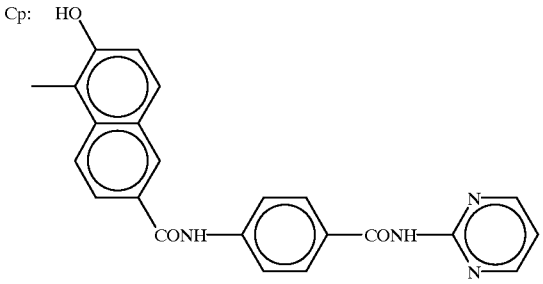
Pigment (6)-44
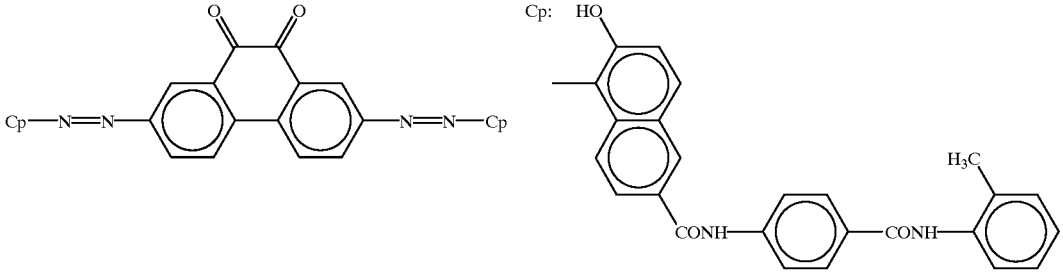
Pigment (6)-45
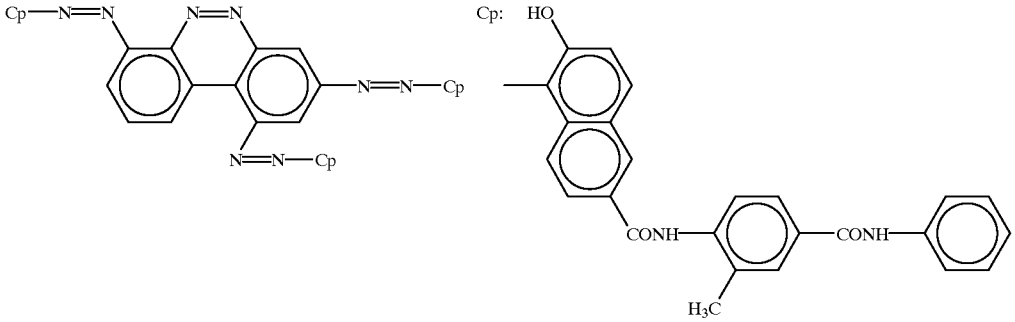

-continued
Pigment (6)-46
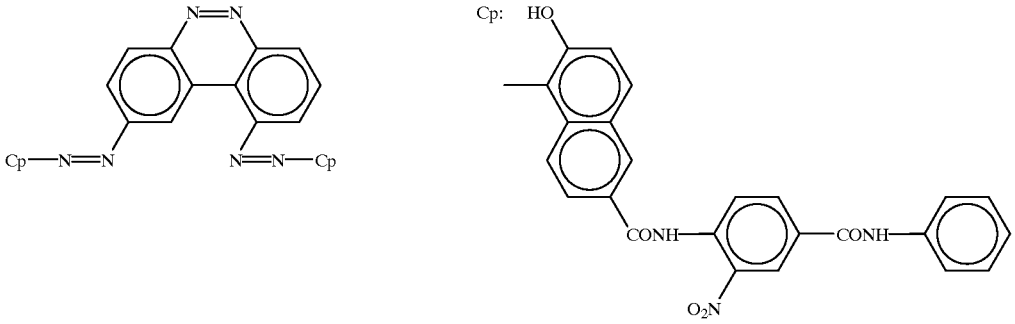
Pigment (6)-47
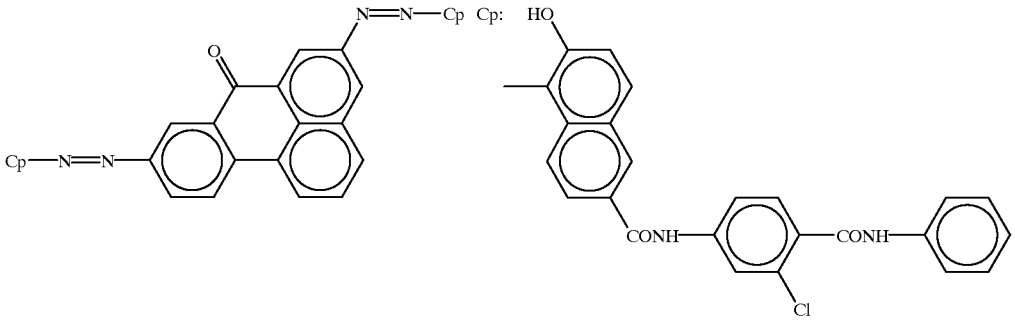
Pigment (6)-48
Structure:same as above
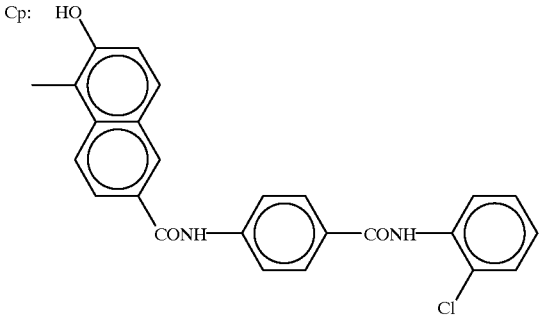
Pigment (6)-49
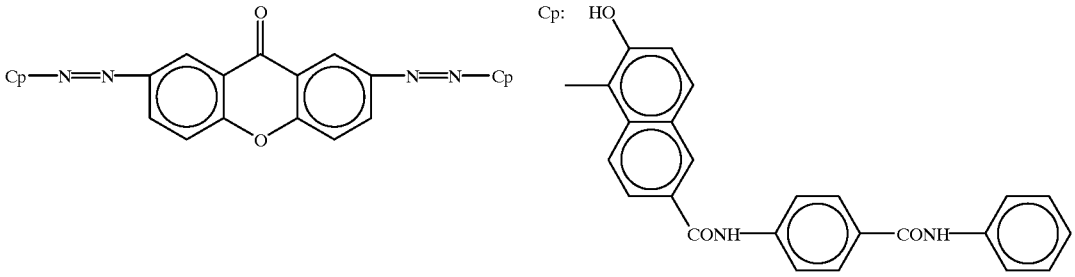
Pigment (6)-50
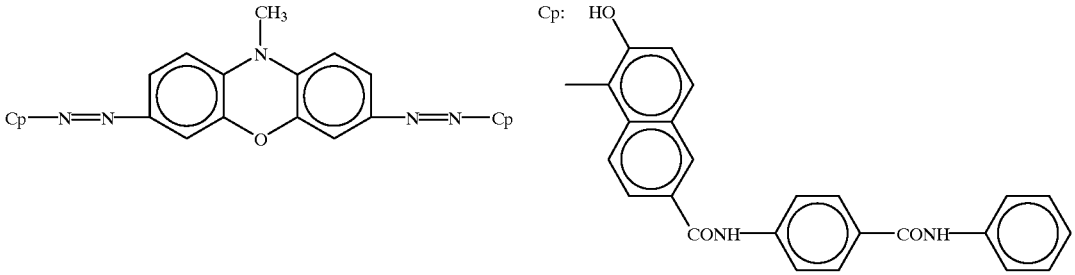

-continued
Pigment (6)-51
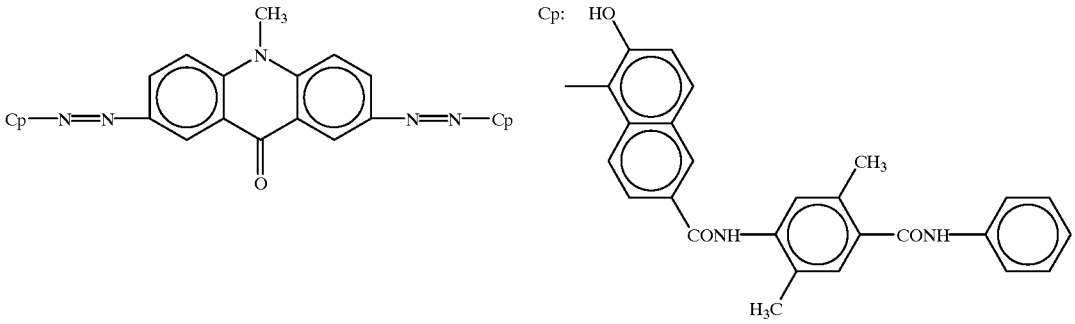
Pigment (6)-52
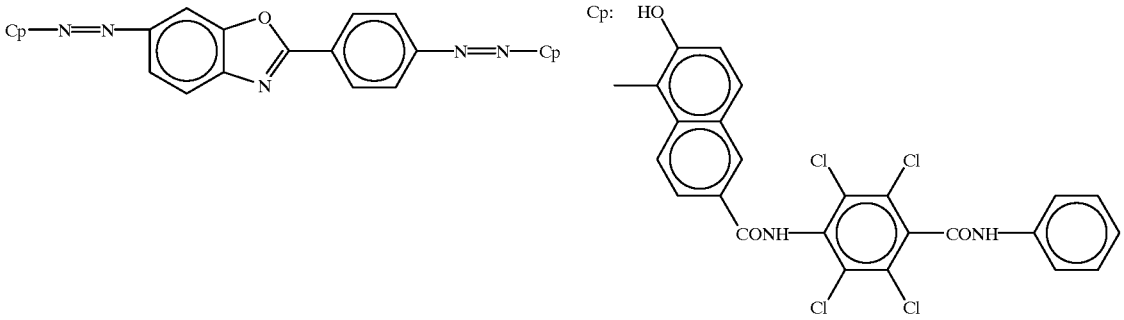
Pigment (6)-53
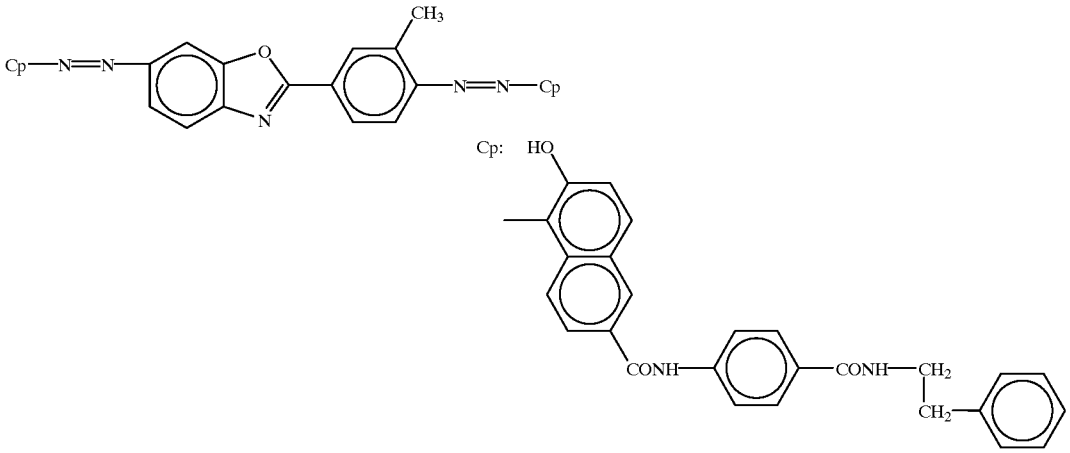
Pigment (6)-54
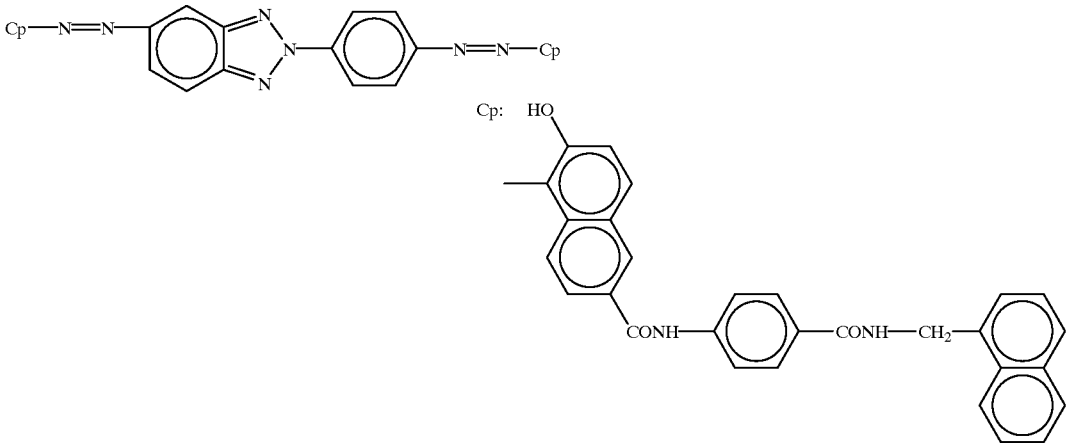

-continued
Pigment (6)-55
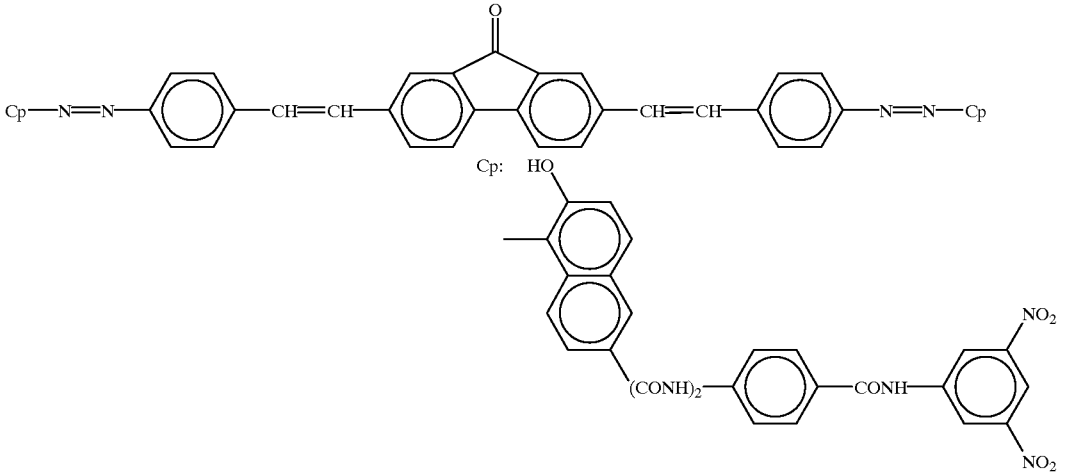
Pigment (6)-56
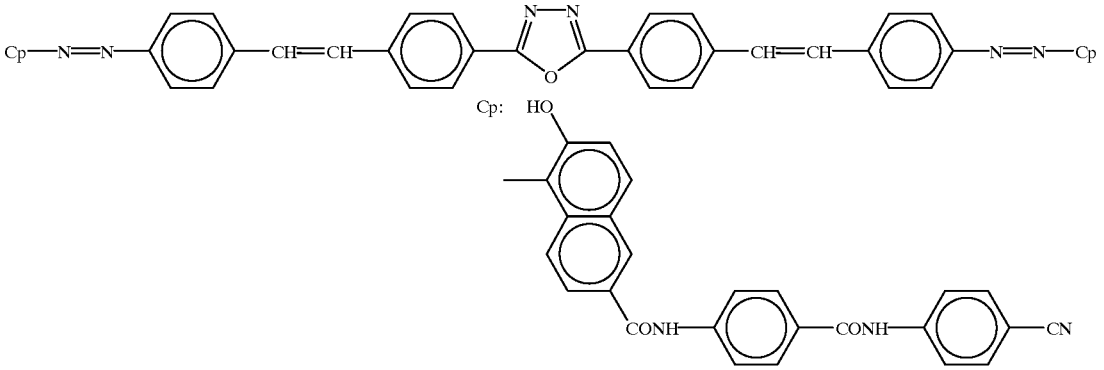
Pigment (6)-57
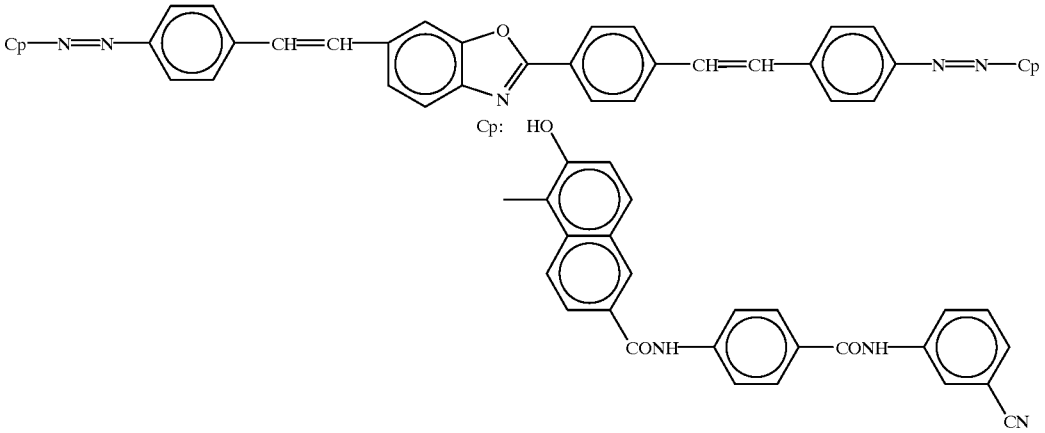
Pigment (6)-58
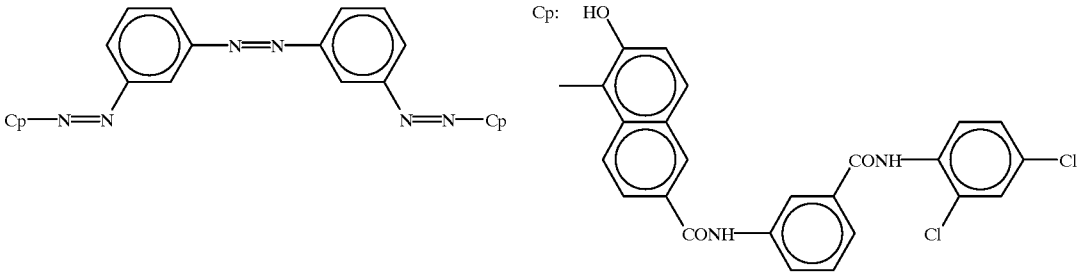

-continued
Pigment (6)-59
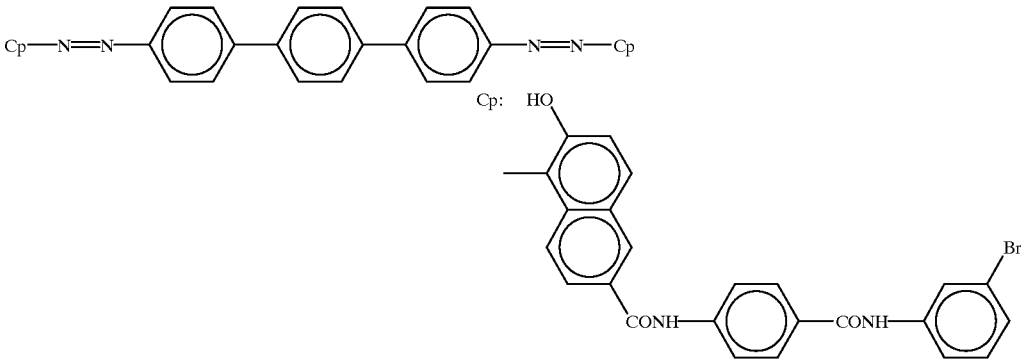
Pigment (6)-60
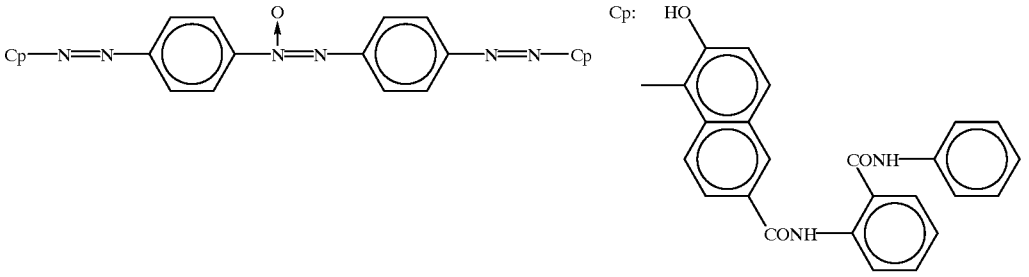
Pigment (6)-61
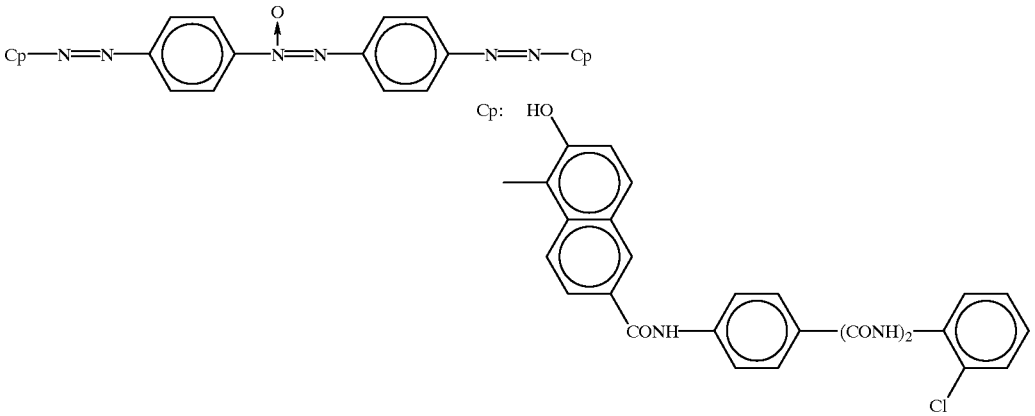
Pigment (6)-62
Structure: same as the above
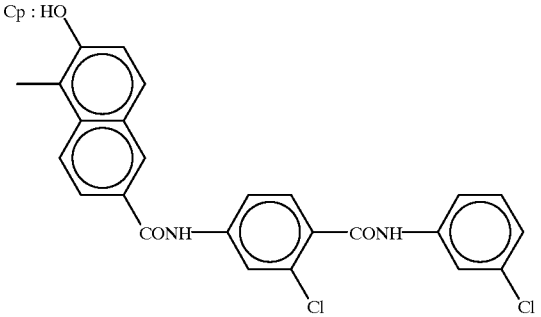

-continued
Pigment (6)-63
Structure: same as the above
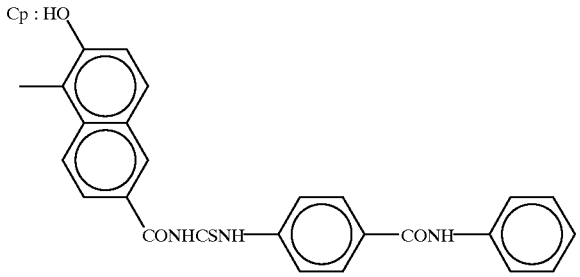
Pigment (6)-64
Structure: same as the above
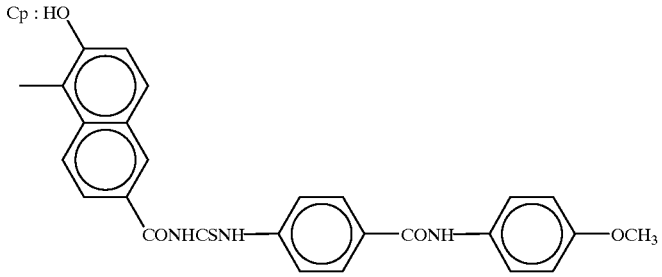
Pigment (6)-65
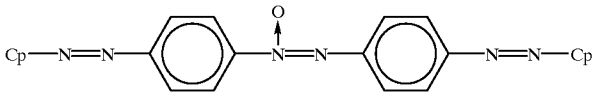
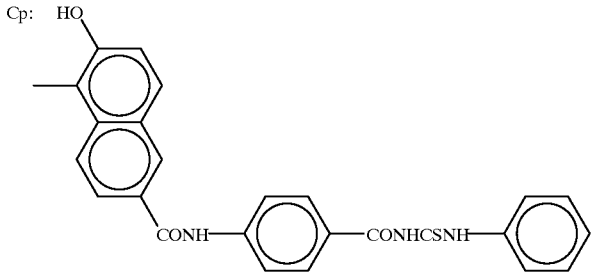
Pigment (6)-66
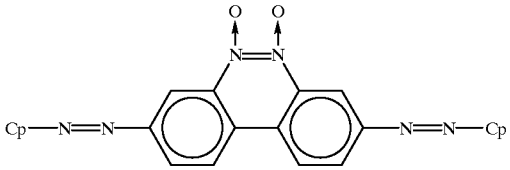
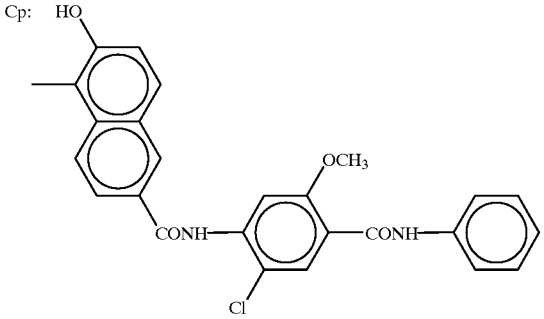
Pigment (6)-67
Structure: same as the above
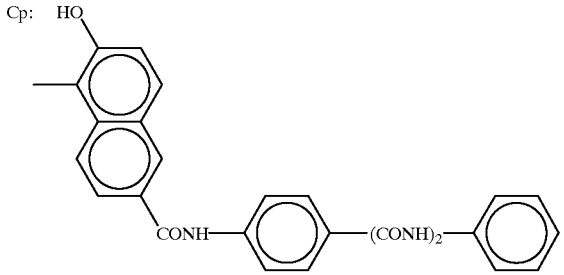

-continued
Pigment (6)-68
Structure: same as the above
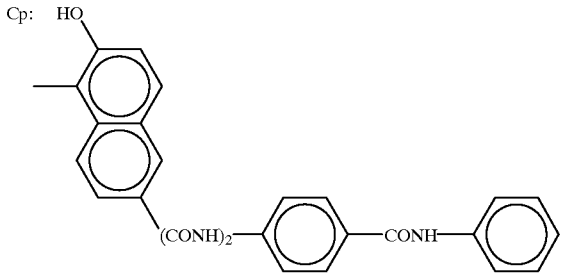
Pigment (6)-69
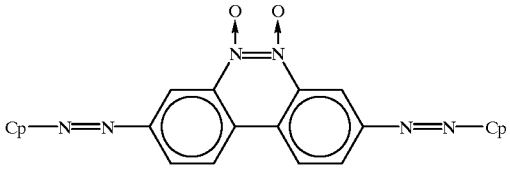
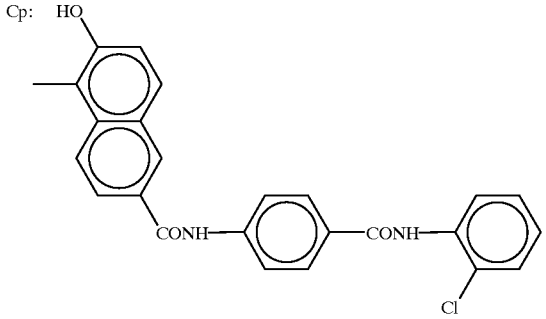
Pigment (6)-70
Structure: same as the above
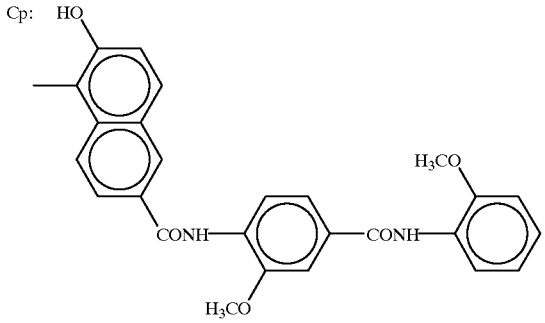
Pigment (6)-71
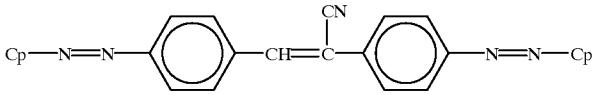
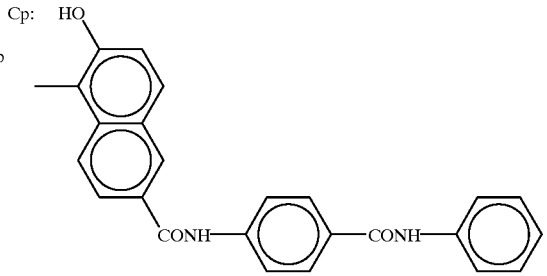
Pigment (6)-72
Structure: same as the above
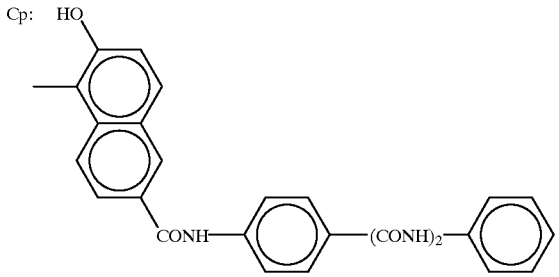

-continued
Pigment (6)-73
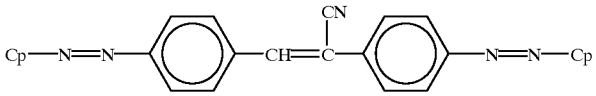
Cp:
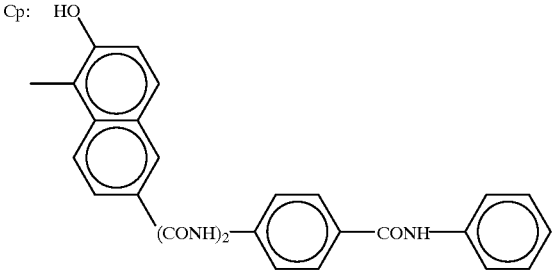
Pigment (6)-74
Structure: same as the above
Cp:
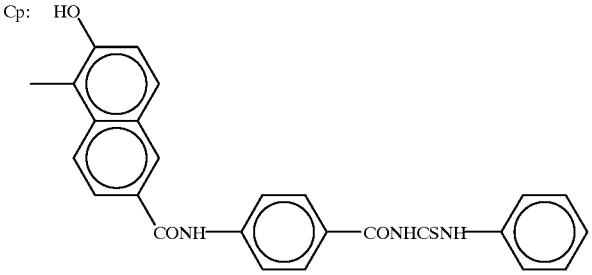
Pigment (6)-75
Structure: same as the above
Cp:
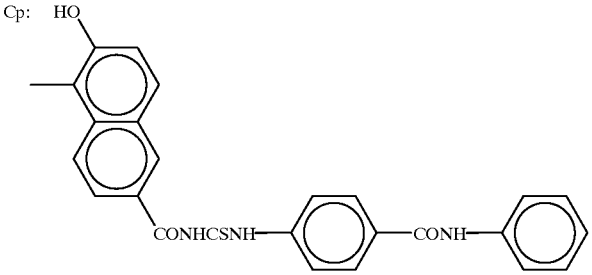
Pigment (6)-76
Structure: same as the above
Cp:
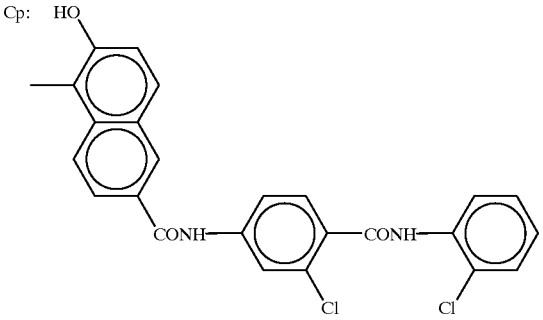

-continued
Pigment (6)-77
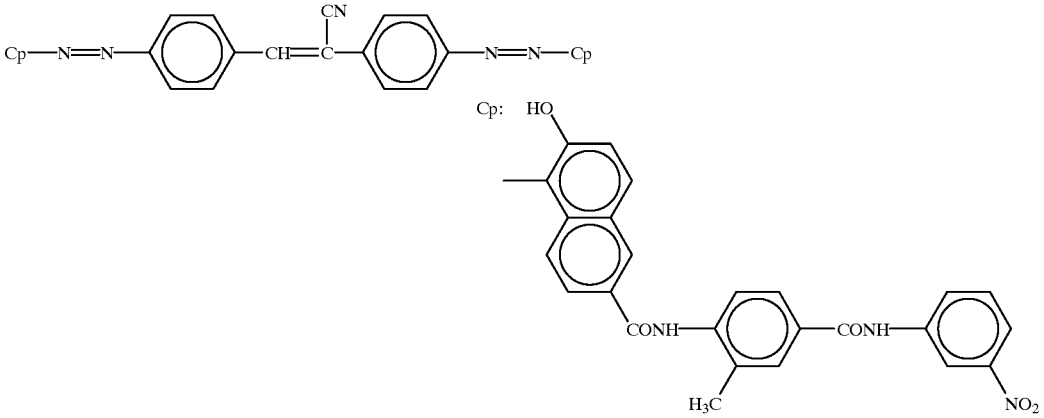
Pigment (6)-78
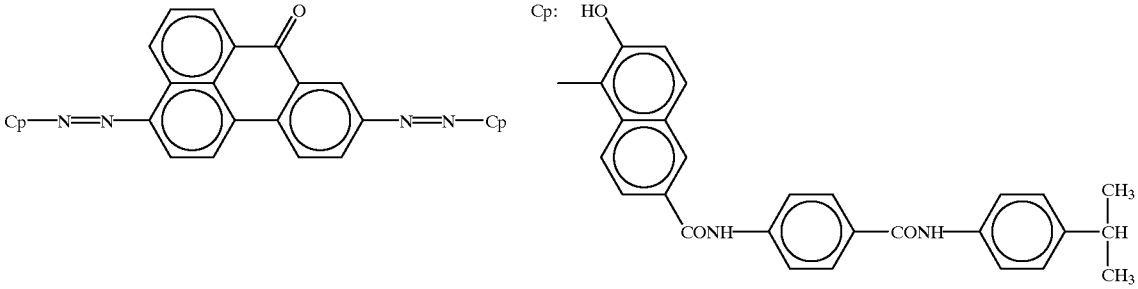
Pigment (6)-79
Structure: same as the above
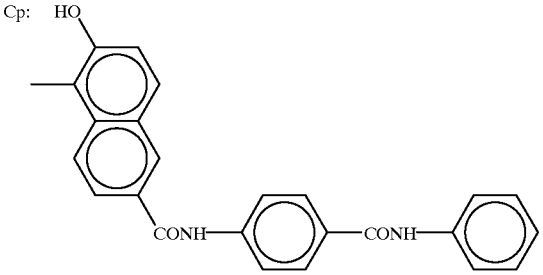
Pigment (6)-80
Structure: same as the above
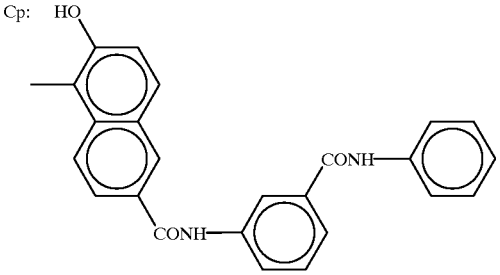
Pigment (6)-81
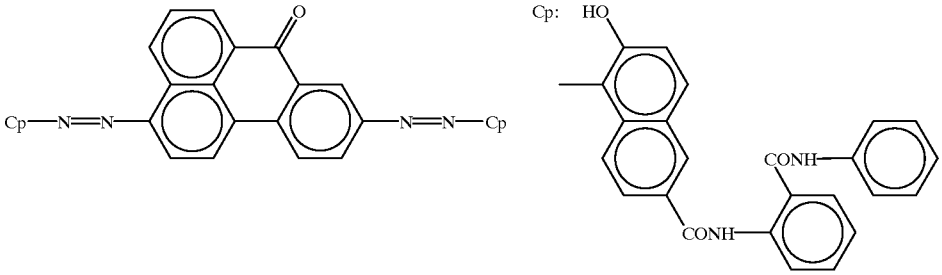

-continued
Pigment (6)-82
Structure: same as the above
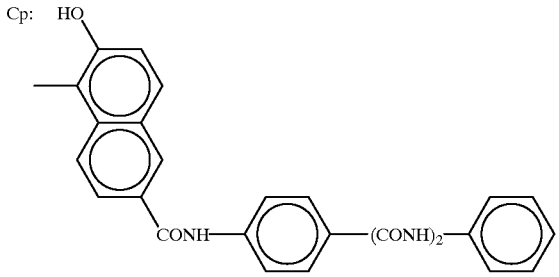
Pigment (6)-83
Structure: same as the above
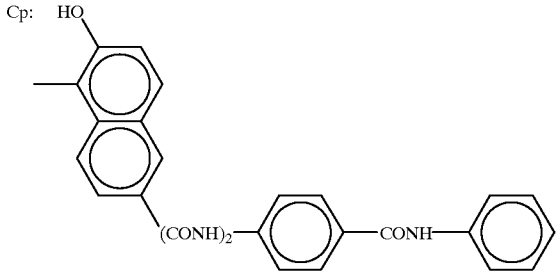
Pigment (6)-84
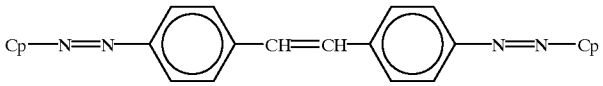
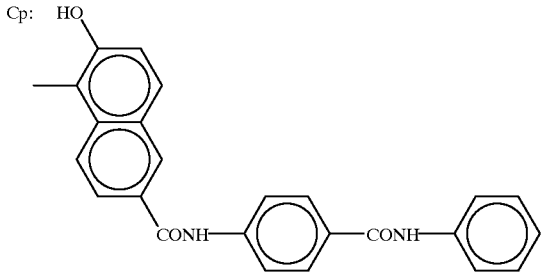
Pigment (6)-85
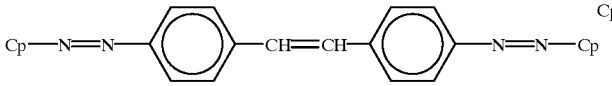
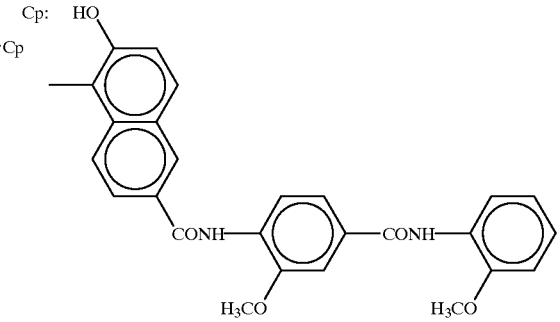

-continued
Pigment (6)-86
Structure: same as the above
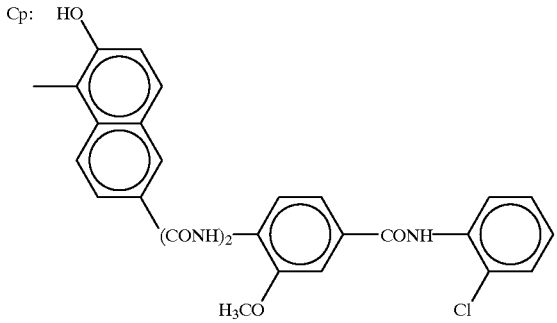
Pigment (6)-87
Structure: same as the above
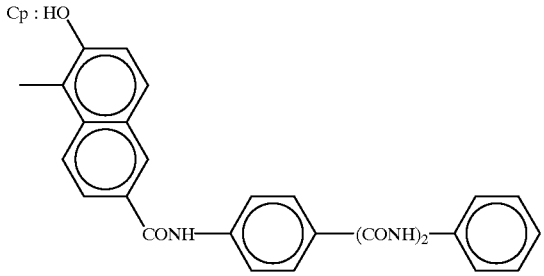
Pigment (6)-88
Structure: same as the above
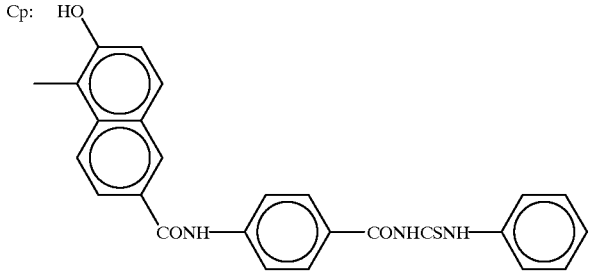
Pigment (6)-89
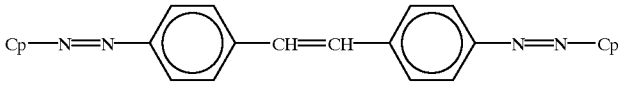
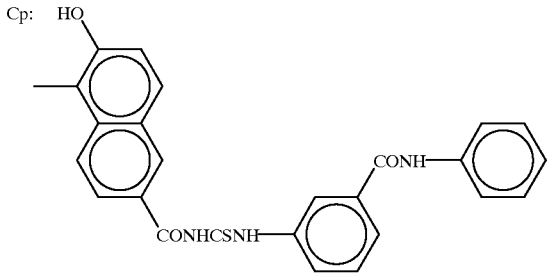

-continued
Pigment (6)-90
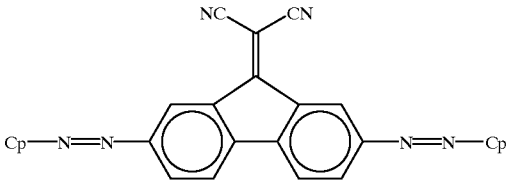
Cp:
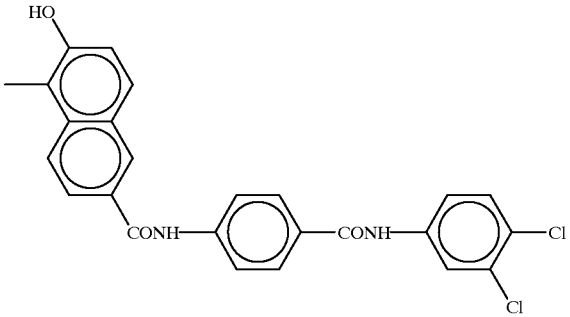
Pigment (6)-91
Structure: Same as the above
Cp:
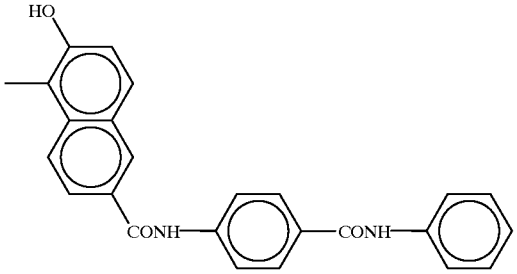
Pigment (6)-92
Structure: Same as the above
Cp:
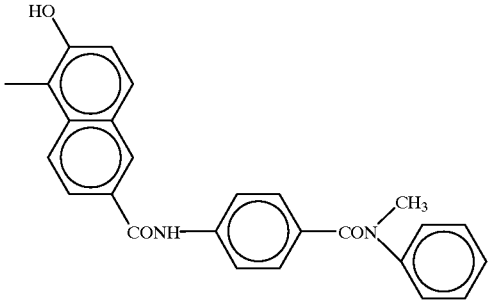
Pigment (6)-93
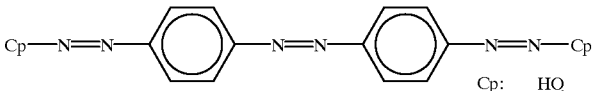
Cp:
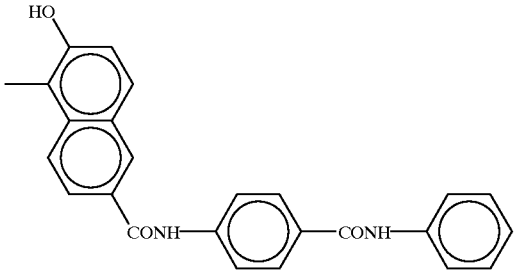
Pigment (6)-94
Structure: Same as the above
Cp:
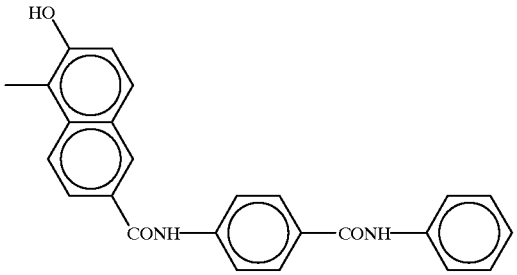

-continued
Pigment (6)-95
Structure: same as the above
Cp:
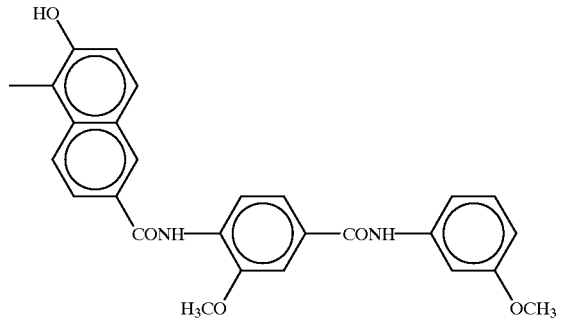
Pigment (6)-96
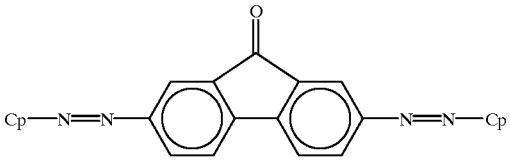
Cp:
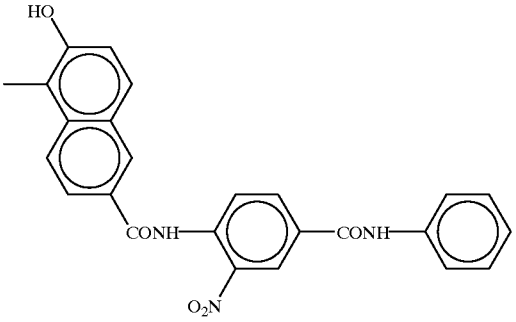
Pigment (6)-97
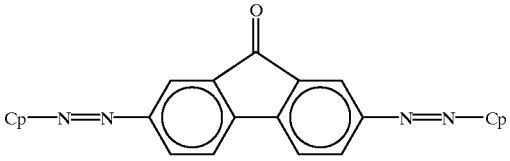
Cp:
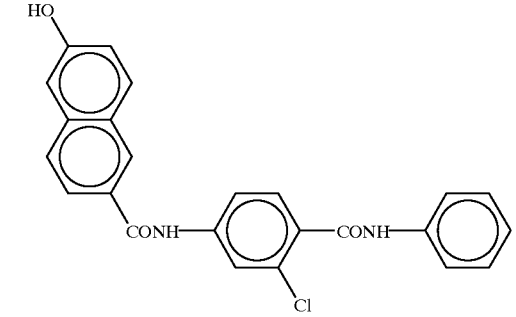
Pigment (6)-98
Structure: same as the above
Cp:
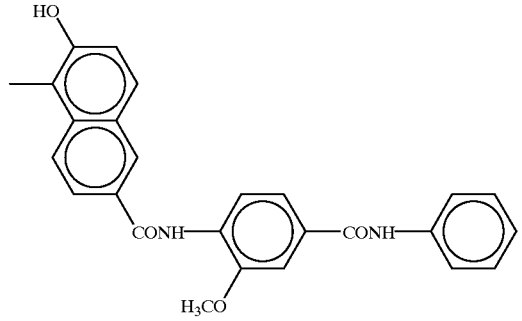

-continued
Pigment (6)-99
Structure: same as the above
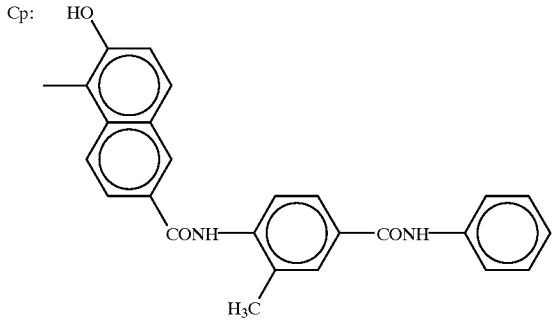
Pigment (6)-100
Structure: same as the above
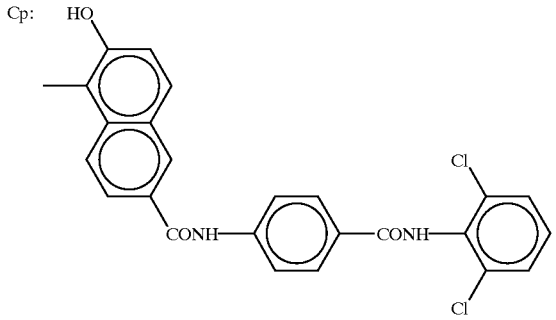
Pigment (6)-101
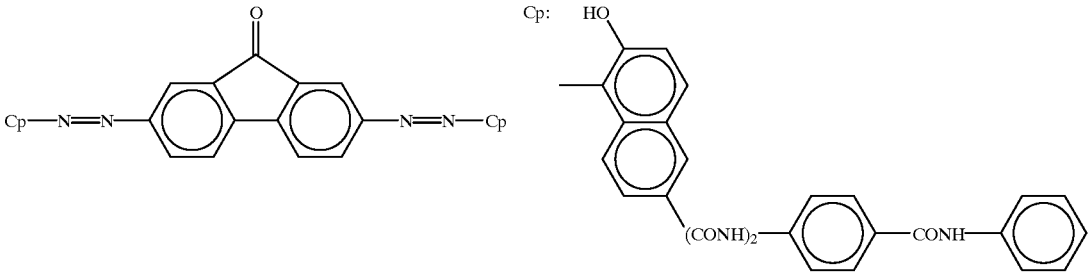
Pigment (6)-102
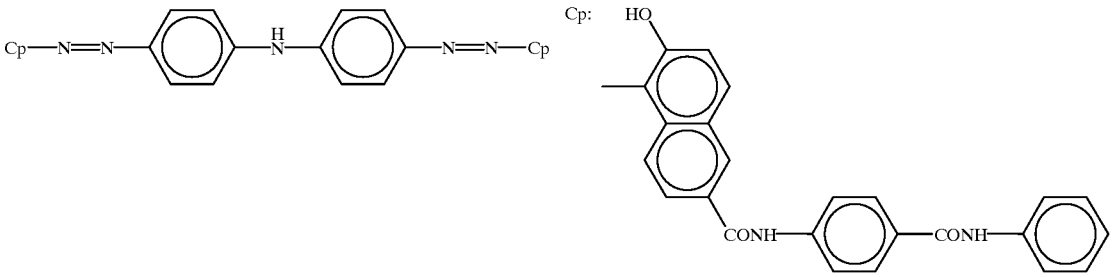
Pigment (6)-103
Structure: same as the above
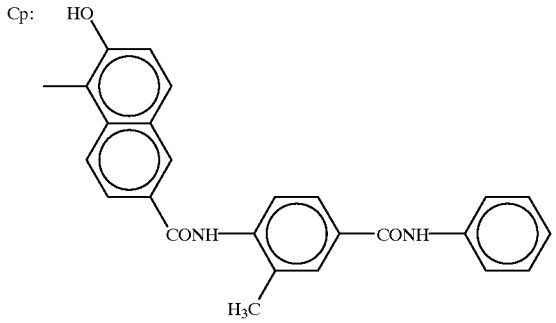

-continued
Pigment (6)-104
Structure: same as the above
Cp:
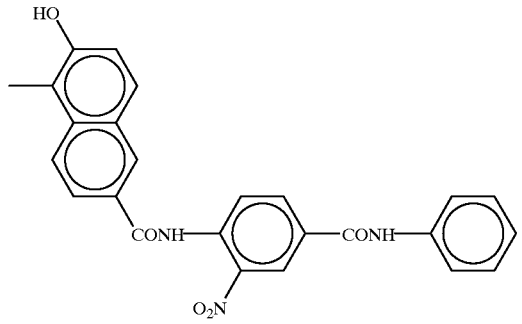
Pigment (6)-105
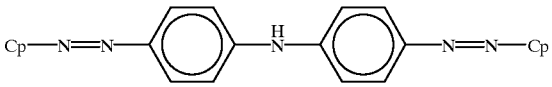
Cp:
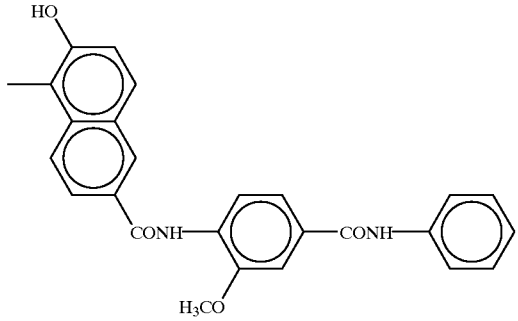
Pigment (6)-106
Structure: same as the above
Cp:
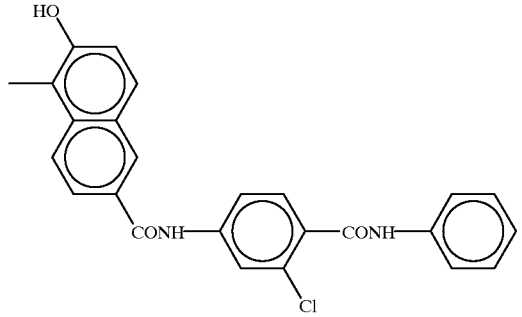
Pigment (6)-107
Structure: same as the above
Cp:
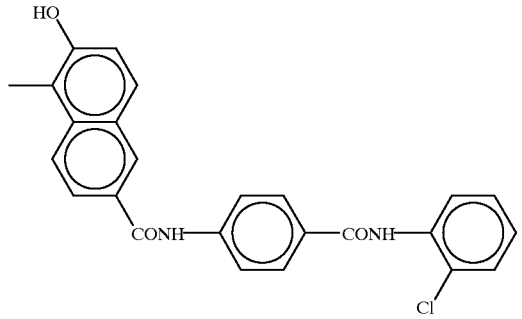

-continued
Pigment (6)-108
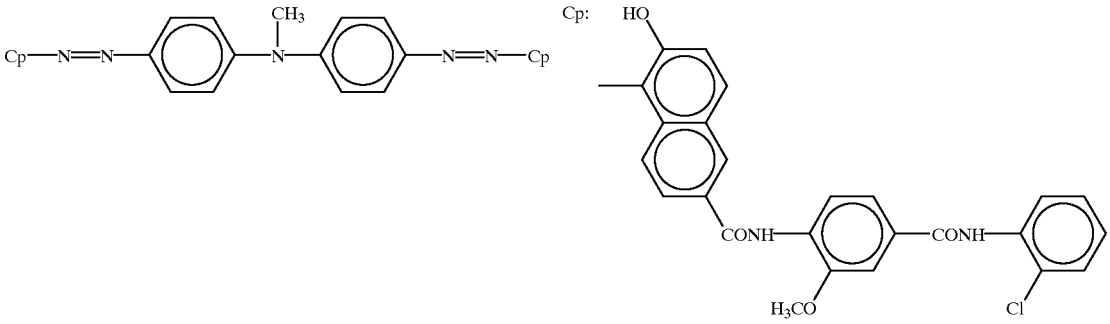
Pigment (6)-109
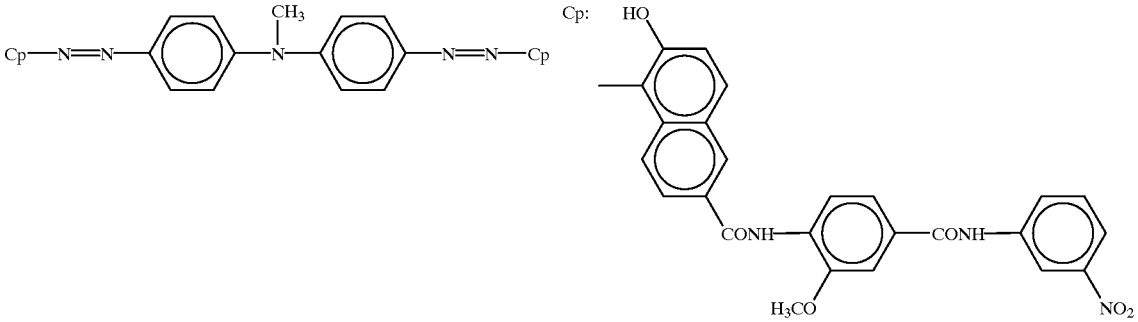
Pigment (6)-110
Structure: same as the above
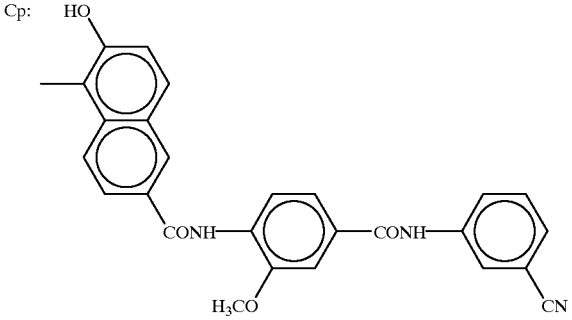
Pigment (6)-111
Structure: same as the above
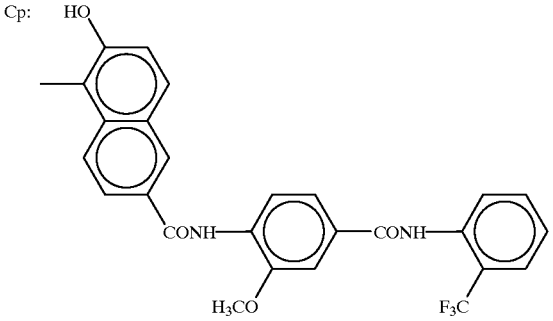

-continued
Pigment (6)-112
Structure: same as the above
Cp:
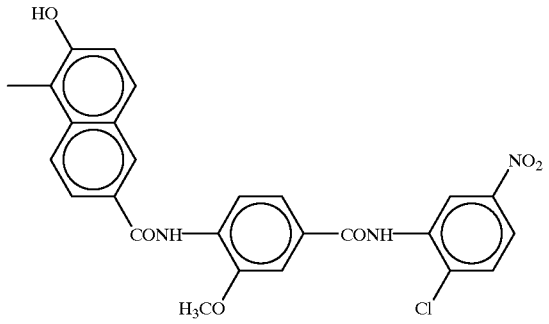
Pigment (6)-113
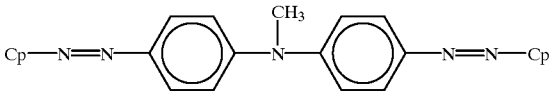
Cp:
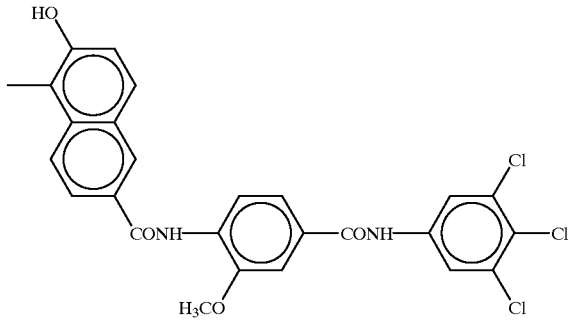
Pigment (6)-114
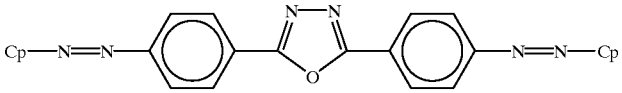
Cp:
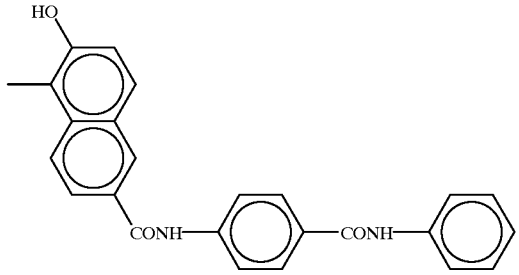
Pigment (6)-115
Structure: same as the above
Cp:
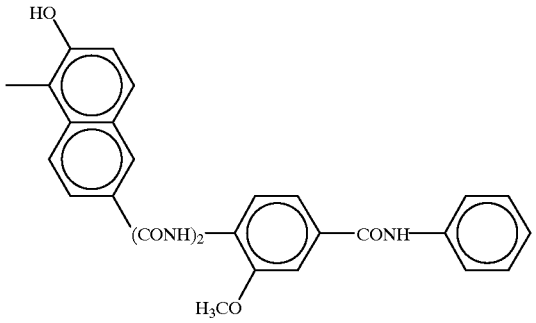

-continued
Pigment (6)-116
Structure: same as the above
Cp:
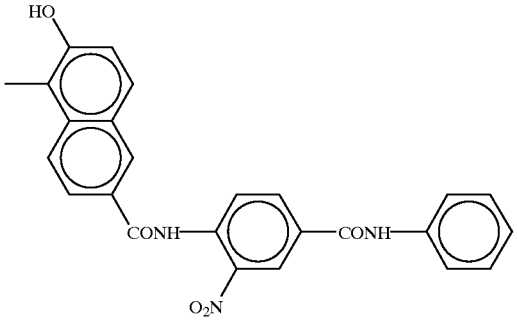
Pigment (6)-117
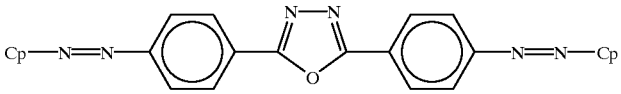
Cp:
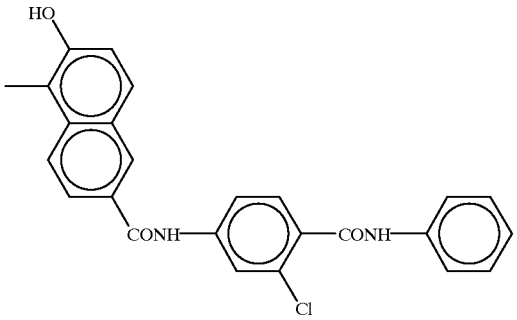
Pigment (6)-118
Structure: same as the above
Cp:
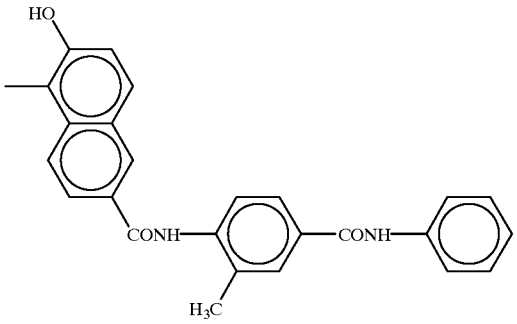
Pigment (6)-119
Structure: same as the above
Cp:
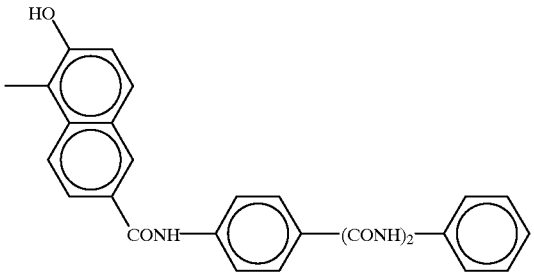

-continued
Pigment (6)-120
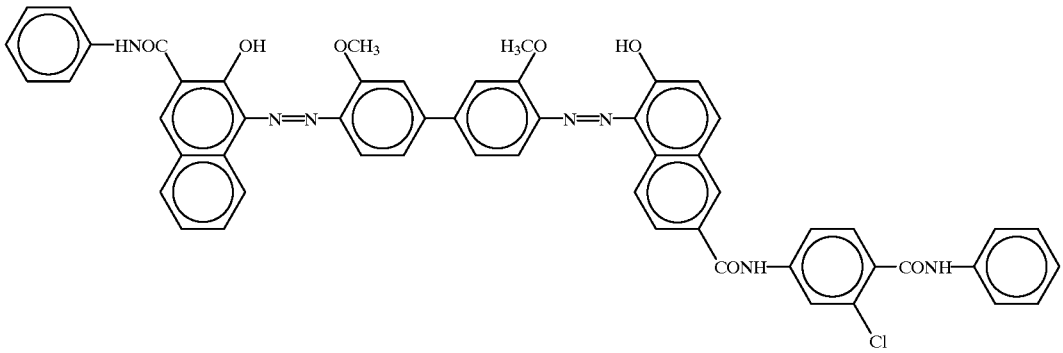
Pigment (6)-121
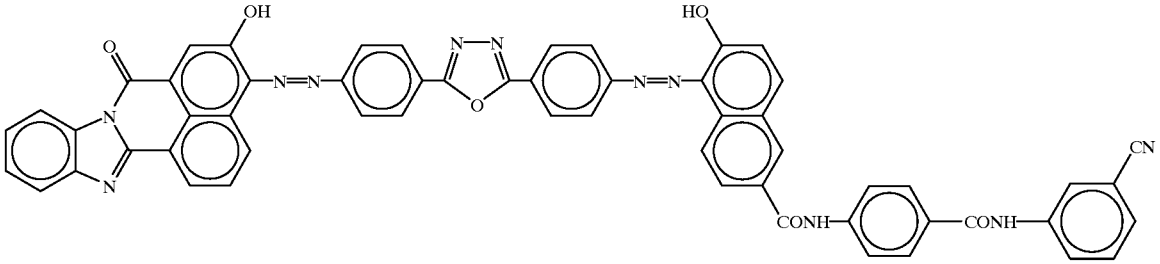
Pigment (6)-122
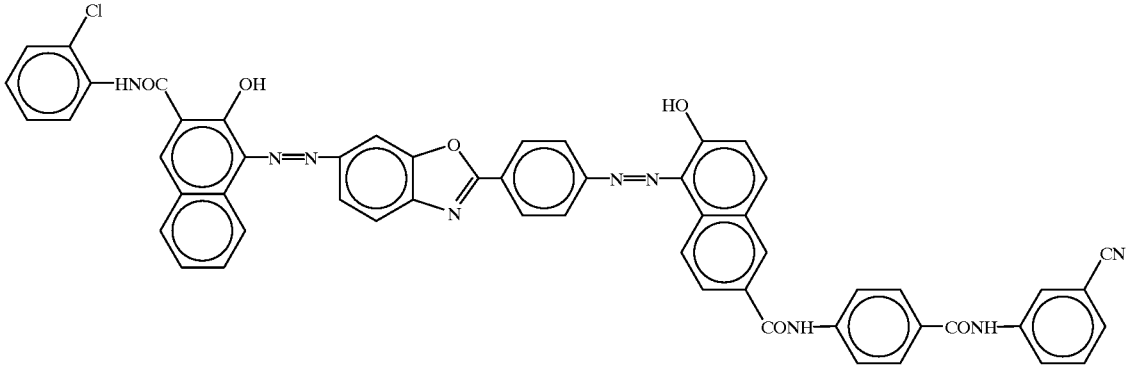
Pigment (6)-123
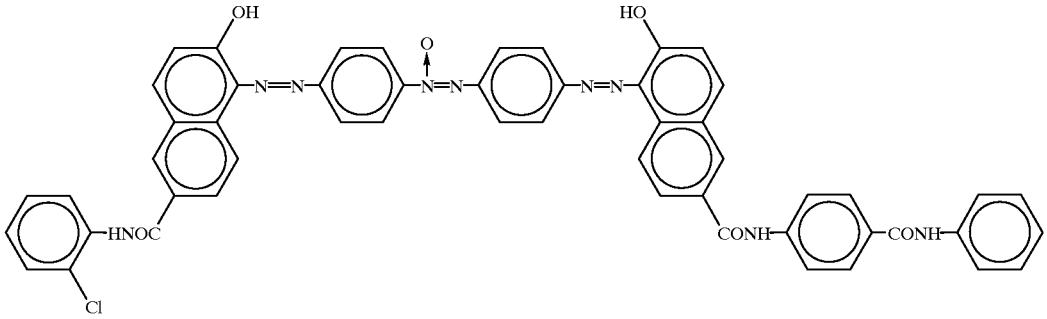

-continued
Pigment (6)-124
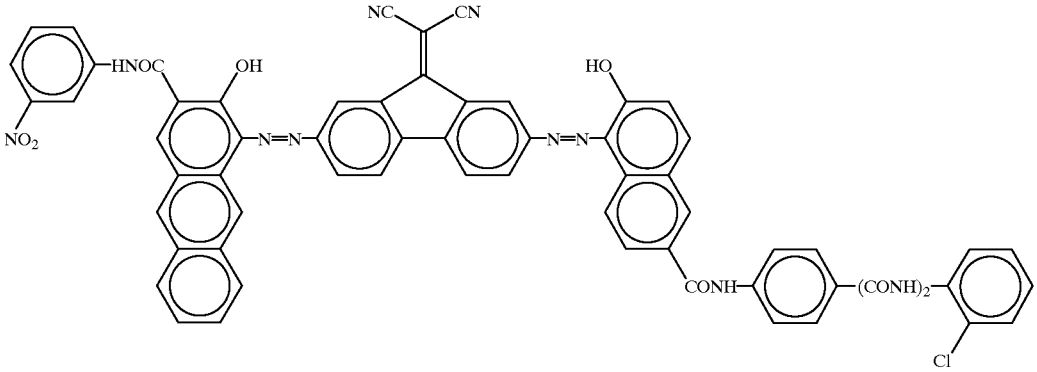
Pigment (6)-125
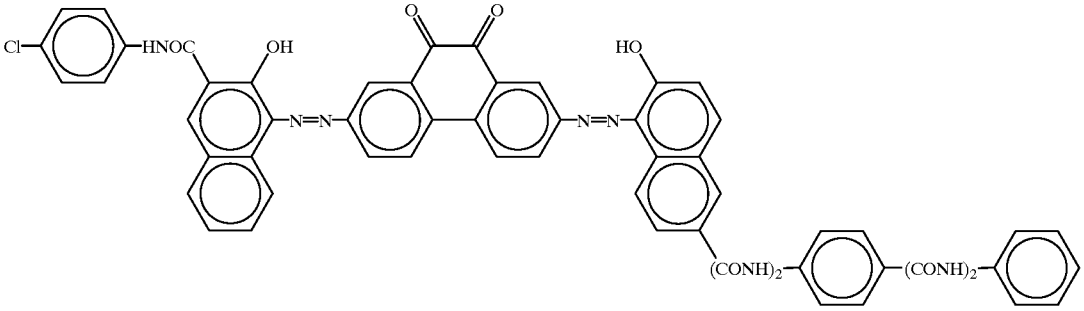
Pigment (6)-126
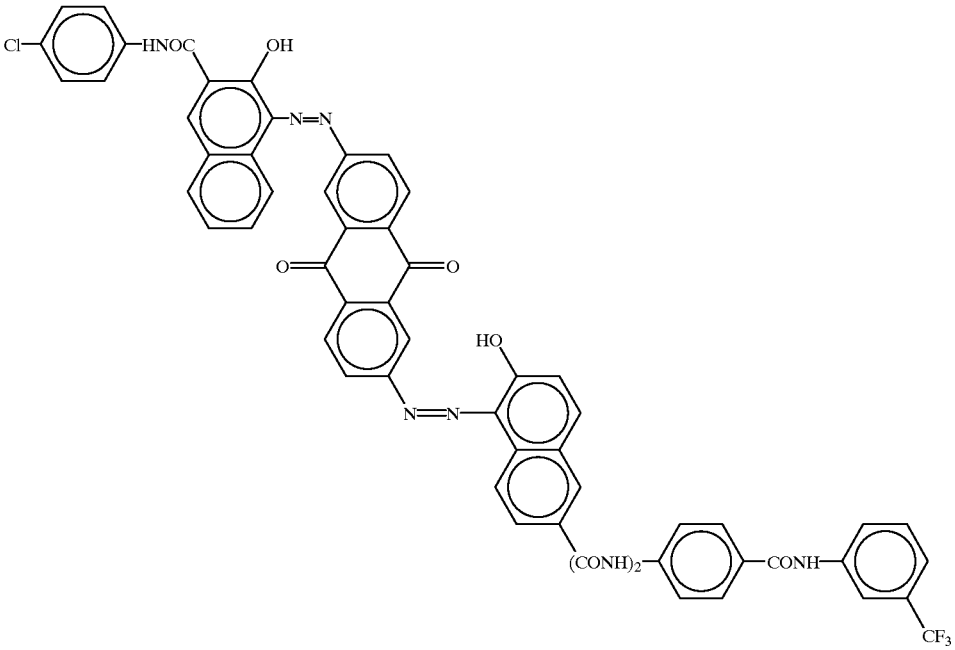

-continued
Pigment (6)-127
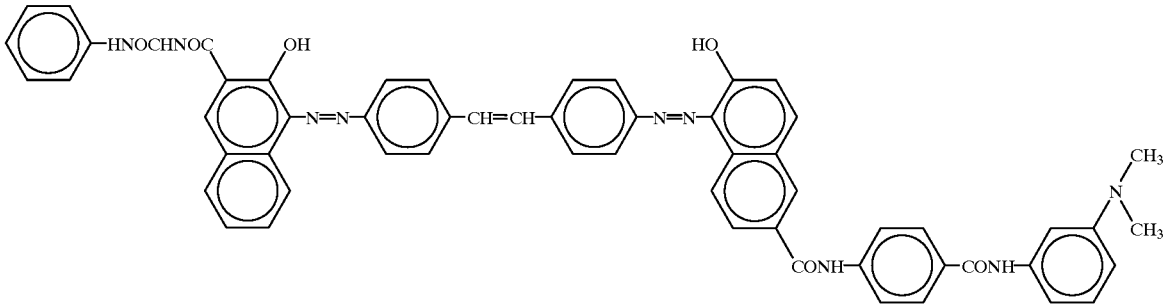
Pigment (6)-128
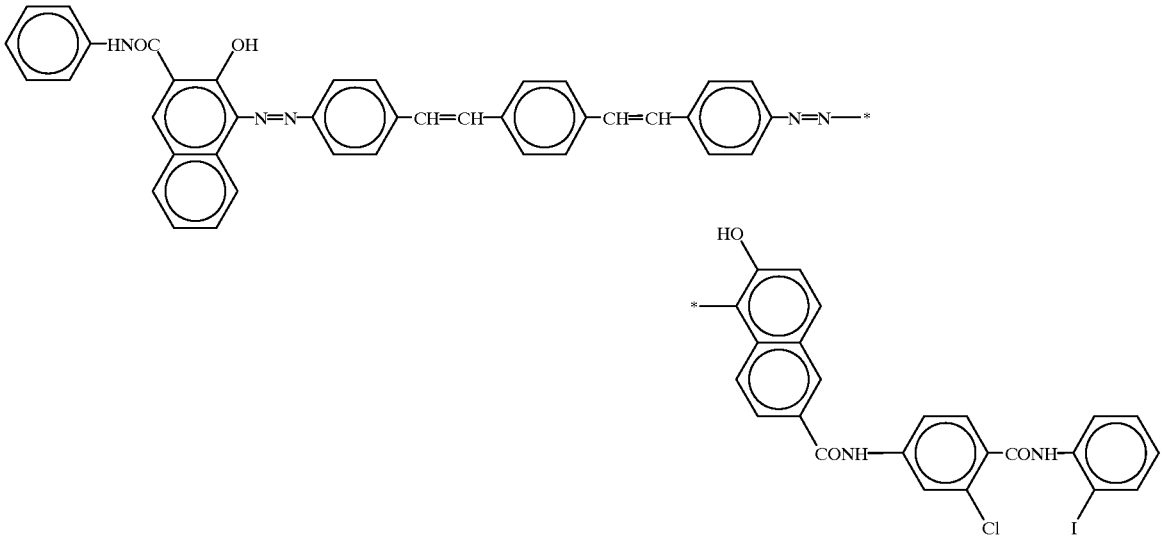
Pigment (6)-129
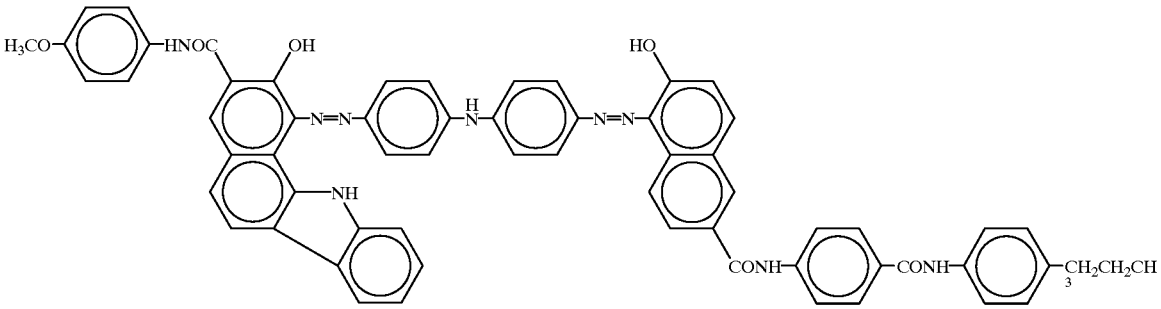
Pigment (6)-130
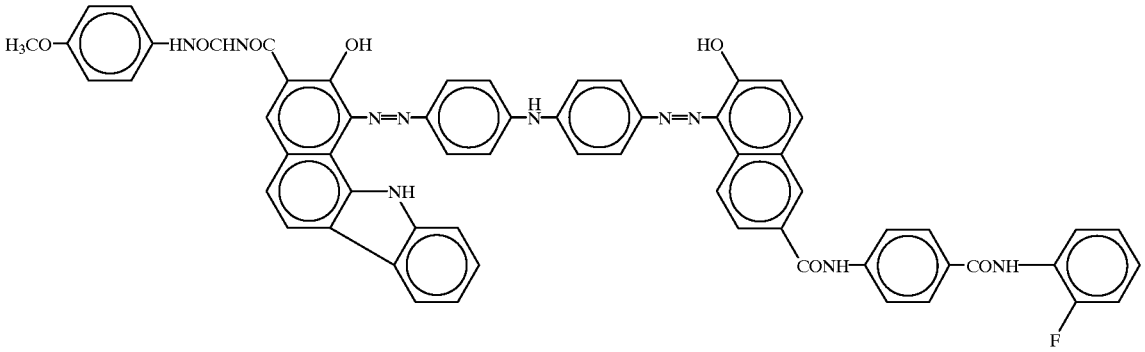

-continued
Pigment (6)-131
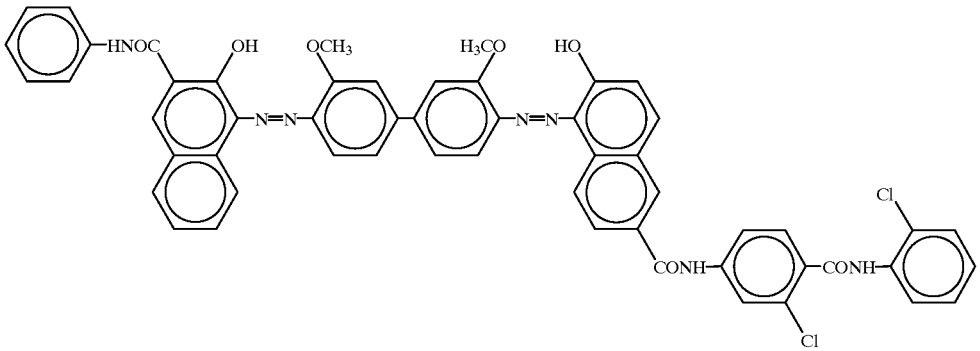
Pigment (6)-132
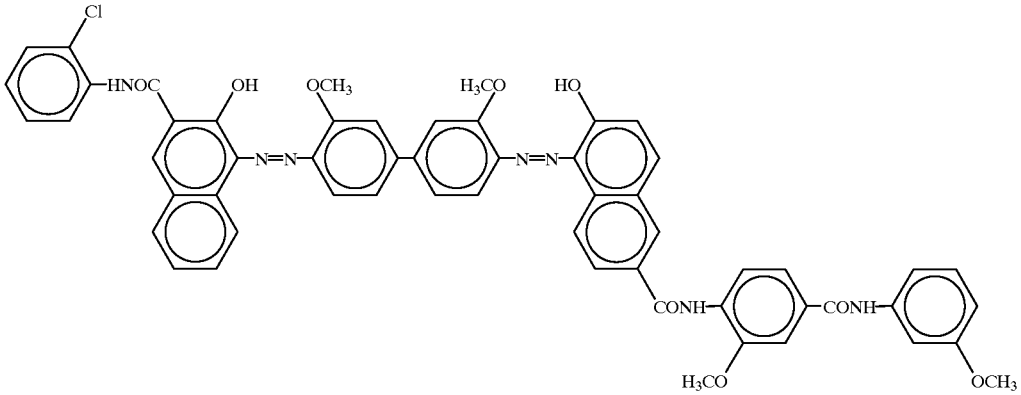
Pigment (6)-133
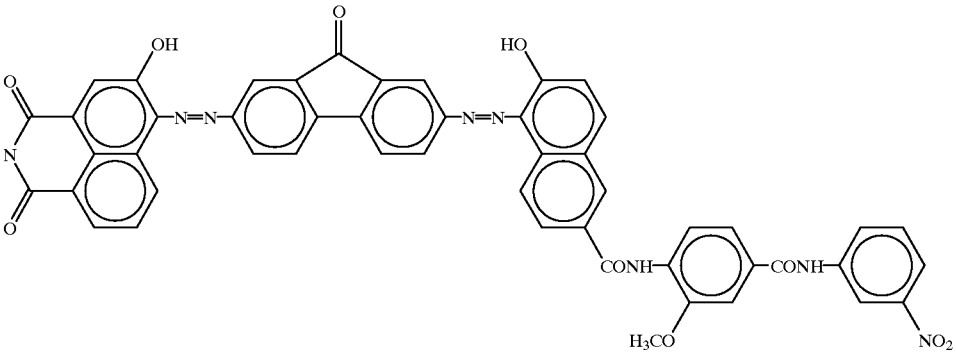

-continued
Pigment (6)-134
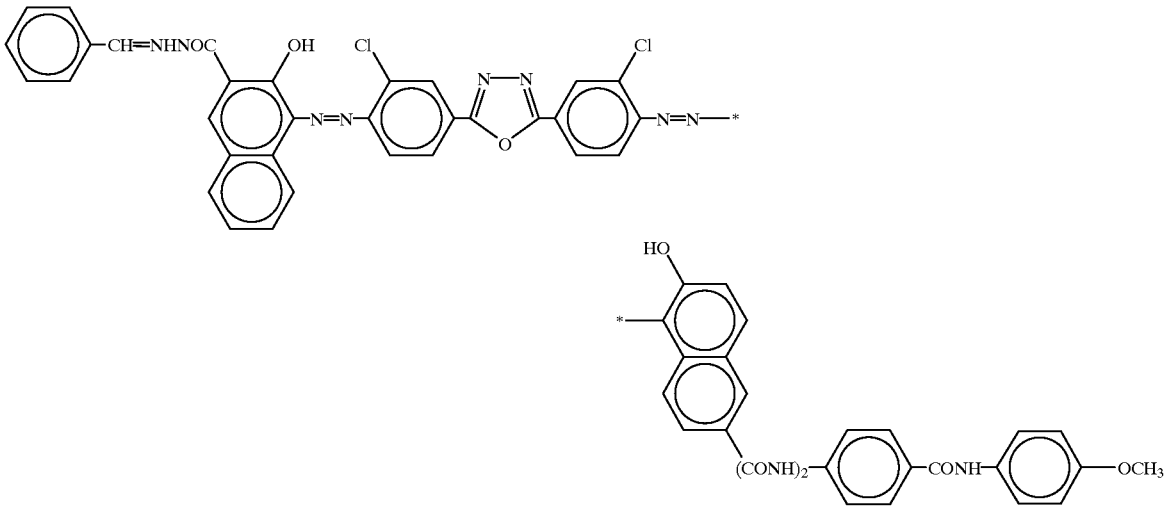
Pigment (7)-1
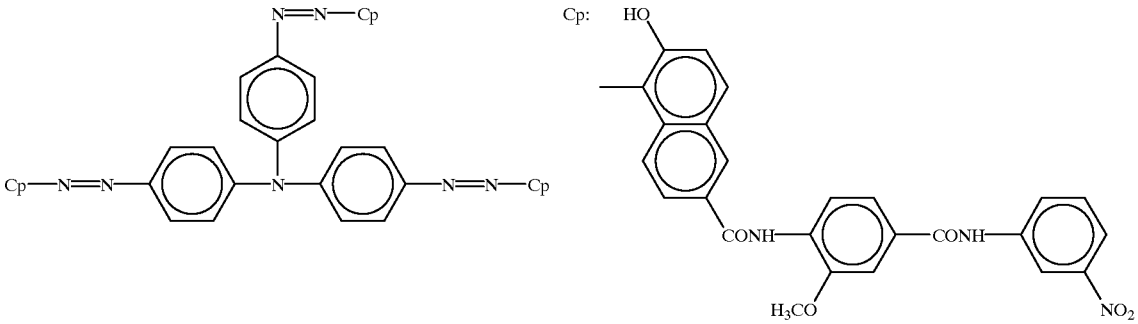
Pigment (7)-2
Structure: same as the above
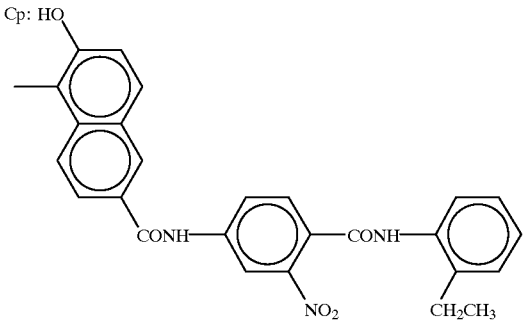
Pigment (7)-3
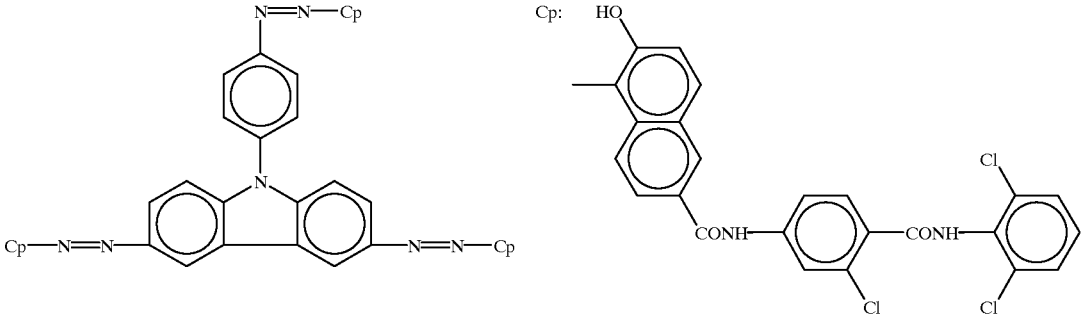

-continued
Pigment (7)-4
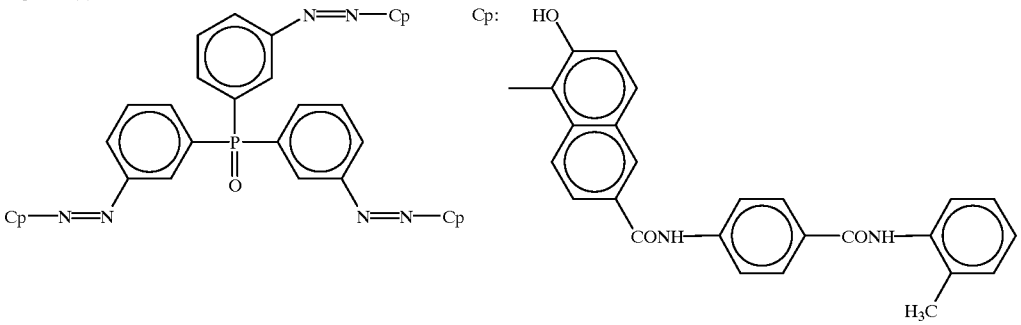
Pigment (7)-5
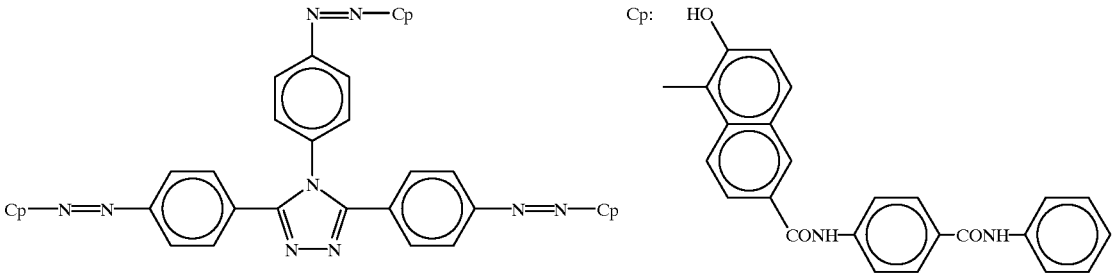
Pigment (7)-6
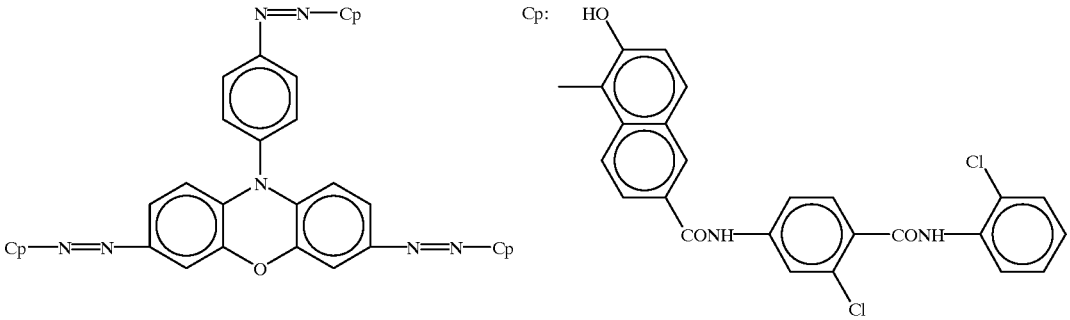
Pigment (7)-7
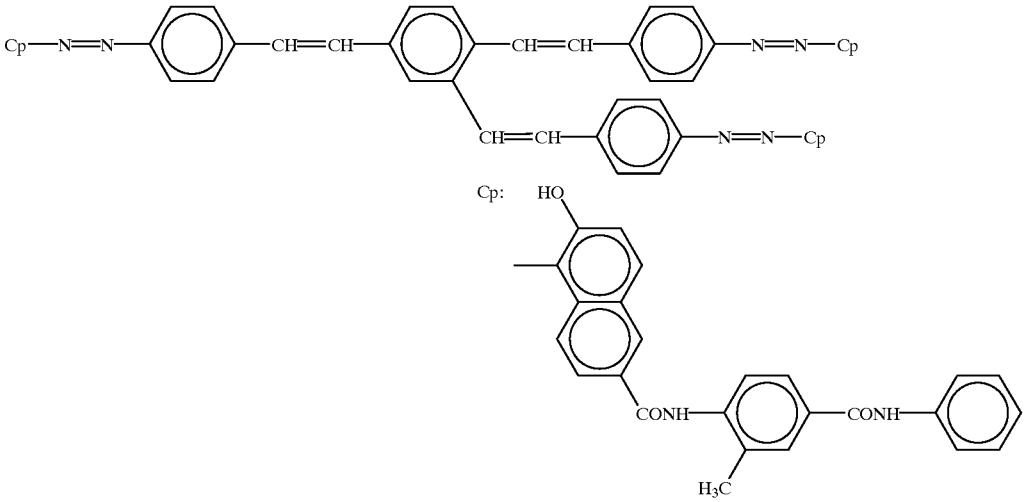

-continued
Pigment (7)-8
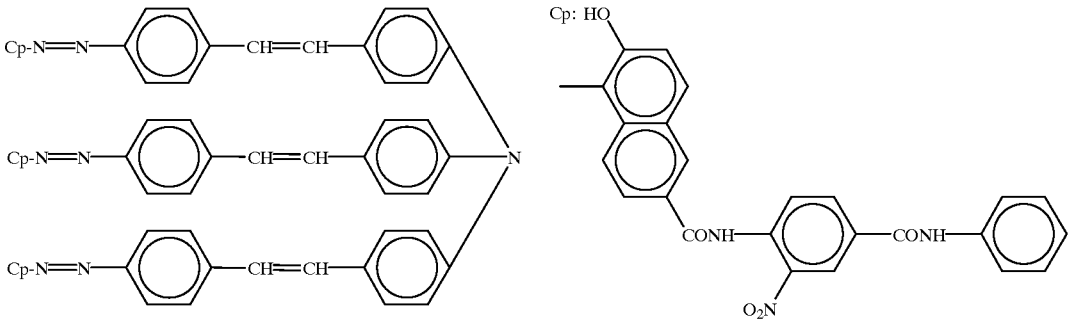
Pigment (7)-9
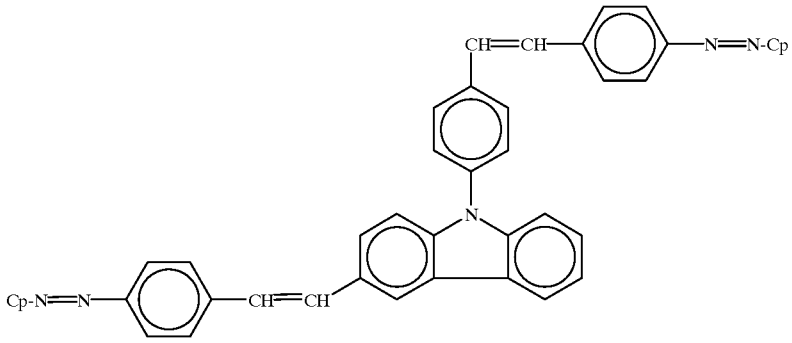
Pigment (7)-10
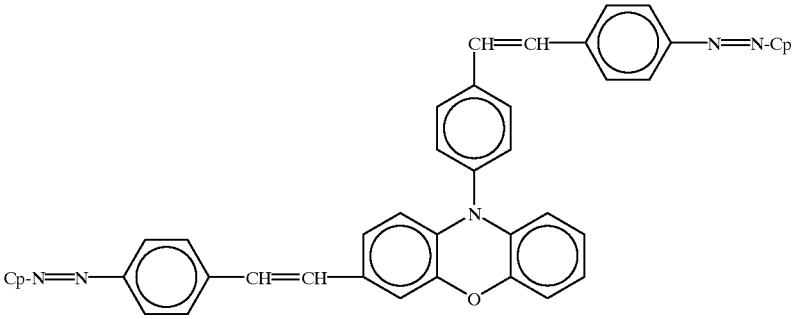

-continued
Pigment (7)-11
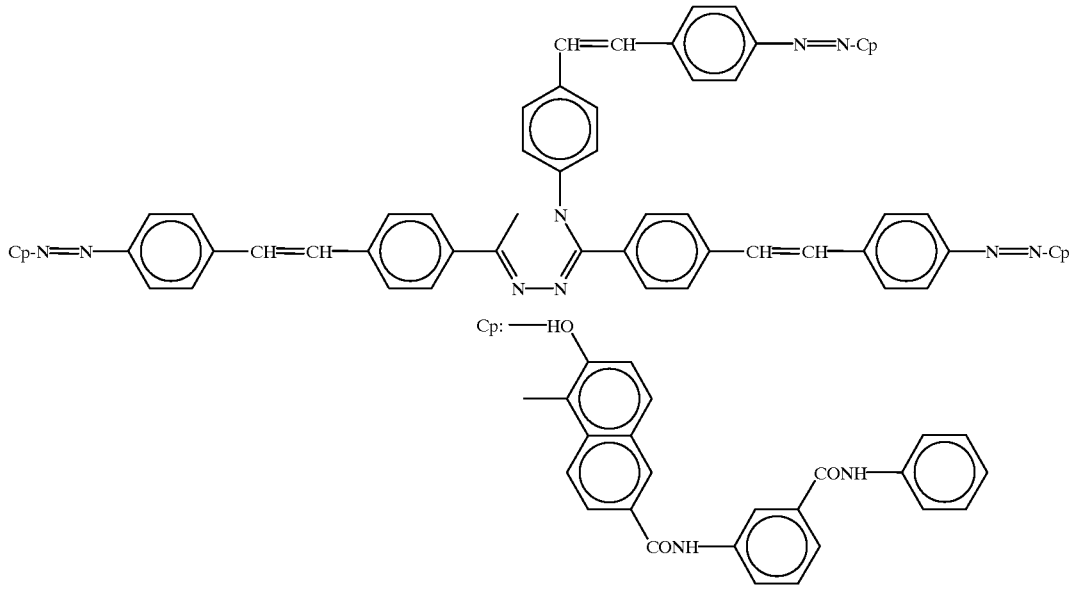
Pigment (7)-12
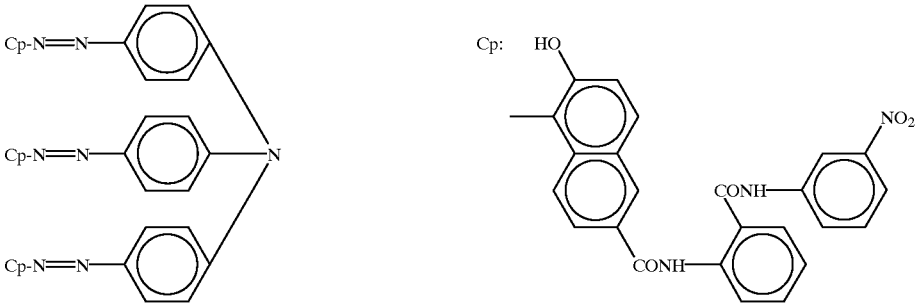
Pigment (7)-13
Structure: same as the above
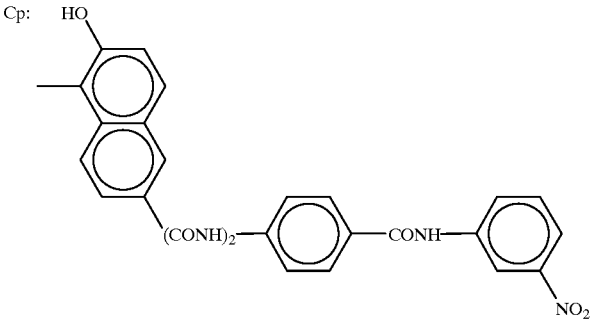
Pigment (7)-14
Structure: same as the above
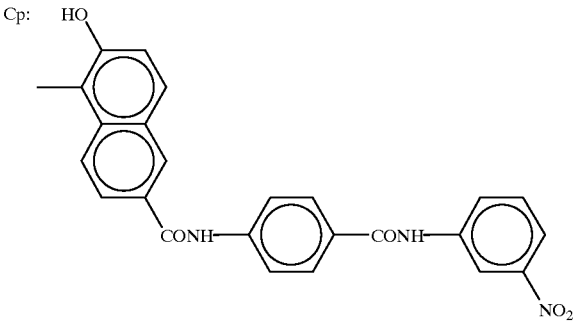

-continued
Pigment (7)-15
Structure: same as the above
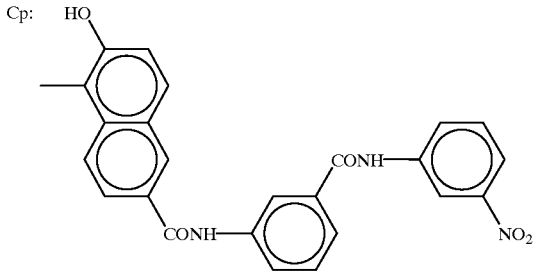
Pigment (7)-16
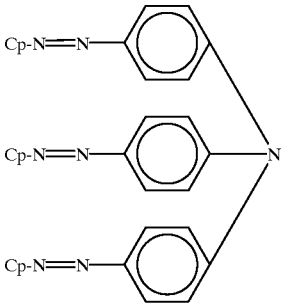
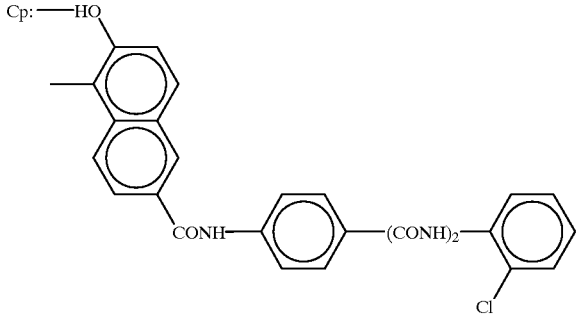
Pigment (7)-17
Structure: same as the above
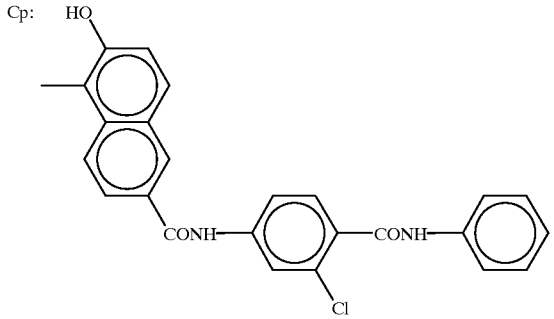
Pigment (7)-18
Structure: same as the above
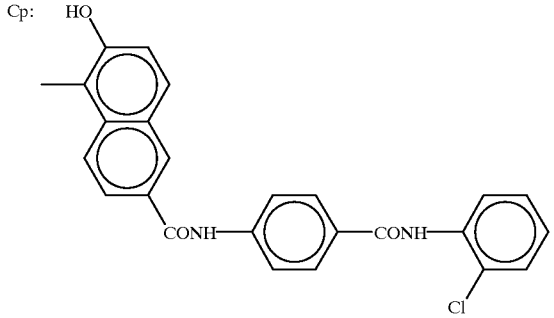
Pigment (7)-19
Structure: same as the above
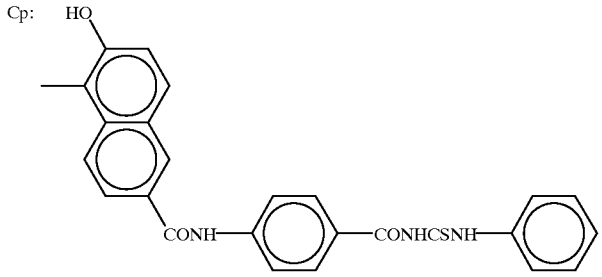

-continued
Pigment (7)-20
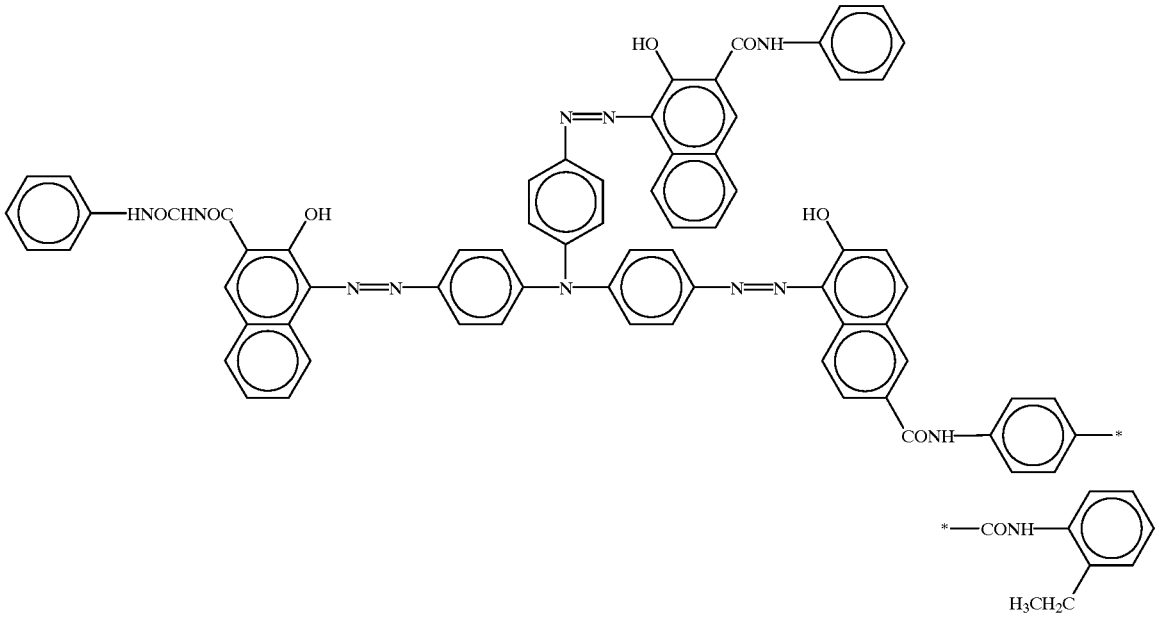
Pigment (7)-21
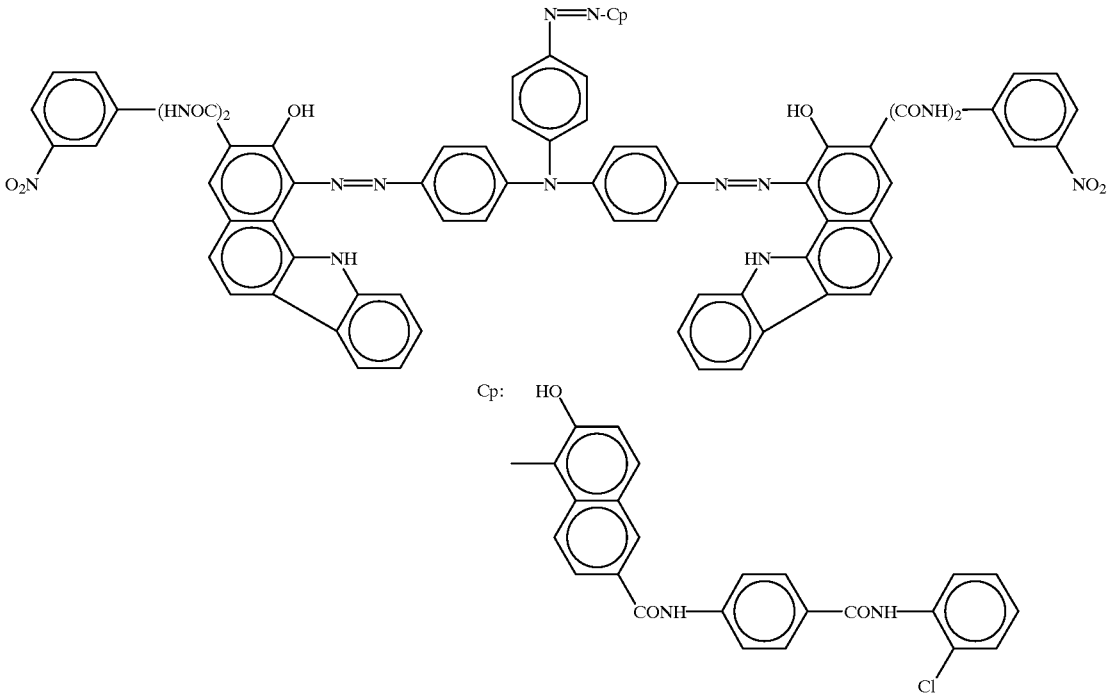

-continued
Pigment (7)-22
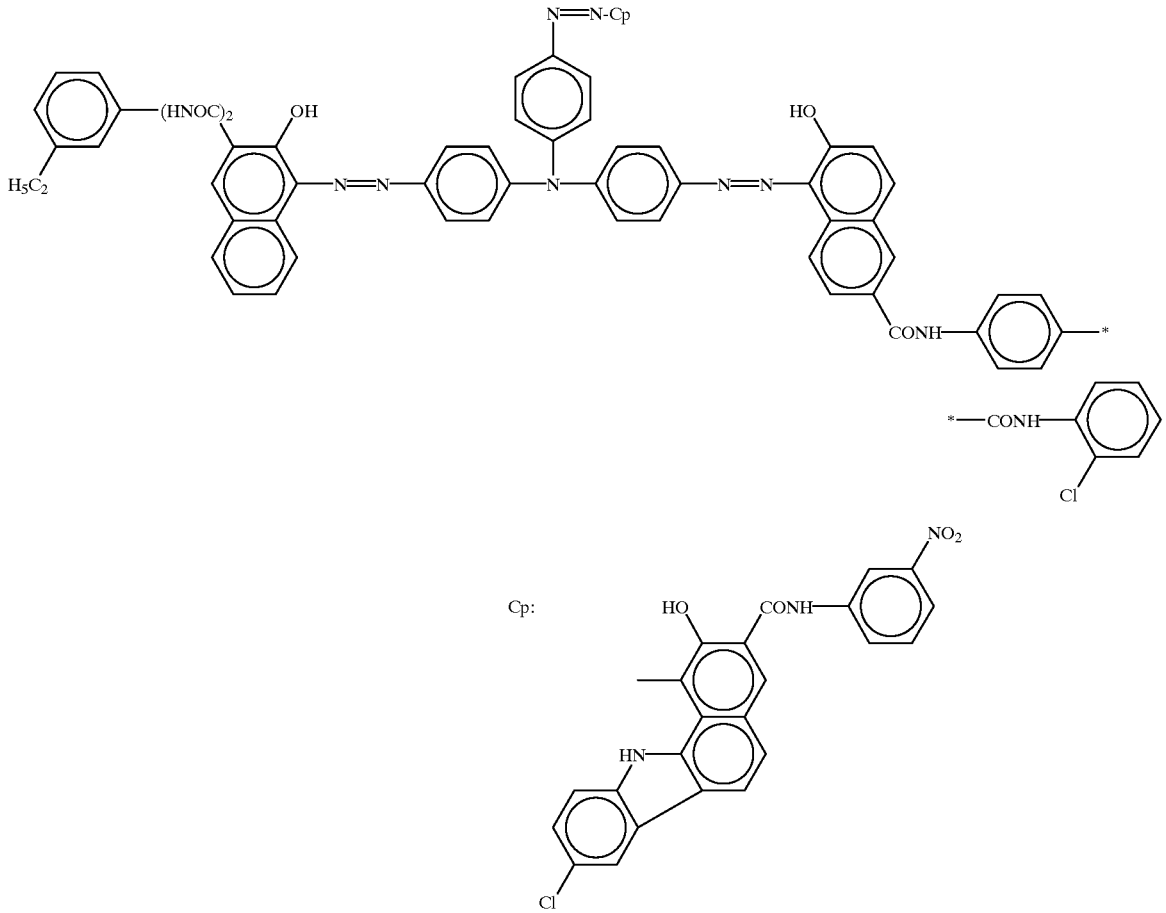
Pigment (8)-1
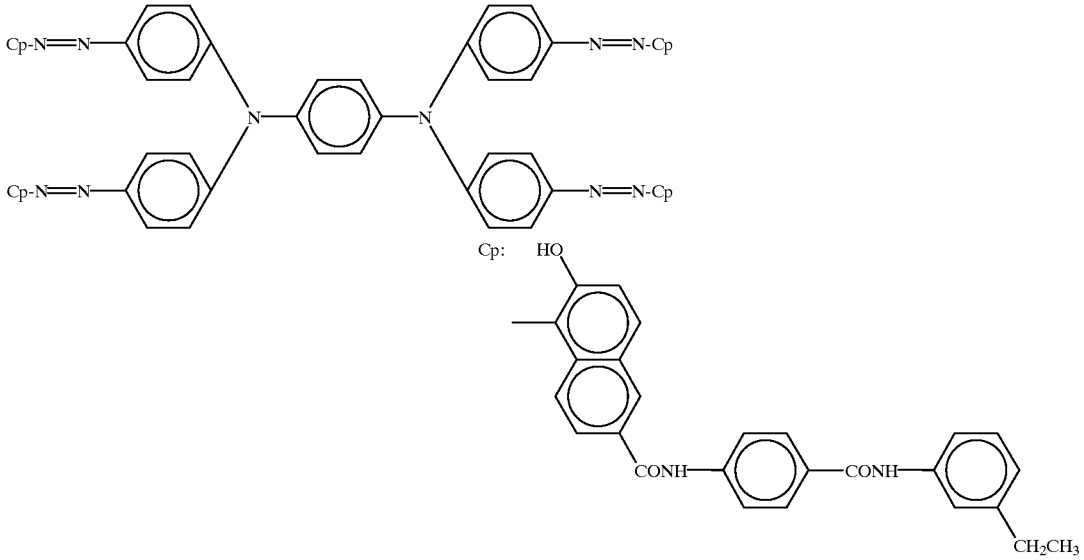

-continued
Pigment (8)-2
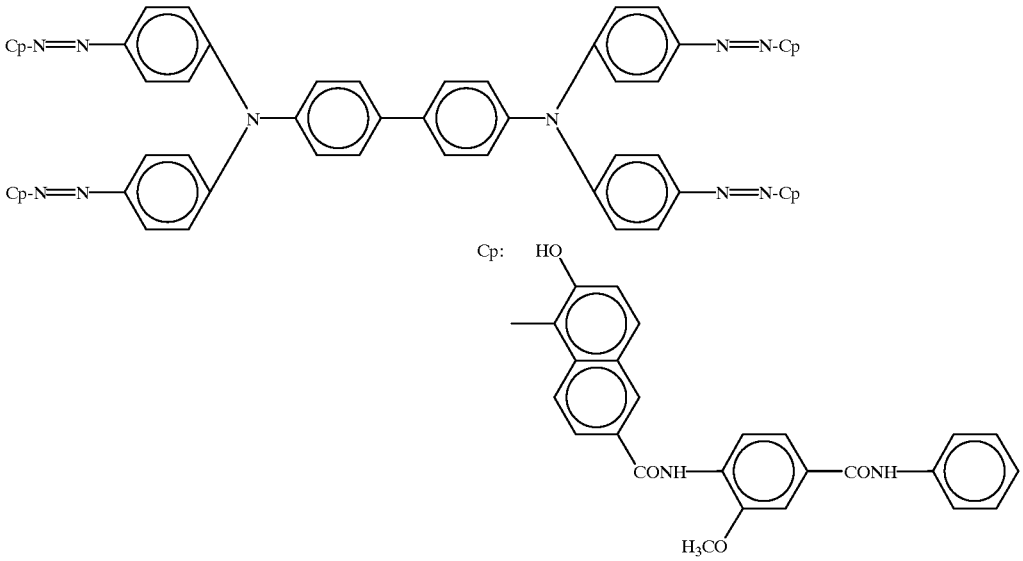
Pigment (8)-3
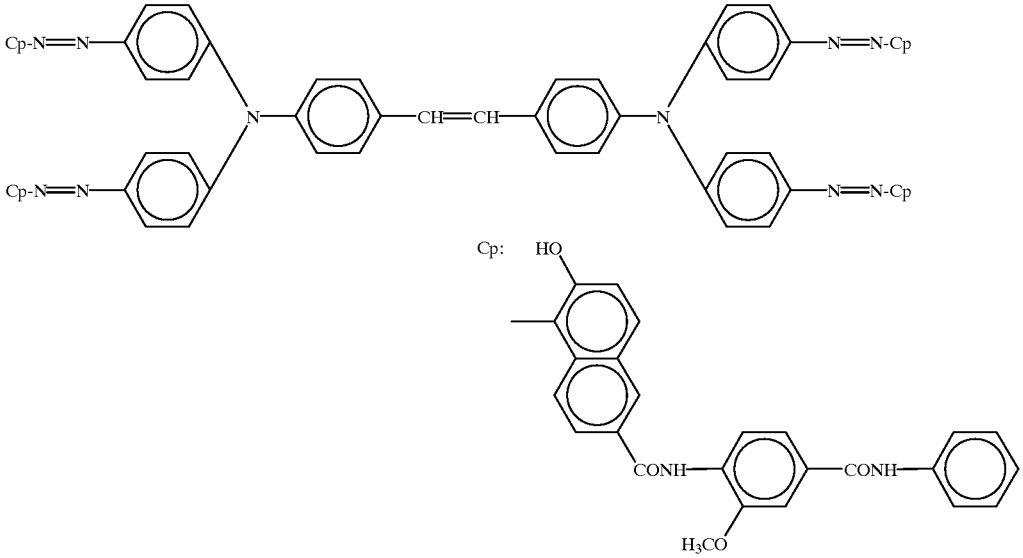

-continued
Pigment (8)-4
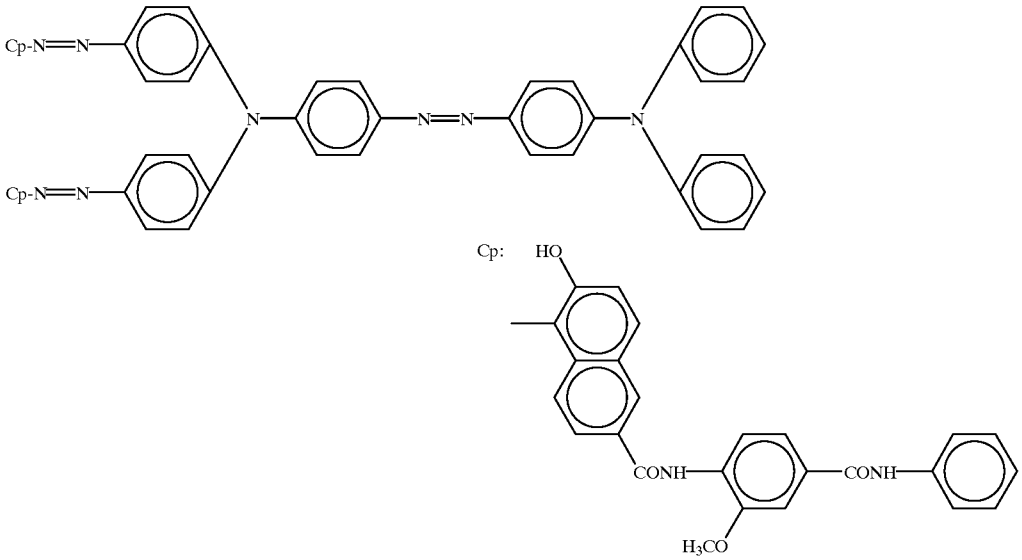
Pigment (8)-5
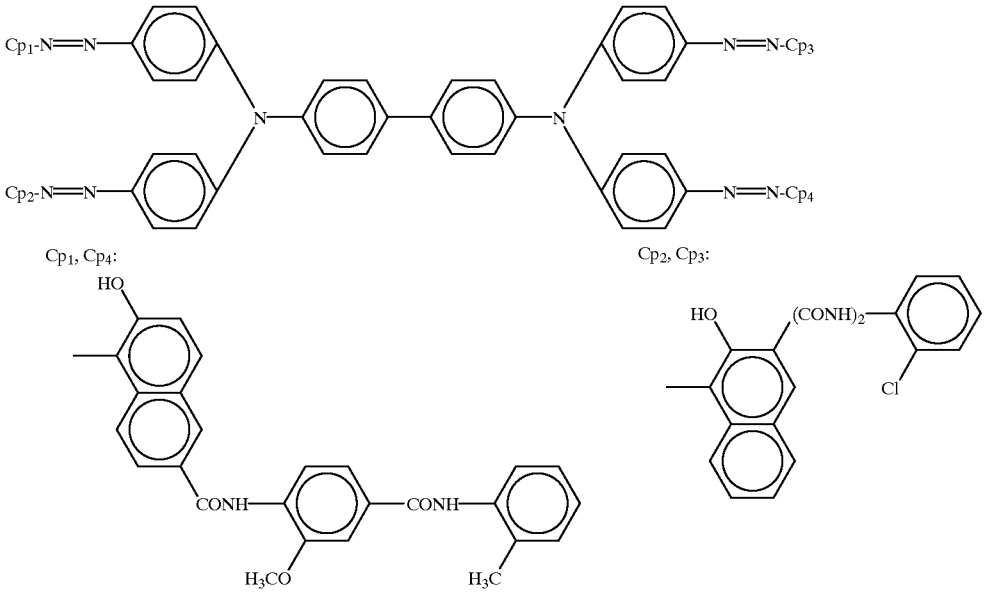
The azo pigment having an organic group represented by the above-mentioned formula (1) used in the present invention may be easily synthesized by subjecting a coupler component of formula (17) below:
(17)
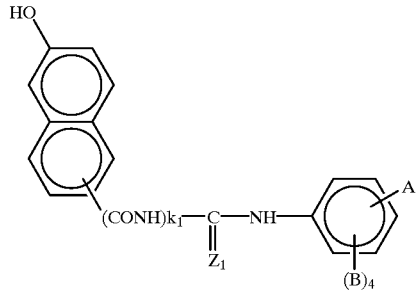

(wherein B, $Z_1$, $k_1$ and A are the same as in the formula (1)) and a compound having a diazonium salt structure to a coupling reaction in the presence of an alkali.

Further, a coupler component of the formula (17) ($k_1$=0) may be synthesized by subjecting an acid of the following formula (18):

(18)

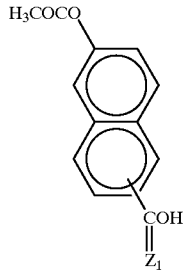

(wherein $Z_1$ is the same as in the formula (1)) and an aniline compound of the following formula (19):

(19)

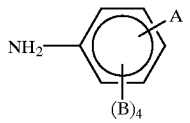

(wherein B and A are the same as in the formula (1)), and a coupler component of the formula (17) ($k_1$=1) may be synthesized by subjecting a carboxylic acid of the following formula (20):

(20)

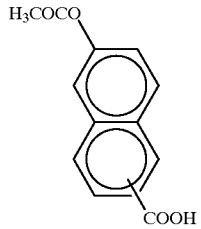

and a urea compound of the following formula (21):

(21)

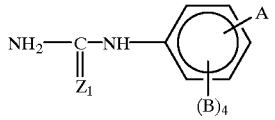

(wherein B, Z, and A are the same as in the formula (1)), respectively, to a condensation reaction under heating at 80–200° C. in the presence of phosphorus trichloride in an aromatic solvent selected from benzene, toluene, xylene, chlorobenzene, o-dichlorobenzene, etc.; or by subjecting a compound formed by reaction of the acid chloride of the following formula (22):

(22)

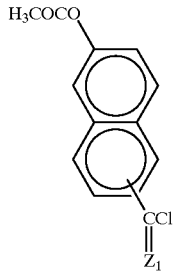

(wherein $Z_1$ is thte same as in the formula (1)) with an aniline compound of the formula (19) for the coupler component (k=0), or a urea compound of the above formula (21) for the coupler component of (k=1), respectively, in an aromatic solvent as described above under heating, to de-acetylation in an acidic or alkaline condition.

The azo pigment used in the present invention may be synthesized by subjecting the thus-obtained coupler component of the formula (17) and a diazotization product conditions of an amino compound of the following formula (24):

(24)

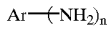

(wherein Ar and n are the same as in the above formula (2)) to a coupling reaction in the presence of an alkali in an aqueous medium according to an ordinary manner. Further, it is also possible to isolate such a diazonium salt obtained from the amino compound once in the form of a borofluoride salt, a zinc chloride complex salt, etc., and subject the isolated salt to a coupling reaction in the presence of a base, such as sodium acetate, pyridine, trimethylamine or triethylamine, in an appropriate organic solvent, such as N,N-dimethylformamide, N,N-dimethylacetamide or dimethyl sulfoxide, to obtain an azo pigment having an organic group of the formula (1) used in the present invention.

In case where the azo pigment used in the present invention has a plurality of coupler residue groups (Cp) having a phenolic hydroxyl group (e.g., n=2, 3 or 4 in the formula (2)), it is sufficient that the azo pigment includes at least one organic group (coupler residue group) according to the formula (1) but it is preferred that two or more organic group according to the formula (1).

An azo pigment having a coupler residue group other than the one according to the formula (1) in addition to the one according to the formula (l),may for example be synthesized by subjecting an amino compound of the following formula (25):

(25)

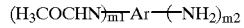

(wherein Ar is the same as in the formula (2), and ml and $m_2$ are independently 1, 2 or 3 with the proviso of $m_1+m_2 \leqq 4$) to an ordinary manner of diazotization, and subjecting the resultant diazonium salt to a coupling reaction with a coupler component of the above formula (17), followed by hydrolysis with a mineral acid such as hydrochloric acid to form an intermediate product of the following formula (26):

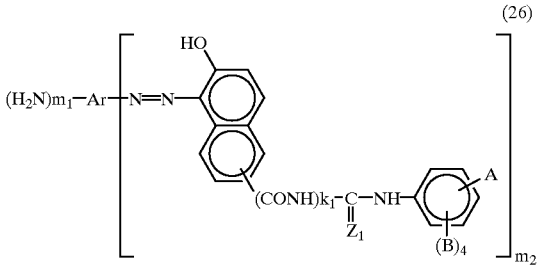

(26)

(wherein B, $z_1$, $k_1$ and A are the same as in the formula (1), and Ar, $m_1$ and $m_2$ are the same as in the formula (25)). Then, the intermediate product is again subjected to an ordinary manner of diazotization and then to a coupling reaction with a coupler component having a phenolic hydroxyl group other than those represented by the formula (17), e.g., those providing coupler residue groups (Cp) as represented the above formula (3)–(16), to provide such an azo pigment having also a coupler residue group other than the one according to the formula (1). Further, it is also possible to add a diazonium salt obtained from an amino compound of the formula (24) in an ordinary manner to a coupler mixture solution containing a plurality of couplers including at least one species according to the formula (17) to cause a coupling reaction in the presence of an alkali, thereby obtaining an objective azo pigment having also coupler residue group other than the one according to the formula (1). Such an objective azo pigment may also be obtained by first performing a primary coupling reaction with a species of coupler component of the formula (17) in the presence of an alkali and then adding an alkaline solution of another coupler component to cause a further coupling reaction.

SYNTHESIS EXAMPLE 1

(Synthesis of Pigment (2)-1)

Into a 300 ml-beaker, 150 ml of water, 20 ml (0.23 mol) of conc. hydrochloric acid and 7.8 g (0.032 mol) of anisidine were placed and cooled to 0° C., followed by dropwise addition of a solution of 4.6 g (0.067 mol) of sodium nitrite in 10 ml of water in 10 min. while maintaining the system liquid temperature at 5° C. After 15 min. of stirring, the reaction liquid was filtrated through carbon, and into the resultant filtrate, a solution of 10.5 g (0.096 mol) of sodium borofluorine in 90 ml of water was added dropwise under stirring. The resultant precipitated borofluoride salt was filtered out and washed with cold water, followed by washing with acetonitrile and dried at a reduced pressure at room temperature. The yield was 12.0 g (85%).

Then, into a 1 liter-beaker, 50 ml of N,N-dimethylformamide (DMF) was placed, and 16.7 g (0.042 mol) of a coupler compound of the following formula:

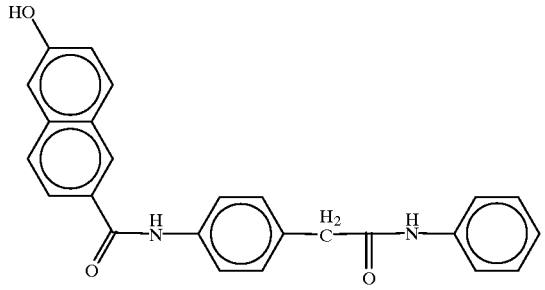

was dissolved therein, followed by cooling to 5° C., dissolution therein of 8.8 g (0.020 mol) of the above-prepared borofluoride and dropwise addition of 5.1 g (0.050 mol) of triethylamine in 5 min. After two hours of stirring, a precipitated pigment was recovered by filration, washed four times with DMF and three times with water, and then freeze-dried. The yield was 19.5 g (92%). The pigment exhibited the following elementary analysis result.

(Elementary analysis)

| | Calculated (%) | Measured (%) |
|---|---|---|
| C | 72.58 | 72.69 |
| H | 4.76 | 4.73 |
| N | 10.58 | 10.63 |

SYNTHESIS EXAMPLE 2

(Synthesis of Pigment (6)-1)

Into a 1 liter-beaker, 50 ml of N,N-dimethylformamide (DMF) was placed, and 16.1 g (0.042 mol) of 4-(2-hydroxynaphthalene-6-carboxamido)-benzanilide was dissolved therein, followed by cooling to 5° C., addition of 8.8 g (0.020 mol) of a borofluoride salt obtained in the same manner as in Synthesis Example 1, and dropwise addition of 5.1 g (0.050 mol) of triethylamine in 5 min. After 2 hours of stirring, a precipitated pigment was recovered by filtration, washed 4 times with DMF and 3 times with water, and then freeze-dried. The yield was 19.2 g (93%).

(Elementary analysis)

| | Calculated (%) | Measured (%) |
|---|---|---|
| C | 72.22 | 72.35 |
| H | 4.50 | 4.53 |
| N | 10.87 | 10.84 |

The electrophotographic photosensitive member according to the present invention comprises a support, and a photosensitive layer disposed on the support and comprising such an azo pigment having an organic group represented by the formula (1). In a preferred form of the electrophotographic photosensitive member, the photosensitive layer may be functionally separated into a charge generation layer and a charge transport layer disposed in lamination with each other.

The charge generation layer may be formed by applying a coating liquid prepared by dispersing the above-mentioned azo pigment together with a binder resin in an appropriate solvent onto a support in a known manner. The thickness may preferably be at most 5 μm, more preferably 0.1–1 μm.

The binder resin used for the above purpose may be selected from a wide scope of insulating resins, or alternatively selected from organic photoconductive polymers, such as poly-N-vinylcarbazole, polyvinylanthracene, and polyvinylpyrene. Preferred examples of the binder resin may include: polyvinyl butyral, polyvinylbenzal, polyarylates (e.g., polycondensate between bisphenol and phthalic acid), polycarbonate, polyester, phenoxy resin, polyvinyl acetate, acrylic resin, polyacrylamide, polyamide, polyvinylpyridine, cellulose resin, polyurethane, casein, polyvinyl alcohol, and polyvinyl pyrrolidone. The content of the binder resin in the charge generation layer may preferably be at most 80 wt. %, more preferably at most 40 wt. %.

The solvent used for the above purpose may preferably be selected from solvents that dissolve the above-mentioned binder resin but do not dissolve a charge transport layer or an undercoating layer which will be described hereinafter. Specific examples thereof may include: alcohols, such as methanol, ethanol and isopropanol; ketones, such as acetone, methyl ethyl ketone, and methyl isobutyl ketone; amides, such as N,N-dimethylacetamide, sulfoxides, such as dimethyl sulfoxide; ethers, such as tetrahydrofuran, dioxane, and ethylene glycol monomethyl ether; esters, such as methyl acetate and ethyl acetate; aliphatic halogenated hydrocarbons, such as chloroform, methylene chloride, dichloroethylene, carbon tetrachloride, dichlorohexane and trichloroethylene; and aromatic compounds, such as benzene, toluene, xylene, monochrolobenzene and dichlorobenzene.

The application of or coating with the coating liquid may be performed by coating methods, such as dip coating, spray coating, spinner coating, bead coating, wire bar coating, blade coating, roller coating and curtain coating.

The drying of the applied coating layer may preferably be performed by first drying at room temperature to a dryness felt by a finger touch, and then heat-drying. The heat-drying may be performed at 3–200° C. for 5 min. to 2 hours in a still state or under flowing air or gas.

The charge transport layer may be disposed on or below the charge generation layer in lamination, and functions to receive and transfer a charge carrier from the charge generation layer in the presence of an electric field.

Charge-transporting substances contained in the charge transport layer may include electron-transporting substances and hole-transporting substances. Examples of the electron-transporting substances may include: electron attractive substances, such as chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymers derived from such electron attractive substances.

Examples of the hole-transporting substance may include: carbazole compounds, such as N-ethylcarbazole and N-isopropylcarbazole; hydrazone compounds, such as N-methyl-N-phenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, pdiethylaminobenzaldehyde-N,N-diphenylhydrazone and p-pyrrolidinobenzaldehyde-N,N-diphenylhydrazone; pyrazoline compounds, such as 1-[pyridyl(2)]-3-(α-methyl-p-diethylaminostyryl)-5-(p-diethylaminophenyl)-pyrazoline, 1-diphenyl-3-(p-diethylaminostyryl)-4-methyl-5-(p-diethylaminophenyl)pyrazoline, and 1-phenyl-3-(α-benzyl-p-diethylaminostyryl)-5-(p-diethylaminophenyl)pyrazoline; styryl compounds, such as 4-diethylamino-β-naphthylstyrene, and 4 -diphenylamino-4'-methoxystilbene; oxazole compounds, such as 2-(p-diethylaminostyryl)-6-diethylaminobenzoxazole, and 2-(p-diethylaminophenyl)-4-(p-diethylaminophenyl)-5-(2-chlorophenyl)oxazole; thiazole compounds, such as 2-(p-diethylaminostyryl)-6-diethylaminobenzothiazole; triarylmethane compounds, such as bis(4-diethylamino-2-methylphenyl) phenylmethane, and 2-(N,N-p-ditolyl)amino-9,9-dimethylfluorene; polyarylalkane compounds, such as 1,1-bis(4-N,N-diethylamino-2-methylphenyl)heptane, and 1,1,2,2-tetrakis(4-N,N-diethylamino-2-methylphenyl)ethane; triphenylamine, poly-N-vinylcarbazole, polyvinylpyrene, polyvinylanthracene, polyvinylacridine, poly-9-vinylanthracene, pyrene-formaldehyde resin, and ethylcarbazole-formaldehyde resin. In addition to these organic charge-transporting substances, it is also possible to use inorganic materials, such as selenium, selenium-tellurium, amorphous silicon and cadmium sulfide. These charge-transporting substances may be used alone or in combination of two or more species.

In case where a charge-transporting substance having no film-formability is used, an appropriately selected binder resin may be used in combination therewith for forming a charge transport layer. Examples of such a binder resin may include: insulating resins, such as acrylic resin, polyallylate, polyester, polycarbonate, polystyrene, acrylonitrile-styrene copolymer, acrylonitrile-butadiene copolymer, polyvinyl butyral, polyvinyl formal, polysulfone, polyacrylamide, polyamide, and chlorinated rubber; and organic photoconductive polymers, such as poly-N-vinylcarbazole, polyvinyl-anthracene, and polyvinylpyrene.

The charge transport layer cannot have an unnecessarily large thickness because there is a certain limit for ensuring a charge carrier-transportability. The thickness may generally be 5–30 μm, preferably 10–25 μm. The formation of the charge transport layer by wet application may be performed according to appropriate coating methods as described with reference to the formation of the charge generation layer.

According to another embodiment, the electrophotographic photosensitive member according to the present invention may include a single photosensitive layer containing both the azo pigment and a charge-transporting substance. In this embodiment, in place of or in addition to a charge-transporting substance as described above, it is also possible to use a charge transfer complex comprising poly-N-vinylcarbazole and trinitrofluorenone. Such a photosensitive layer may for example be formed by dispersing the above-mentioned azo pigment and such a charge transfer complex in a solution of polyester in tetrahydrofuran, and applying the resultant coating liquid.

In any form of the photosensitive layer, at least one species of the specific azo pigment having an organic group represented by the formula (1) is contained. The azo pigment may be amorphous or crystalline. It is also possible to use a combination of two or more species of the specific azo pigment having an organic group according to the formula (1) or a combination of at least one species of the specific azo pigment and a known other charge-generating substance for the purpose of, e.g., providing the photosensitive member with an enhanced sensitivity or providing a panchromatic photosensitive member by combining pigments having different light-absorption characteristics.

The support on which the photosensitive layer is disposed may comprise any form or material as far as it can exhibit electroconductivity. For example, the support may comprise aluminum, aluminum alloy, copper, zinc, stainless steel, vanadium, molybdenum, chromium, titanium, nickel, indium, gold or platinum. In addition, it is also possible to use a plastic material (such as a shaped body of polyethylene, polypropylene, polyvinyl chloride, polyethylene terephthalate, acrylic resin, or polyethylene fluoride) coated with a vapor-deposited film of, e.g., aluminum, aluminum alloy, indium oxide, tin oxide or indium tin oxide; a support of plastic or other material further coated with a conductive material formed by dispersing electroconductive particles (of, e.g., aluminum, titanium oxide, tin oxide, zinc oxide, carbon black or silver) in an appropriate binder resin; a support comprising plastic or paper impregnated with electroconductive particles; or a support comprising an electroconductive polymer.

In the photosensitive member according to the present invention, it is also possible to dispose an undercoating layer functioning as a barrier and an adhesive. The undercoating layer may have a thickness of 0.1–10 μm, preferably 0.5–5 μm, and may comprise, e.g., casein, polyvinyl alcohol, nitrocellulose, polyamide (e.g., nylon 6, nylon 66, nylon 610, copolymer nylon, or N-alkoxymethylated nylon), polyurethane, or aluminum oxide.

The photosensitive member of the present invention can be further provided with a protective layer over the photosensitive layer for the purpose of, e.g., protecting the photosensitive layer from mechanical and chemical adverse effects of the exterior. Such a protective layer may comprise a resin or a resin containing electroconductive particles or a charge-transporting substance.

The electrophotographic photosensitive member according to the present invention may be used not only in electrophotographic copying machines but also widely in a field of various applied electrophotography inclusive of laser beam printers, CRT printers, LED printers, liquid crystal printers, printing plate production by laser beam irradiation, and digital recording system using near infrared rays.

Next, some description will be made on the process cartridge and the electrophotographic apparatus according to the present invention.

The sole figure in the drawing shows a schematic structural view of an electrophotographic apparatus including a process cartridge using an electrophotographic photosensitive member of the invention. Referring to the FIGURE, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is image-wise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. When a contact charging means is used as the primary charger 3 for charging the photosensitive member 1 uniformly, when a contact (or proximity) charging means is used, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail 12 of the apparatus body.

Incidentally, in case where the electrophotographic apparatus in a copying machine or a printer, the exposure light 4 is reflected light or transmitted light from an original, or illumination light provided by scanning with a laser beam, drive of an LED array or drive of a liquid crystal array, based on a signal produced, e.g., by reading an original with a sensor.

Hereinbelow, the present invention will be described more specifically with reference to Examples and Comparative Examples.

EXAMPLE 1

A sheet-form aluminum support was coated with a solution of 5 g of methoxymethylated nylon (Mw (weight-average molecular weight)=32,000) and 10 g of alcohol-soluble copolymer nylon (Mw=29,000) in 95 g of methanol by means of a wire bar, followed by drying to form a 1 μm-thick undercoating layer.

Then, 5 g of Pigment (2)-1 was added to a solution of 2 g of polyvinyl butyral (butyral degree=63 mol. %) in 95 g of cyclohexanone and dispersed therein by means of a sand mill for 20 hours. The resultant dispersion was applied by a wire bar onto the undercoating layer and dried to form a 0.2 μm-thick charge generation layer.

Then, 5 g of a hydrazone compound of the following formula:

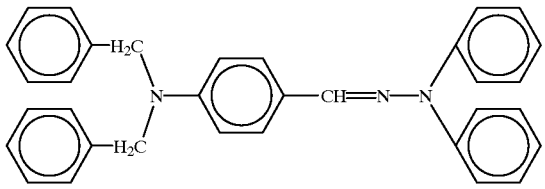

and 5 g of polymethyl methacrylate (Mn (number-average molecular weight)=100,000) were dissolved in 35 g of chlorobenzene, and the resultant liquid was applied by a wire bar onto the charge generation layer and dried to form a 20 μm-thick charge transport layer, thereby providing an electrophotographic photosensitive member of Example 1.

EXAMPLES 2–36

Electrophotographic photosensitive members of Examples 2–36 were prepared in the same manner as in Example 1 except for using Pigments, respectively indicated in Table 1.

Each of the above prepared photosensitive members of Examples 1–36 were subjected to evaluation of charging performances by negatively charging the photosensitive member with −5 kV of corona discharge, followed by standing for 1 sec. in the dark and exposure light at a luminance of 10 lux from a halogen lamp, by means of an electrostatic copying paper tester ("SP-428" (trade name), mfd. by Kawaguchi Denki K. K.). Evaluated charging performances were a surface potential $V_0$ immediately after the charging and an exposure light quantity $E_{1/2}$ required for lowering the surface potential after standing in the dark to a half thereof. The results are also shown in Table 1 below.

TABLE 1

| Ex. | Pigment | $V_0$ (−V) | $E_{1/2}$ (lux · sec) |
|---|---|---|---|
| 1 | (2)-1 | 700 | 1.75 |
| 2 | (2)-2 | 700 | 1.70 |
| 3 | (2)-3 | 710 | 1.52 |
| 4 | (2)-15 | 720 | 1.12 |
| 5 | (2)-16 | 720 | 1.22 |
| 6 | (2)-17 | 700 | 0.85 |
| 7 | (2)-18 | 710 | 0.92 |
| 8 | (2)-19 | 700 | 1.35 |
| 9 | (2)-23 | 690 | 1.52 |
| 10 | (2)-29 | 710 | 1.25 |
| 11 | (2)-30 | 685 | 1.95 |
| 12 | (2)-31 | 710 | 1.25 |
| 13 | (2)-34 | 710 | 1.17 |
| 14 | (2)-36 | 710 | 1.05 |
| 15 | (2)-39 | 710 | 0.85 |
| 16 | (2)-56 | 710 | 1.08 |
| 17 | (3)-7 | 700 | 0.98 |

TABLE 1-continued

| Ex. | Pigment | $V_0$ (−V) | $E_{1/2}$ (lux · sec) |
|---|---|---|---|
| 18 | (4)-3 | 695 | 0.92 |
| 19 | (6)-1 | 700 | 1.60 |
| 20 | (6)-13 | 700 | 1.38 |
| 21 | (6)-16 | 710 | 1.25 |
| 22 | (6)-18 | 700 | 1.58 |
| 23 | (6)-30 | 720 | 1.38 |
| 24 | (6)-32 | 685 | 1.50 |
| 25 | (6)-60 | 700 | 2.35 |
| 26 | (6)-61 | 700 | 1.85 |
| 27 | (6)-66 | 710 | 1.25 |
| 28 | (6)-71 | 700 | 1.35 |
| 29 | (6)-96 | 720 | 0.95 |
| 30 | (7)-1 | 710 | 0.85 |
| 31 | (7)-16 | 710 | 1.07 |
| 32 | (7)-18 | 700 | 1.02 |
| 33 | (7)-21 | 695 | 0.93 |
| 34 | (7)-22 | 690 | 1.25 |
| 35 | (8)-3 | 700 | 1.15 |
| 36 | (8)-4 | 685 | 1.05 |

COMPARATIVE EXAMPLES 1–5

Electrophotographic photosensitive members of Comparative Examples 1–5 were prepared in the same manner as in Example 1 except for using Comparative Pigments 1–5, respectively, shown below instead of Pigment (2)-1, and the charging performances thereof were evaluated in the same manner as in Example 1. The results are shown in Table 2.

[Comparative Pigment 1]

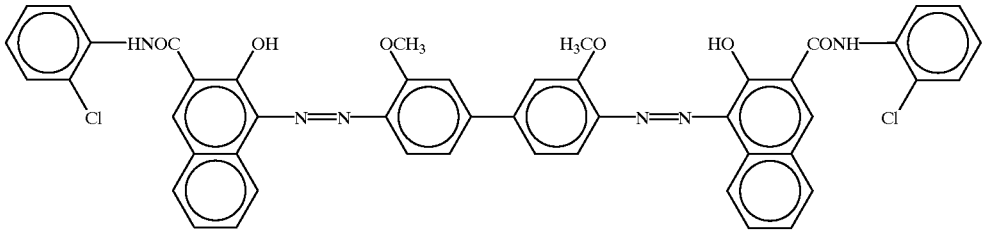

[Comparative Pigment 2]

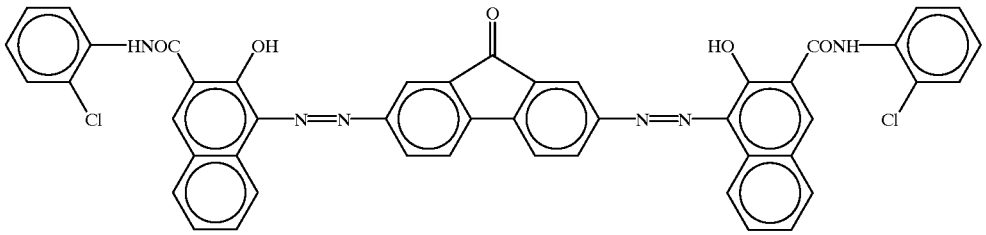

-continued

[Comparative Pigment 3]

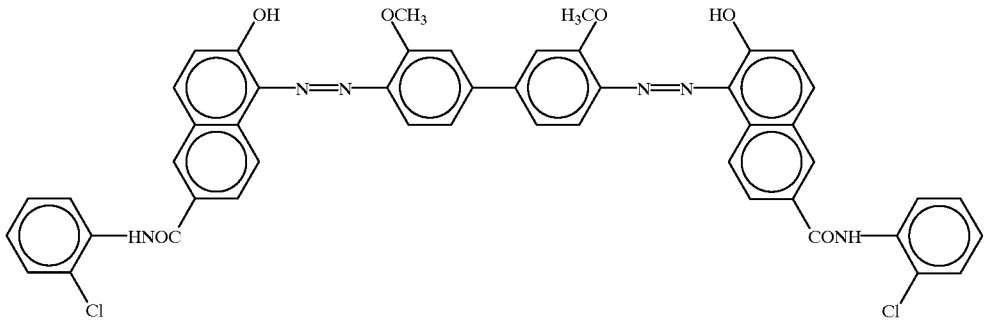

[Comparative Pigment 4]

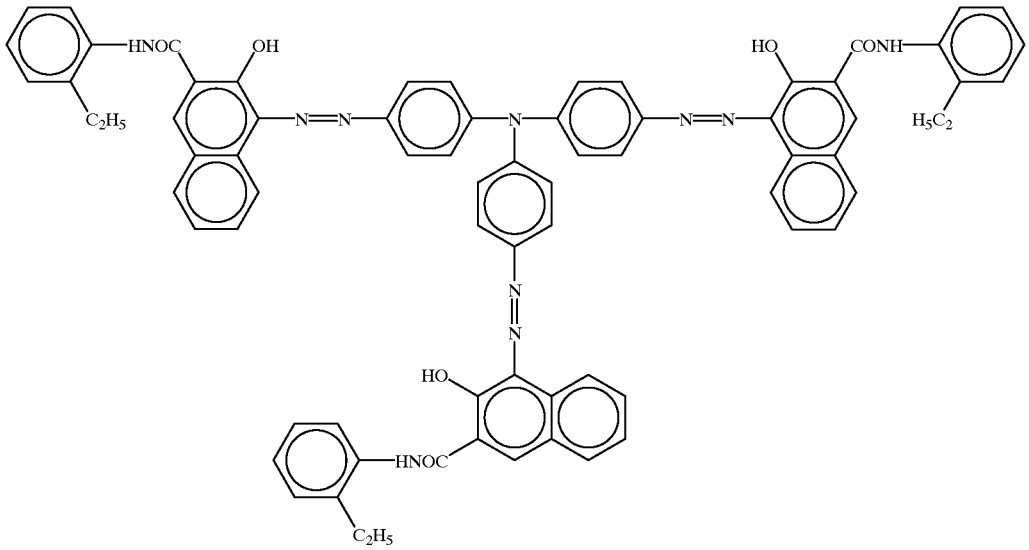

[Comparative Pigment 5]

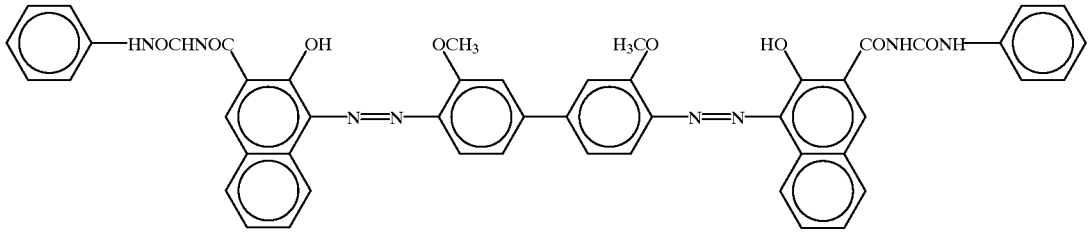

TABLE 2

| Comp. Ex. | Comp. Pigment | $V_0$ (−V) | E½ (lux · sec) |
|---|---|---|---|
| 1 | 1 | 690 | 5.4 |
| 2 | 2 | 680 | 3.4 |
| 3 | 3 | 685 | 7.9 |
| 4 | 4 | 670 | 5.5 |
| 5 | 5 | 690 | 3.7 |

From the results shown in Table 1 in comparison with those in Table 2, the electrophotographic photosensitive members according to the present invention all exhibit a sufficient chargeability and an excellent sensitivity.

EXAMPLE 37

The sheet-form electrophotographic photosensitive member prepared in Example 1 was wound about a cylinder of 30 mm in diameter, and the resultant cylindrical photosensitive member was incorporated in an electrophotographic copying machine equipped with a corona charger of −6.5 kV, an exposure optical system, a developing device, a transfer charger, a charge-removal exposure optical system and a cleaner.

The photosensitive member was subjected to 5000 cycles (rotations) of charging and exposure while setting the initial-stage dark-part potential $V_D$ and light-part potential $V_L$ to −700 volts and −200 volts, respectively. The changes in dark-part potential $\Delta V_D$ and the change in light-part potential $\Delta V_L$ were measured as differences between the last values and the initial values $V_D$ and $V_L$. The results are shown in Table 3. A positive sign (+) and a negative sign (−) in $\Delta V_D$ and $\Delta V_L$ represent an increase and a decrease, respectively, in terms of absolute values of potentials.

EXAMPLES 38–60

The evaluation of $\Delta V_D$ and $\Delta V_L$ in Example 37 was repeated by using photosensitive members of Examples 3, 4, 6, 7, 1, 11, 14, 15–23, 27–30, 32, 33 and 36. The results are also shown in Table 3.

TABLE 3

| Ex. | Photosensitive member | $\Delta V_D$ (V) | $\Delta V_L$ (V) |
|---|---|---|---|
| 37 | Ex. 1 | +20 | +25 |
| 38 | Ex. 3 | +10 | +15 |
| 39 | Ex. 4 | +10 | +10 |
| 40 | Ex. 6 | +10 | +15 |
| 41 | Ex. 7 | 0 | −5 |
| 42 | Ex. 10 | +15 | +10 |
| 43 | Ex. 11 | +10 | +5 |
| 44 | Ex. 14 | −10 | −5 |
| 45 | Ex. 15 | −10 | +5 |
| 46 | Ex. 16 | −10 | +5 |
| 47 | Ex. 17 | −10 | +5 |
| 48 | Ex. 18 | −10 | +5 |
| 49 | Ex. 19 | +10 | +10 |
| 50 | Ex. 20 | +10 | +10 |
| 51 | Ex. 21 | +5 | +5 |
| 52 | Ex. 22 | 0 | +5 |
| 53 | Ex. 23 | +5 | +5 |
| 54 | Ex. 27 | 0 | −5 |
| 55 | Ex. 28 | 0 | −10 |
| 56 | Ex. 29 | 0 | +10 |
| 57 | Ex. 30 | 0 | +10 |
| 58 | Ex. 32 | −5 | −10 |
| 59 | Ex. 33 | +5 | −10 |
| 60 | Ex. 36 | +5 | +15 |

COMPARATIVE EXAMPLES 6–10

The electrophotographic photosensitive members prepared in Comparative Examples 1–5 were respectively evaluated in the same manner as in Example 37. The results are shown in Table 4.

TABLE 4

| Comp. Ex. | Photosensitive member | $\Delta V_D$ (V) | $\Delta V_L$ (V) |
|---|---|---|---|
| 6 | Comp. Ex. 1 | −75 | +30 |
| 7 | Comp. Ex. 2 | −60 | +50 |
| 8 | Comp. Ex. 3 | −55 | +55 |
| 9 | Comp. Ex. 4 | −130 | +40 |
| 10 | Comp. Ex. 5 | −40 | +45 |

From the results shown in Table 3 in comparison with those in Table 4, the electrophotographic photosensitive members of the present invention exhibited little potential change during repetitive use.

EXAMPLE 61

On an aluminum vapor deposition layer formed on a polyethylene terephthalate film, a 1.2 μm-thick undercoating layer of polyvinyl alcohol was formed, and further thereon, a charge generation layer-forming dispersion liquid identical to the one prepared in Example 1 was applied by a wire bar and dried to form a 0.2 μm-thick charge generation layer.

Then 5 g of a styryl compound of the following formula:

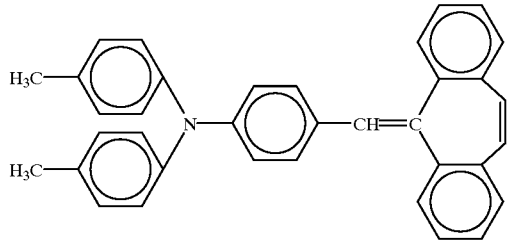

and 5 g of polycarbonate (Mw=55,000) were dissolved in 40 g of tetrahydrofuran, and the resultant solution was applied by a wire bar on the charge generation layer and dried to form a 20 μm-thick charge transport layer.

The thus-prepared electrophotographic photosensitive member was evaluated with respect to electrophotographic performances in the same manner as in Examples 1 and 37 to provide the following results:

$V_0$: −720 V $E_{1/2}$: 0.95 lux.sec $\Delta V_D$: +5 V $\Delta V_L$: +5 V

EXAMPLE 62

An electrophotographic photosensitive member was prepared and evaluated in the same manner as in Example 61 except for using a charge generation layer-forming dispersion liquid identical to the one prepared in Example 19, thereby providing the following results:

$V_0$: −710 V $E_{1/2}$: 1.40 lux.sec $\Delta V_D$: +15 V $\Delta V_L$: +5 V

EXAMPLE 63

On an aluminum vapor deposition layer formed on a polyethylene terephthalate film, a 1.0 μm-thick undercoating layer of polyvinyl alcohol was formed, and further thereon, a charge generation layer-forming dispersion liquid identical to the one prepared in Example 6 was applied by a wire bar and dried to form a 0.2 μm-thick charge generation layer.

Then 5 g of a triacylamine compound of the following formula:

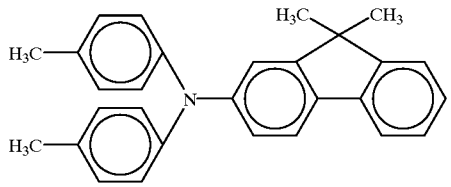

and 5 g of polycarbonate (Mw=55,000) were dissolved in 40 g of tetrahydrofuran, and the resultant solution was applied by a wire bar on the charge generation layer and dried to form a 21 μm-thick charge transport layer.

The thus-prepared electrophotographic was evaluated with respect to electrophotographic performances in the same manner as in Examples 1 and 37 to provide the following results:

$V_0$: −710 V $E_{1/2}$: 0.82 lux.sec $\Delta V_D$: 0 V $\Delta V_L$: +15 V

EXAMPLE 64

An electrophotographic photosensitive member was prepared and evaluated in the same manner as in Example 63 except for using a charge generation layer-forming dispersion liquid identical to the one prepared in Example 33, thereby providing the following results:

$V_0$: −730 V $E_{1/2}$: 0.78 lux.sec $\Delta V_D$: 0 V $\Delta V_L$: −5 V

EXAMPLE 65

An electrophotographic photosensitive member was prepared in the same manner as in Example 17 except that the charge generation layer and the c charge transport layer were laminated in a reverse order, and the photosensitive member was evaluated in the same manner as in Example 17 except that the photosensitive member was initially charged in a positive polarity, whereby the following results were obtained:

$V_0$: +700 V $E_{1/2}$: 1.37 lux.sec

EXAMPLE 66

An electrophotographic photosensitive member was prepared in the same manner as in Example 27 except that the charge generation layer and the charge transport layer were laminated in a reverse order, and the photosensitive member was evaluated in the same manner as in Example 27 except that the photosensitive member was initially charged in a positive polarity, whereby the following results were obtained:

$V_0$: +700 V $E_{1/2}$: 1.53 lux.sec

EXAMPLE 67

The preparation of the electrophotographic photosensitive member was proceeded with up to the formation of a charge generation layer in the same manner as in Example 14. Then, on the charge generation layer, a solution of 5 g of 2,4,7-trinitro-9-fluorenone and 5 g of poly-4,4'-dioxydiphenyl-2,2-propane carbonate (Mw=300,000) in 50 g of tetrahydrofuran was applied by means of a wire bar and dried to form a 20 μm-thick charge transport layer.

The electrophotographic performances of the resultant photosensitive member were evaluated in the same manner as in Example 1 except that the photosensitive member was initially charged in a positive polarity, whereby the following results were obtained:

$V_0$: +690 volts $E_{1/2}$: 1.72 lux.sec

EXAMPLE 68

An electrophotographic photosensitive member was prepared and evaluated in the same manner as in Example 67 except for using a charge generation layer-forming dispersion liquid identical to the one prepared in Example 29, thereby providing the following results:

$V_0$: +700 volts $E_{1/2}$: 1.63 lux.sec

EXAMPLE 69

0.5 g of Pigment (3)-18 and 9.5 g of cyclohexanone were subjected to 5 hours of dispersion in a paint shaker. Into the dispersion, a solution. of 5 g of the charge transport substance used in Example 1 and 5 of polycarbonate in 40 g of tetrahydrofuran was added, and the mixture was subjected to further 1 hour of shaking. The resultant coating liquid was applied on an aluminum support by means of a wire bar and dried to form a 21 μm-thick photosensitive layer.

The electrophotographic performance of the resultant photosensitive member was evaluated in a similar manner as in Example 1 except for using a positive charging polarity, whereby the following results were obtained.

$V_0$: +700 volts $E_{1/2}$: 1.25 lux.sec

EXAMPLE 70

An electrophotographic photosensitive member was prepared and evaluated in the same manner as in Example 69 except for using Pigment (7)-15 instead of Pigment (3)-18, to provide the following results:

$V_0$: +700 volts $E_{1/2}$: 1.75 lux.sec

What is claimed is:

1. An electrophotographic photosensitive member, comprising a support, and a photosensitive layer disposed on the support; said photosensitive layer containing an azo pigment having an organic group represented by formula (1) below:

(1)

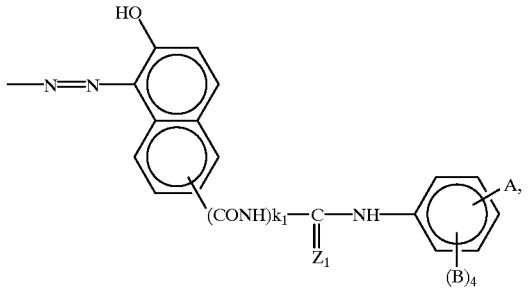

wherein each B independently denotes a hydrogen atom, halogen atom, nitro group, cyano group, substituted or unsubstituted alkyl group, substituted or unsubstituted alkoxy group, or substituted or unsubstituted amino group; $Z_1$ denotes an oxygen or sulfur atom; $k_1$ is 0 or 1; A denotes a residue group of formula (1A) below:

(IA)

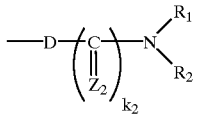

wherein $R_1$ and $R_2$ independently denote a hydrogen atom, a substituted or unsubstituted alkyl group, substituted or unsubstituted aralkyl group, a substituted or unsubstituted aryl group, a substituted or unsubstituted heterocyclic group, or a group forming a substituted or unsubstituted cyclic group by a combination of the groups R1 and R2 together with the nitrogen (N) atom in the formula (1A); $Z_2$ denotes an oxygen atom or sulfur atom; $k_2$ is 1 or 2; D denotes a substituted or unsubstituted alkylene group, substituted or unsubstituted alkenylene group or —$(CONH)_{k3}$—; and $k_3$ is 0 or 1.

2. A photosensitive member according to claim 1, wherein the azo pigment has an entire structure including a core unit to which the organic group of the formula (1) is bonded; said core unit including at least one ring unit each comprising at least one of substituted or unsubstituted aromatic hydrocarbon rings and substituted or unsubstituted heterocyclic rings with the proviso that a plurality of such ring units can be bonded to each other via an intervening bonding group.

3. A photosensitive member according to claim 2, wherein the azo pigment has an entire structure represented by formula (2) below:

$$Ar—(N{=}N—Cp)_n, \quad (2)$$

wherein Ar denotes a core unit including at least one ring unit each comprising at least one of substituted or unsubstituted aromatic hydrocarbon rings and substituted or unsubstituted heterocyclic rings with the proviso that a plurality of such ring units can be bonded to each other via an intervening bonding group; n is an integer of 1–4; and each Cp denotes a coupler residue group having a phenolic hydroxy group with the proviso that at least one of up to 4 Cp groups constituted the organic group of the formula (1).

4. A photosensitive member according to claim 3, wherein n in the formula (2) is at least 2.

5. A photosensitive member according to claim 1, wherein a group of formula (1B) below in the formula (1) is attached to a carbon at 6-position of the naphthalene ring with respect to the azo (—N=N—) group;

(1B)

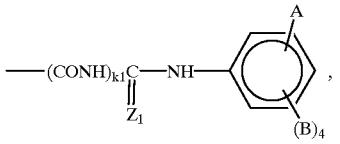

wherein each of four groups B is hydrogen, and $k_2$, $Z_2$ and D in the formula (1A) below for the group A:

(1A)

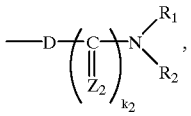

are set to satisfy one of the following conditions (a)–(c):

(a) $k_2$ is 1, $Z_2$ is oxygen, and D is —$CH_2$—, —$CH_2CH_2$—, —$CH(CH_3)$—, —$CH_2CH_2CH_2$—, or —CH=CH—;

(b) $k_2$ is 2, $Z_2$ is oxygen atom, and D is —$CH_2$—; or (c) $k_2$ is 1, $Z_2$ is oxygen or sulfur atom, and D is —$(CONH)_{k3}$— wherein $k_3$ is 0 or 1.

6. A photosensitive member according to claim 1, wherein $R_1$ in the formula (1A) is a hydrogen atom.

7. A photosensitive member according to claim 6, wherein $R_2$ in the formula (1A) is a substituted or unsubstituted alkyl group, a substituted or unsubstituted aralkyl group, or a substituted or unsubstituted aryl group.

8. A photosensitive member according to claim 7, wherein $R_2$ in the formula (1A) is a substituted or unsubstituted aryl group.

9. A photosensitive member according to claim 8, wherein $R_2$ in the formula (1A) is a substituted or unsubstituted phenyl group.

10. A photosensitive member according to claim 5, wherein $R_1$ in the formula (1A) is a hydrogen atom.

11. A photosensitive member according to claim 10, wherein $R_2$ in the formula (1A) is a substituted or unsubstituted alkyl group, a substituted or unsubstituted aralkyl group, or a substituted or unsubstituted aryl group.

12. A photosensitive member according to claim 11, wherein $R_2$ in the formula (1A) is a substituted or unsubstituted aryl group.

13. A photosensitive member according to claim 12, wherein $R_2$ in the formula (1A) is a substituted or unsubstituted phenyl group.

14. A process cartridge, comprising: an electrophotographic photosensitive member and at least one means selected from the group consisting of charging means, developing means and cleaning means; said electrophotographic photosensitive member and said at least one means being integrally supported to form a unit which is detachably mountable to a main assembly of electrophotographic apparatus;

wherein said electrophotographic photosensitive member comprises a support, and a photosensitive layer disposed on the support; said photosensitive layer containing an azo pigment having an organic group represented by formula (1) below:

(1)

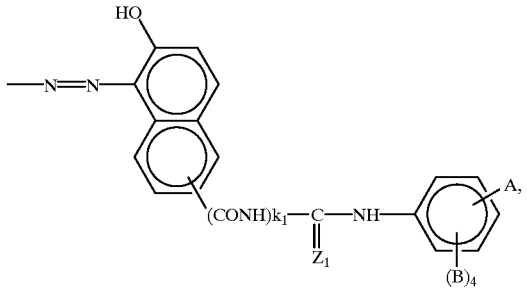

wherein each B independently denotes a hydrogen atom, halogen atom, nitro group, cyano group, substituted or unsubstituted alkyl group, substituted or unsubstituted alkoxy group, or substituted or unsubstituted amino group; $Z_1$ denotes an oxygen or sulfur atom; $k_1$ is 0 or 1; A denotes a residue group of formula (1A) below:

(IA)

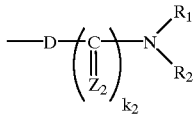

wherein $R_1$ and $R_2$ independently denote a hydrogen atom, a substituted or unsubstituted alkyl group, substituted or unsubstituted aralkyl group, a substituted or unsubstituted aryl group, a substituted or unsubstituted heterocyclic group, or a group forming a substituted or unsubstituted cyclic group by a combination of the groups R1 and R2 together with the nitrogen (N) atom in the formula (1A); $Z_2$ denotes an oxygen atom or sulfur atom; $k_2$ is 1 or 2; D denotes a substituted or unsubstituted alkylene group, substituted or unsubstituted alkenylene group or —$(CONH)_{k3}$—; and $k_3$ is 0 or 1.

15. A process cartridge according to claim 14, wherein a group of formula (lB) below in the formula (1) is attached to a carbon at 6-position of the naphthalene ring with respect to the azo (—N=N—) group;

(1B)

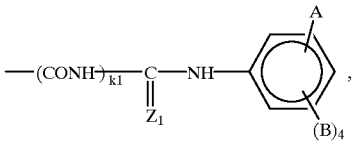

wherein each of four groups B is hydrogen, and $k_2$, $Z_2$ and D in the formula (1A) below for the group A:

(1A)

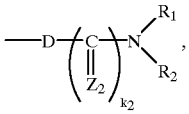

are set to satisfy one of the following conditions (a)–

(a) $k_2$ is 1, $Z_2$ is oxygen, and D is —$CH_2$—, —$CH_2CH_2$—, —$CH(CH_3)$—, —$CH_2CH_2CH_2$—, or —CH=CH—;

(b) $k_2$ is 2, $Z_2$ is oxygen atom, and D is —$CH_2$—; or (c) $k_2$ is 1, $Z_2$ is oxygen or sulfur atom, and D is —$(CONH)_{k3}$— wherein $k_3$ is 0 or 1.

16. An electrophotographic apparatus, comprising:

an electrophotographic photosensitive member, charging means, exposure means, developing means, and transfer means;

wherein said electrophotographic photosensitive member comprises a support, and a photosensitive layer disposed on the support; said photosensitive layer containing an azo pigment having an organic group represented by formula (1) below:

(1)

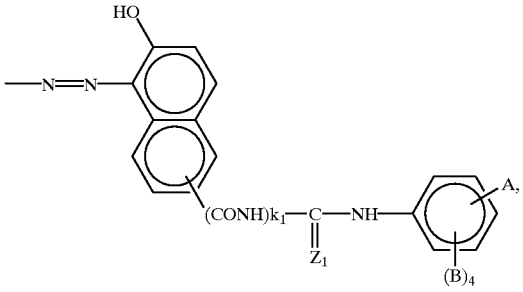

wherein each B independently denotes a hydrogen atom, halogen atom, nitro group, cyano group, substituted or unsubstituted alkyl group, substituted or unsubstituted alkoxy group, or substituted or unsubstituted amino group; $Z_1$ denotes an oxygen or sulfur atom; $k_1$ is 0 or 1; A denotes a residue group of formula (1A) below:

(IA)

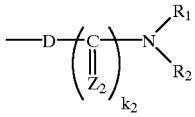

wherein $R_1$ and $R_2$ independently denote a hydrogen atom, a substituted or unsubstituted alkyl group, substituted or unsubstituted aralkyl group, a substituted or unsubstituted aryl group, a substituted or unsubstituted heterocyclic group, or a group forming a substituted or unsubstituted cyclic group by a combination of the groups R1 and R2 together with the nitrogen (N) atom in the formula (1A); $Z_2$ denotes an oxygen atom or sulfur atom; $k_2$ is 1 or 2; D denotes a substituted or unsubstituted alkylene group, substituted or unsubstituted alkenylene group or —$(CONH)_{k3}$—; and $k_3$ is 0 or 1.

17. An electrophotographic apparatus according to claim 16, wherein a group of formula (1B) below in the formula (1) is attached to a carbon of 6-position of the naphthalene ring with respect to the azo (—N=N—) group;

(1B)

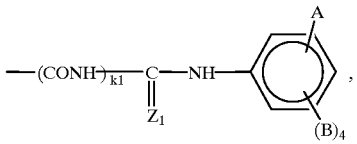

wherein each of four groups B is hydrogen, and $k_2$, $Z_2$ and D in the formula (1A) below for the group A:

(1A)

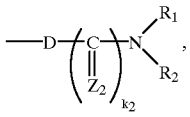

are set to satisfy one of the following conditions (a)–(c):

(a) $k_2$ is 1, $Z_2$ is oxygen, and D is —$CH_2$—, —$CH_2CH_2$—, —$CH(CH_3)$—, —$CH_2CH_2CH_2$—, or —CH=CH—;

(b) $k_2$ is 2, $Z_2$ is oxygen atom, and D is —$CH_2$—; or (c) $k_2$ is 1, $Z_2$ is oxygen or sulfur atom, and D is —$(CONH)_{k3}$— wherein k3is 0 or 1.

* * * * *

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

Column 2,
Line 35, "R1 and R2" should read -- $R_1$ and $R_2$ --.

Column 3,
Line 37, "R1 and R2" should read -- $R_1$ and $R_2$ --.

Column 4,
Line 1, "R1 and R2" should read -- $R_1$ and $R_2$ --;
Line 20, "R1, R2" should read -- $R_1$, $R_2$ --;
Line 30, "R1" should read -- $R_1$ --; and
Line 33, "R1" should read -- $R_1$ -- and "R2" should read -- $R_2$ --.

Column 8,
Line 42, "X1" should read -- $X_1$ --;
Line 56, "R4 and R5" should read -- $R_4$ and $R_5$ --;
Line 61, "R4 and R5" should read -- $R_4$ and $R_5$ --; and
Line 65, "R6 and R7" should read -- $R_6$ and $R_7$ --;

Column 9,
Line 4, "R8" should read -- $R_8$ --; and
Line 9, "Y1" should read -- $Y_1$ --.

Column 10,
Line 11, "Y2" should read -- $Y_2$ --;
Line 15, "Y3" should read -- $Y_3$ --;
Line 34, "Z3" should read -- $Z_3$ --;
Line 35, "R4 to R8" should read -- $R_4$ to $R_8$ --; and
Line 48, "X1, R4-R8, Y1-Y3" should read -- $X_1$, $R_4$-$R_8$, $Y_1$-$Y_3$ --.

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

Column 17,
Fig. (2) -5,

"

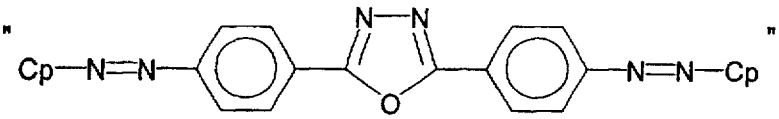

should read

--

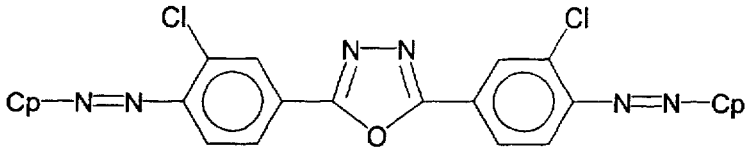

--;

Fig. (2) -6,

"

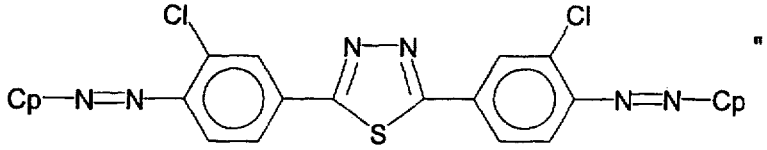

"

should read

--

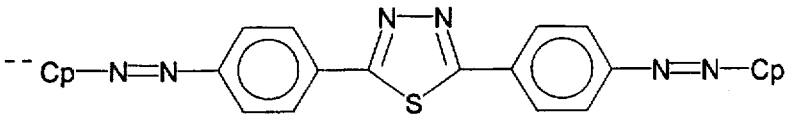

--;

and
Fig. (2) -7, "HaC" should read -- $H_3C$ --.

Column 34,
Fig. (2) -36, "CONH" should read -- $(CONH)_2$ --.

Column 66,
Fig. (4) -5, "$Cp_1$, $Cp_4$:" should read -- $Cp_2$, $Cp_3$: --.

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

Column 90,
Fig. (6) -32,

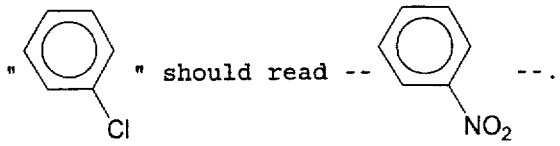

Column 115
Fig. (6) -94,

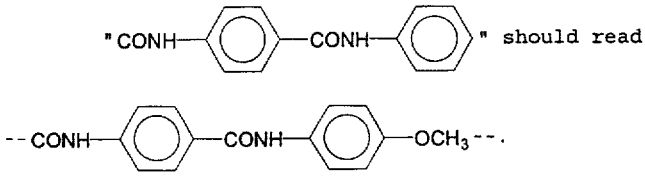

Column 130,
Fig. (6) -121,

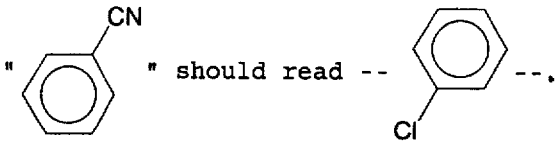

Column 133,
Fig. (6) -129, "$_3CH_2CH_2CH$" should read -- $CH_2CH_2CH_3$ --.

Column 141,
Fig. (7) -9, "

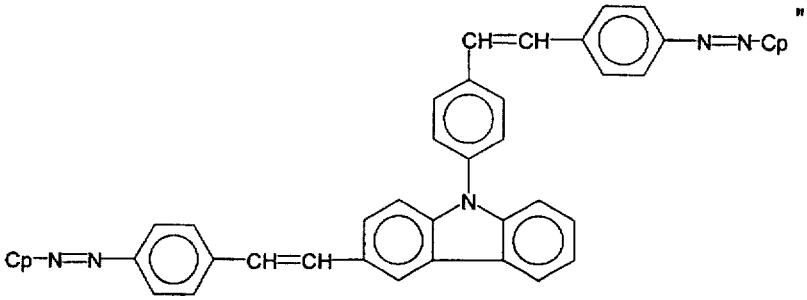

"

should read

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

-- Pigment (7) -9

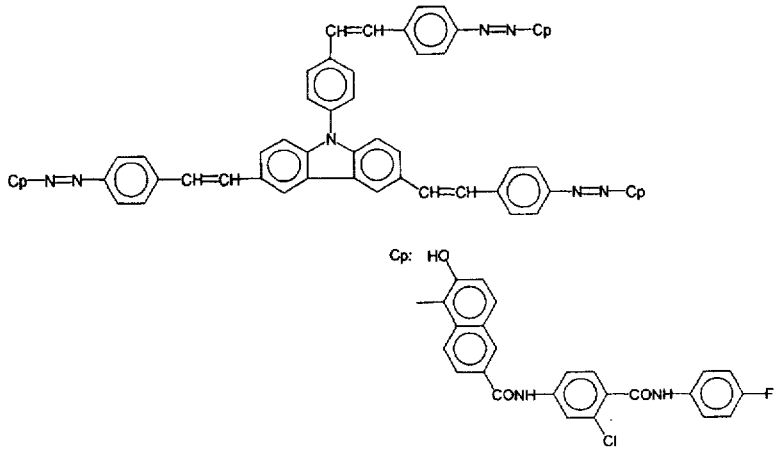

--; and

Fig. (7) -10,

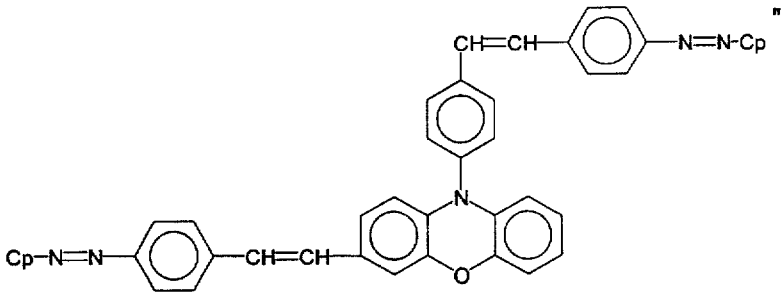

should read

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

-- Pigment (7) -10

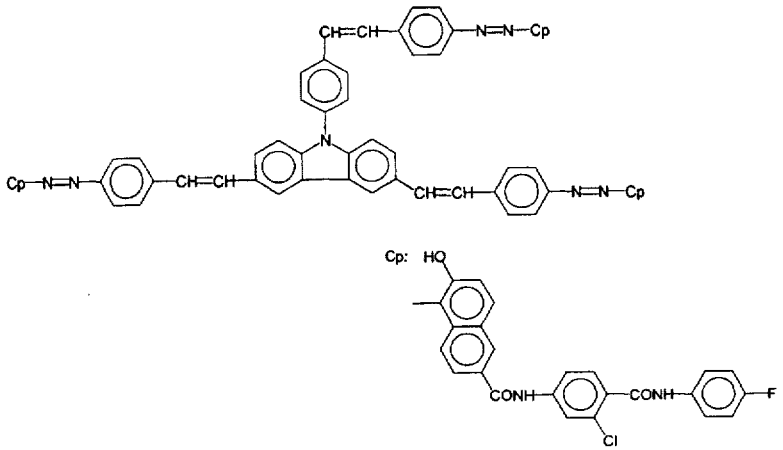

Column 149,
Fig. (7) -22, should read

" 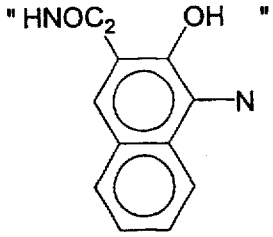

"

-- 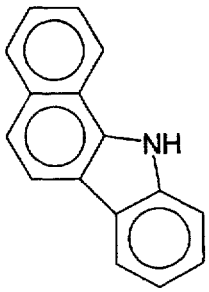

--.

UNITED STATES PATENT AND TRADEMARK OFFICE

CERTIFICATE OF CORRECTION

PATENT NO. : 6,040,100
DATED : March 21, 2000
INVENTOR(S) : Masato Tanaka et al.

It is certified that error appears in the above-identified patent and that said Letters Patent is hereby corrected as shown below:

Column 155,
Line 60, "Z," should read -- $Z_1$ --.

Column 158,
Line 18, "filration," should read -- filtration, --.

Column 159,
Line 58, "pdiethylaminobenzaldehyde" should read -- p-diethylaminobenzaldehyde --.

Column 173,
Line 30, "(a)–" should read -- (a) – (c) : --.

Signed and Sealed this

Fourth Day of December, 2001

*Attest:*

Nicholas P. Godici

NICHOLAS P. GODICI
*Acting Director of the United States Patent and Trademark Office*

*Attesting Officer*